US011591819B2

(12) United States Patent
Laue et al.

(10) Patent No.: US 11,591,819 B2
(45) Date of Patent: Feb. 28, 2023

(54) COLLAPSIBLE STRUCTURE

(71) Applicant: trac9, LLC, Huntsville, AL (US)

(72) Inventors: Greg Laue, Huntsville, AL (US); Timothy J. Wright, Huntsville, AL (US)

(73) Assignee: trac9, LLC, Huntsville, AL (US)

( * ) Notice: Subject to any disclaimer, the term of this patent is extended or adjusted under 35 U.S.C. 154(b) by 0 days.

(21) Appl. No.: 17/170,547

(22) Filed: Feb. 8, 2021

(65) Prior Publication Data

US 2021/0164256 A1 Jun. 3, 2021

Related U.S. Application Data

(62) Division of application No. 16/530,486, filed on Aug. 2, 2019, now Pat. No. 10,934,736.

(60) Provisional application No. 62/714,471, filed on Aug. 3, 2018.

(51) Int. Cl.

| | |
|---|---|
| ***E04H 15/00*** | (2006.01) |
| ***E04H 1/12*** | (2006.01) |
| ***E04H 15/20*** | (2006.01) |
| ***E04H 15/36*** | (2006.01) |

(52) U.S. Cl.

CPC ..... *E04H 15/008* (2013.01); *E04H 1/1205* (2013.01); *E04H 15/20* (2013.01); *E04H 15/36* (2013.01); *E04H 2015/201* (2013.01)

(58) Field of Classification Search

CPC ..... A45B 2023/0087; E04H 15/008; E04H 1/1205; E04H 15/20; E04H 15/36; E04H 2015/201

See application file for complete search history.

(56) References Cited

U.S. PATENT DOCUMENTS

| | | | | |
|---|---|---|---|---|
| 3,186,524 | A | 6/1965 | Spaeth | |
| 3,346,998 | A | 10/1967 | Nelson | |
| 3,407,546 | A | 10/1968 | Yates | |
| 3,531,851 | A | 10/1970 | Douglas | |
| 3,606,719 | A * | 9/1971 | Berry | E04B 1/3445 52/632 |
| 3,967,023 | A | 6/1976 | Lysek | |
| 4,666,107 | A | 5/1987 | Berry | |

(Continued)

FOREIGN PATENT DOCUMENTS

| | | |
|---|---|---|
| GB | 2183289 A | 6/1987 |
| JP | 4693692 B2 | 3/2011 |

OTHER PUBLICATIONS

International Search Report and Written Opinion for International Application Serial No. PCT/US2019/044890.

(Continued)

*Primary Examiner* — Noah Chandler Hawk

(74) *Attorney, Agent, or Firm* — Stephen H. Hall; Ryan J. Letson; Bradley Arant Boult Cummings LLP

(57) ABSTRACT

Collapsible structures are disclosed. In one embodiment, the collapsible structure includes a plurality of hinges and a plurality of panels. The plurality of panels are swingably connected by the plurality of hinges so as to form at least one arch when the collapsible structure is in an erected state and so as to become at least one stack of the plurality of panels in a collapsed state. The panels allow for the collapsible structure to maintain its structural integrity when erected but to have a compact and transportable configuration when collapsed.

7 Claims, 42 Drawing Sheets

(56) References Cited

U.S. PATENT DOCUMENTS

| | | | | |
|---|---|---|---|---|
| 4,780,344 | A | 10/1988 | Hoberman | |
| 4,981,732 | A | 1/1991 | Hoberman | |
| 6,601,598 | B2 | 8/2003 | Clee | |
| 7,874,304 | B2 | 1/2011 | Ostrowski | |
| 8,739,474 | B2 | 6/2014 | Chang | |
| 9,316,017 | B1 | 4/2016 | Slaughter | |
| 2008/0073945 | A1 | 3/2008 | Hoberman | |
| 2016/0282089 | A1* | 9/2016 | Warner | F41H 5/24 |

OTHER PUBLICATIONS

Pehrson et al., Folding Approaches for Tensioned Precision Planar Shell Structures; AIAA SciTech Forum; Jan. 8-12, 2018, Kissimmee, Florida, 2018 AIAA Spacecraft Structures Conference.

Extended European Search Report for European patent application serial No. 19844162.8 dated Mar. 25, 2022.

* cited by examiner 602
600
600
600
600
600
600
600
602
600
600
600
600
600
600
600
600
600
600
600
600
600
600
600
600
602
600
600
600
600
600
600
600
600
600
600
600
600
600
600
600
600

COLLAPSIBLE STRUCTURE

CROSS REFERENCE TO RELATED APPLICATIONS

This application is a divisional patent application of pending U.S. patent application Ser. No. 16/530,486, filed Aug. 2, 2019 and entitled "Collapsible Structure," which claims the benefit of provisional patent application Ser. No. 62/714,471, filed Aug. 3, 2018, and entitled "Collapsible Structure." The disclosure of each of the foregoing is hereby incorporated herein by reference in its entirety.

FIELD OF THE DISCLOSURE

This disclosure relates generally to collapsible structures, enclosures, shelters, habitats, and methods of forming the same, and is primarily referred to herein as a structure for simplicity.

BACKGROUND

Inflatable shelters are often used because they are portable and easily deployed. More specifically, an inflatable structure may be deflated so as to significantly reduce the volume of the inflatable structure. In this manner, the inflatable structure can be shipped when deflated. Once the inflatable shelter has been shipped, the inflatable shelter can be inflated and used as a temporary facility at the desired location.

Unfortunately, inflatable structures are typically formed by inflatable cavities constructed from flexible materials, which are filled with a gas. In addition, these cavities are usually located in discrete positions relative to the enclosed volume and usually do not enclose the entire area leaving the surface to be filled with non-rigid textile materials. These inflatable cavities are often not able to support much weight and can easily lose their structural integrity if inflation pressure is compromised due to penetrations in the pressure vessel. Furthermore, these inflatable shelters often leak and thus have to be continually inflated in order to maintain their structural integrity requiring additional systems to be employed to either limit leaks or maintain pressure.

There are also a number of different shelters that can be assembled and erected in the field. For example, there are a variety of different types of recreational tents, but many of these tents are either too small, or, for the larger variety, are often very complex and time-consuming to erect. Additionally, there are a number of different military structures that will have some type of internal support structure, often made from interconnecting poles, and a soft walled exterior. While these can often be large enough to accommodate a number of individuals, they can also take multiple individuals a number of hours to erect. These structures also take up a lot of space, and are not compact when storing or when being shipped to the desired location.

Additionally, structures that are supported through inflation or by rigid poles contain either free span materials and/or tensioned fabric material between support elements. These free span materials and fabric material can easily tear and is not amenable to attaching rigid and non-foldable electronic components, such as solar cells. With regards to structures that use fabric materials, these structures also rely on separately collapsing/extending/removing the rigid support elements (poles, rods, guide wires, tubes, etc.) from the outer fabric/weather barrier surface, which must be folded very compactly.

Thus, what is needed are portable, collapsible structures that are capable of being shipped in compact configurations, but that also can maintain their structural integrity when erected and, in some embodiments, be completely rigid over the entire enclosed volume.

SUMMARY

This disclosure relates to collapsible structures and methods of erecting the same. In one embodiment, the collapsible structure includes a first rigid panel and a second rigid panel. The second rigid panel is connected to the first rigid panel such that the first rigid panel and the second rigid panel are secured into position when the collapsible shelter is erected. In this manner, the rigid panels allow for the collapsible structure to be rigid and maintain its structural integrity.

This collapsible structure can be employed as a network of panels that form a sheet of panels or where the panels form tubular sections that deploy and collapse in a similar manner. The enclosed volume then can be covered with fabric or semi-rigid plastic materials and still maintain the same aspects of passive rigidity once deployed. The sheets of panels and the tubular sections may form arches that may be joined together. With regards to the sheets of panels, the panels may be joined so that the adjacent row of the panels form arch peaks and arch valleys.

Due to the nature of the collapsible schemes disclosed herein, each panel (or rigid frame) maintains its integrity since the panel itself does not have to deform either when the collapsible structure is collapsed or when the collapsible structure is deployed. This allows for other elements to be constructed or mounted on the rigid panels (such as photovoltaic cells and lighting devices) which could not be employed in previously known inflatable or fabric structures due to the deformation required in order to collapse the inflatable or fabric structure. The ability to collapse the collapsible structures disclosed herein without deforming the rigid panels allows the collapsible structures to more completely integrate with other components.

The collapsible structures disclosed herein fold and collapse as one complete unit without deforming either the support elements or the rigid panels and/or rigid frames. This ability eliminates the need to separately affix supports into and around tension fabric or free span material, which greatly simplifies the ease of construction and allows for direct integration of more rigid components including electronics, windows, doors and a variety of other features that cannot be readily be employed with typical tensioned fabric structures.

In space applications, this disclosure can be utilized for rigid walled habitats (or habitats that are a combination of soft and rigid elements) both on landed surfaces (Moon, Mars etc.) or even highly expandable spacecraft modules also with rigid panels or a combination of panels. This collapsible structure could also be used to support antennas of sunshields by deploying complete circular elements as a perimeter ring enclosing the soft antenna etc.

Due to the rigid nature of the deployed structured (especially with tubular elements and composite panels) that the entire assembly could be "hardened" with foam, concrete, earth, regolith etc. in the interior volumes or over the external surface.

Another potential application is simply to use this system as a roofing structure where the panels, when deployed, remain in a flat configuration but as roofing tiles or panels. This structure may be integrated into permanent structures that have lost their roofs due to, for example, weather disasters. The panels can simply be secured to the main housing structure.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

This disclosure relates to collapsible shelters and methods of erecting the same. The collapsible shelters are capable of collapsing into compact configurations so that the collapsible shelters can be easily shipped and to minimize space in storage. The collapsible shelters may also be provided in an erected state and may thus be utilized in the erected state to provide housing and/or to store different types of materials or vehicles. However, unlike previously known inflatable shelters, the collapsible shelters described herein are capable of providing a rigid structure capable of maintaining its structural integrity once the collapsible shelter has been erected.

As explained in further detail below, the collapsible structures may be formed from a plurality of rigid panels. These rigid panels may be foldable into compact configurations when the collapsible shelters are in the collapsed state. However, when the collapsible shelters are in the erected state, the rigid panels are unfolded and expand so that the collapsible shelters form a building with a desired shape. More specifically, the rigid panels may be secured into position in the erected state thereby allowing the collapsible shelter to maintain its structural integrity.

Figure 1:
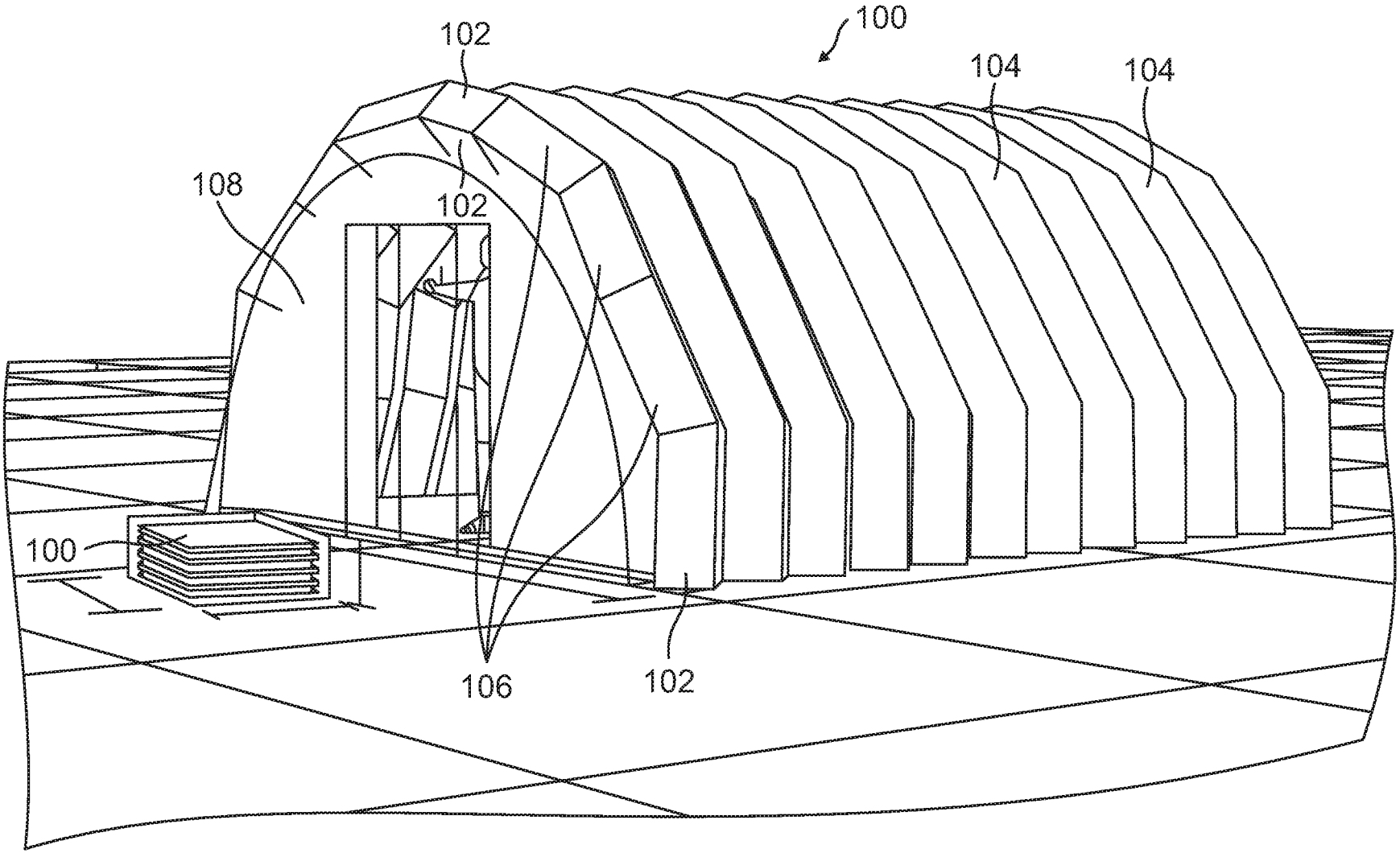
FIG. 1 illustrates an example of a collapsible shelter in the erected state and in the collapsed state.

FIG. 1 illustrates one embodiment of a collapsible shelter 100 in an erected state and a collapsed state. The collapsible shelter 100 is formed from a plurality of rigid panels 102 (not all labeled for the sake of brevity and clarity). Thus, the rigid panels 102 rigidly maintain their form. Thus, even when the collapsible shelter 100 is in the collapsed state, as shown in FIG. 1, the rigid panels 102 maintain their form allowing for the use of a variety of rigid elements and materials to form the surface of skin of the structure. In some examples, the rigid panels 102 may be formed from a rigid material and in some embodiments the rigid panels 102 can be formed from a rigid perimeter framework allowing the area of the panel element to be closed-out with a thin plastic or fabric skin or even filled with insulating materials. In some embodiments, the panels and perimeter framework are sufficiently rigid as to be filled with other materials such as a foam material, concrete, or a local fill material, buried and earth material added to the top to create an earth over structure. The rigid panels 102 may also include a double layer bladder connected to the panel perimeter that can be later filled with the material and thereby form thick rigid panels 102 for permanent installations.

Additionally, in some examples, the rigid panels 102 may be formed as hard double wall structures and thus may be formed from rigid panels that are connected. The rigid panels may be formed from any suitable rigid material such as a rigid plastic or a metal. The hard double walled structures allow for heating ventilation and air conditioning (HVAC) ducts to be formed in the hard double walled structures of the rigid panels 102 or separate panels can form ducts rather than ducts within the walled structure of the panels themselves.

Additionally, one or more of the rigid panels 102 may be formed by or may include a photovoltaic panel or photovoltaic elements. For example, a portion of the rigid panel 102 may have integrated solar panel(s) or cells that capture solar energy and convert the solar energy into electricity for use, or for storage. Thus, in some embodiments, the portion of the rigid panels 102 configured and positioned to be on the outside of the structure when erected or deployed contain the solar panel(s) or cells. In some embodiments, a separate standalone panel or attachment may include the photovoltaic elements can be secured to an existing panel.

Also integrated into one or more of the rigid panels 102 may be a lighting component, such as a light bulb, lighting tube, or other lighting element, operably associated so as to be powered by the photovoltaic panel, solar panel or cell. Other electronic components could also be powered by the photovoltaic cells and thus some of the rigid panels 102 may include electric plugs and/or the like, so that electronic components may be powered by the photovoltaic panels provided by the rigid panels 102. Wiring, batteries, power regulators, and/or power controllers, may also be provided and integrated into the panels so that power may be provided to these electronic components from the photovoltaic panels. Additionally or alternatively, one or more of the rigid panels 102 may include wiring or connections for outside power sources, which may be used to power the lighting components and electronic components integrated into the rigid panels 102 of the collapsible shelter 100 or provided inside or outside the collapsible shelter 100 when the collapsible shelter 100 has been erected.

Furthermore, as shown in FIG. 1 (and explained in further detail below) a set of these rigid panels 102 may also be joined so as to form a tubular arched structure 104 when the collapsible shelter 104 is erected. Several of these tubular arched structures 104 may form arches that extend from one side of the collapsible shelter 104 to the other side of the collapsible shelter 104 such that the ends of the tubular arched structures 104 sit on the floor or ground. In this example, various tubular arched structures 104 are connected and positioned from the front to the back of the collapsible shelter 100. These tubular arched structures 104 form the sidewalls and the roof of the collapsible shelter 104 when the collapsible shelter is erected. As explained in further detail below, subsets of the rigid panels 102 that form each of the tubular arched structures 104 form tubular sections 106 (not all labeled for the sake of clarity and brevity). Each of these tubular sections 106 has a subset of the rigid panels 102 that expand and separate from one another when erected to provide, in some embodiments, a hollow interior of the tubular section 106. Thus, the tubular arched structures 104 may also define a hollow interior. The hollow interior of the tubular arched structures 104 may also be used to provide HVAC ducts and/or wiring for the collapsible shelter 104. In other embodiments, an air bladder may be contained within one or more tubular sections 106 that may be inflated and fill the interior of the tubular section when inflated.

As shown in FIG. 1, when the collapsible shelter 100 is in the collapsed state, the rigid panels 102 are connected so as to be folded into a condensed and compact configuration. In this manner, the collapsible shelter 100 can be easily shipped and transported in the collapsed state. However, as also shown in FIG. 1, the collapsible shelter 100 can be erected so that the spacing between the rigid panels 102 expands. In this manner, the rigid panels form the tubular arched structures 104 that are formed by the plurality of tubular sections 106 that together make up tubular arched structures 104. When in the deployed or erected state, a single tubular section 106 may be comprised of four (4) separate walls, with each wall being a rigid panel 102. The tubular section 106 may be connected to other tubular sections 106 such that, in the deployed state, it forms the tubular arched structure 104. A tubular arched structure 104 may be comprised of a single row of tubular sections 106 connected at their respective ends, or a single tubular arched structure 104 may contain two or more rows of side-by-side tubular sections 106 connected at their respective ends. For example, in one embodiment of the collapsible structure shown in FIGS. 4A-4F, the collapsible structure contains two rows of side-by-side tubular sections 106, connected to form a single tubular arched structure 104. For a fixed dimension of rigid panel, the more tubular sections 106 contained in a single tubular arched structure 104, the wider the base (from where one end of the tubular arched structure 104 connects to the ground to where the other end of the tubular arched structure 104 connects to the ground) and the higher the clearance from the ground to the apex of the arch of the tubular arched structure 104. For example, the collapsible shelters 100, 200 shown in FIGS. 1 and 2 utilizes approximately ten (10) tubular sections 106, 206 for a single tubular arched structure 104, 204. However, the size and dimensions of the tubular sections 206 in FIG. 2, and thus the rigid panels 202, are substantially larger than the tubular sections 106 and the rigid panels 102 shown in FIG. 1. Thus, the tubular arched structures 204 shown in FIG. 2 have a wider base and a higher overall structure than the tubular arched structures 104 shown in FIG. 1.

Furthermore, some of the rigid panels 102 can be provided to form the front and back walls 108 and would fold and hinge in a similar manner as the primary outer surface of the collapsible shelter 100. In other embodiments, a simple fabric panel affixed to a suitable ground cloth or ground interface can be attached to the interior of the arch such that the fabric forms a closed end-wall in the structure. In this manner, the collapsible shelter 100 provides the interior volume of the collapsible shelter 100 when the collapsible structure is erected. In one configuration, the collapsible shelter 100 may be erected simply by having a human manipulate the rigid panels 102. Other configurations may utilize air bladders contained within one or more particular tubular sections 106 and/or interconnected tubing or conduits between various tubular sections 106. The collapsible shelter 100 may be configured to receive air flow (e.g., from an air compressor or pump) through an opening or valve, and as the air bladders are filled, the various rigid panels 102 of the particular tubular sections 106 are pushed apart into a deployed state and into a locked position. There may be individual openings or values for each tubular section 106, or the various tubular sections 106 may be interconnected with tubing or conduits such that a single tubular arched structure 104 has a single opening or valve, and when inflated, the entire tubular arched structure is deployed as all the air bladders are filled.

Once the collapsible shelter 100 is erected, the collapsible shelter 100 is statically stable so that the collapsible shelter 100 maintains its structural integrity. The rigid panels 102 are thus joined so that the rigid panels 102 fold to and from the compact configuration in the collapsed state to the erected configuration that defines interior volume of the collapsible shelter 100 in the erected stated. In the erected state, the rigid panels 102 furthermore are secured in position so that the collapsible shelter 100 maintains its integrity. When deployed, and connected with other tubular arched structures 104 to form a collapsible shelter 100, the shelter 100 can be secured in a manner known to those of skill in the art, including via sand bags, tie downs, etc. Additionally, the end of the tubular arched structure 104 may have a flap, extra material, or other structure to assist with securing the shelter 100 in place (e.g., a place to put sand bags, holes to receive tie downs or stakes, etc.).

In some embodiments, each of the rigid panels 102 is substantially or wholly rectangular, with four (4) rigid panels 102 forming a singular tubular section 106. However, in alternative embodiments, one or more of the rigid panels 102 may be formed in any other suitable shape such as, the shape of a different polygon, a circular shape, an elliptical shape, and/or the like and three (3) or more rigid panels 102 may form a singular tubular section 106. Furthermore, in this example, each of the tubular sections 106 has a diamond shaped cross sectional area when in the erected state. However, the tubular sections 106 may be formed so as to have any other suitable cross sectional area when erected, such as the cross-sectional area of a different polygon, a circular cross section area, an elliptical cross section area, and/or the like.

The collapsible shelter 100 shown in FIG. 1 is a housing unit, such as a barracks, a tent, or medical facility intended to house individuals. However, other implementations of the collapsible structure may form any other type of structure, as would be apparent to one of ordinary skill in the art in light of this disclosure.

It should be noted that different embodiments of the collapsible structure 100 may be provided in order to form different types of housing structures for different types of purposes. For example, some configurations of the collapsible shelter 100 may be utilized to form a tent that can be deployed during a natural disaster. Thus, the Federal Emergency Management Agency (FEMA) may utilize collapsible structures, like the collapsible structure shown in FIG. 1, in order to provide temporary housing for those left without habitable homes after a natural disaster. Other implementations of the collapsible shelter 100 may be used to provide personal tents that can be used by individuals to go camping. Still other implementations of the collapsible shelter 100 can be utilized to provide housing for a space colony. Still other implementations of the collapsible shelter 100 may be used to provide a barracks for soldiers and other military personnel. These and other implementations would be apparent to one of ordinary skill in the art in light of this disclosure.

Figure 2:
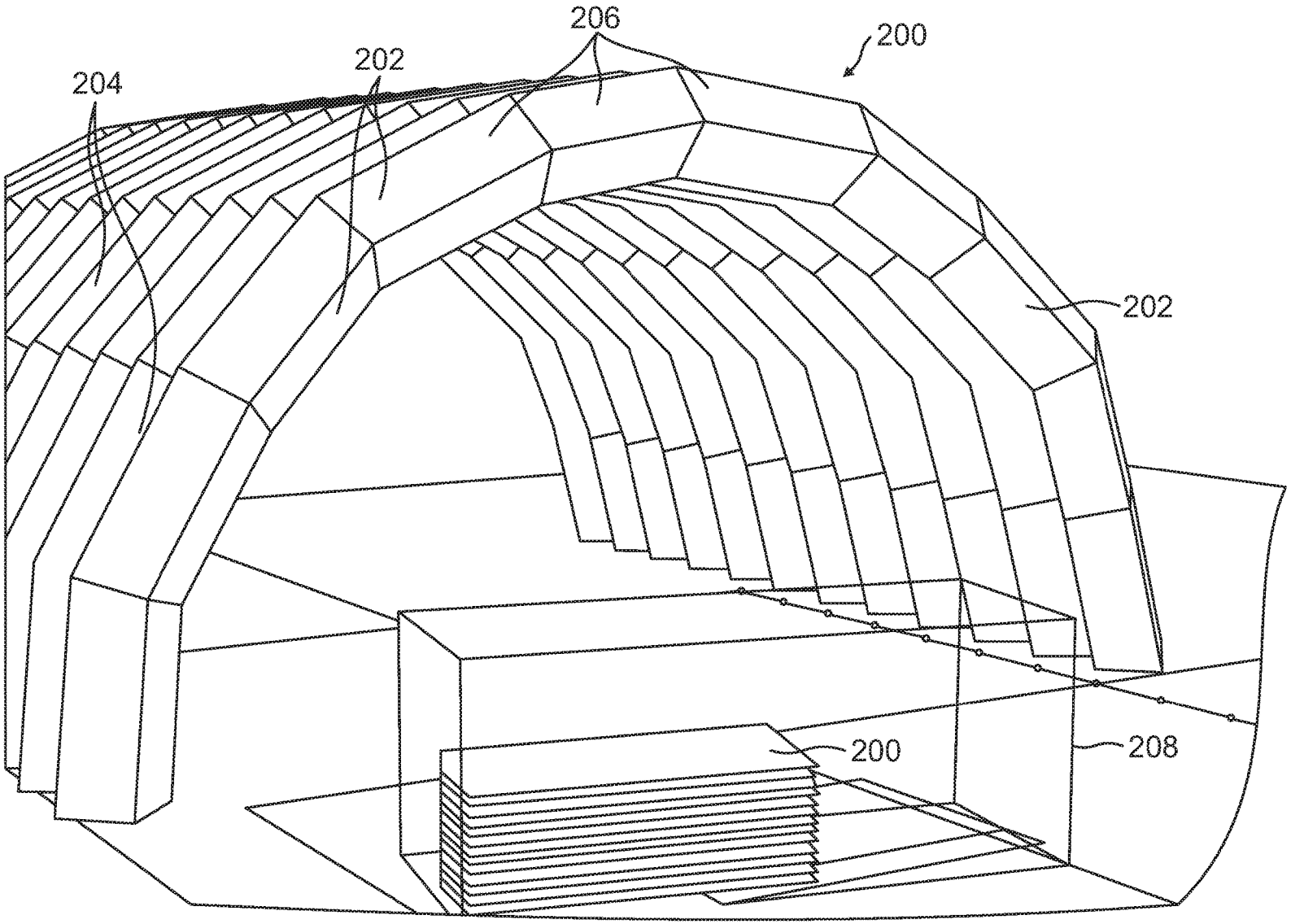
FIG. 2 illustrates another example of a collapsible shelter in the erected state and in the collapsed state.

FIG. 2 illustrates one embodiment of a collapsible shelter 200 in an erected state and a collapsed state. The collapsible shelter 200 is formed from a plurality of rigid panels 202 (not all labeled for the sake of brevity and clarity). Thus, the rigid panels 202 rigidly maintain their form. Thus, even when the collapsible shelter 200 is in the collapsed state, as shown in FIG. 2, the rigid panels 202 maintain their form. In some examples, the rigid panels 202 may be formed from a rigid material such as a foam material, concrete, a local fill material, or an earth over structure. The rigid panels 202 may also include a flexible skin that is filled with the material and thereby form the rigid panels 202

Additionally, in some examples, the rigid panels 202 may be formed as hard double wall structures and thus may be formed from rigid panels that are connected. The rigid panels may be formed from any suitable rigid material such as a rigid plastic or a metal. The hard double walled structures allow for HVAC ducts to be formed in the hard double walled structures of the rigid panels 202.

Additionally, one or more of the rigid panels 202 or one or one of the panels in the rigid panels 202 may be formed by or may include a photovoltaic panel. Also integrated into one or more of the rigid panels 202 may be a lighting component such as a light bulb or lighting tube operably associated so as to be powered by the photovoltaic panel. Other electronic components could also be powered by the photovoltaic cells and thus some of the rigid panels 202 may include electric plugs and/or the like, so that electronic components may be powered by the photovoltaic panels provided by the rigid panels 202. Wiring, power regulators, and/or power controllers, may also be provided so that power may be provided to these electronic components from the photovoltaic panels. Additionally or alternatively, one or more of the rigid panels 202 may include wiring or connections for outside power sources, which may be used to power the lighting components and electronic components integrated into the rigid panels 202 of the collapsible shelter 200 or provided inside or outside the collapsible shelter 200 when the collapsible shelter 200 has been erected.

Furthermore, as shown in FIG. 2 (and explained in further detail below) A set of these rigid panels 202 may also be joined so as to form a tubular arched structure 204 when the collapsible shelter 204 is erected. Several of these tubular arched structures 204 may form arches that extend from one side of the collapsible shelter 204 to the other side of the collapsible shelter 204 such that the ends of the tubular arched structures 204 sit on the floor or ground. In this example, various tubular arched structures 204 are connected and positioned from the front to the back of the collapsible shelter 200. These tubular arched structures 204 form the side walls and the roof of the collapsible shelter 204 when the collapsible shelter is erected. As explained in further detail below, subsets of the rigid panels 202 that form each of the tubular arched structures 204 form tubular sections 206 (not all labeled for the sake of clarity and brevity). Each of these tubular sections 206 has a subset of the rigid panels 202 that expand and separate from one another when erected to provide a hollow interior of the tubular section 206. Thus, the tubular arched structures 204 also define a hollow interior. The hollow interior of the tubular arched structures 204 may also be used to provide HVAC ducts and/or wiring for the collapsible shelter 204.

As shown in FIG. 2, when the collapsible shelter 200 is in the collapsed state, the rigid panels 202 are connected so as to be folded into a condensed and compact configuration. The sizing of the rigid panels 202, tubular arched structures 204, and tubular sections 206 are preferably sized such that they fit into standard shipping containers or spaces, either through standard commercial shipping containers and/or military transportation containers (such as STD ISO 20' and 40' containerized shipping systems) (See FIG. 2 showing a collapsed embodiment inside the standard volume 208 of a standard ISO container.). Other embodiments may be provided in other sizes depending on the particular application. In this manner, the collapsible shelter 200 can be easily shipped and transported in the collapsed state. However, as also shown in FIG. 2, the collapsible shelter 200 can be erected so that the spacing between the rigid panels 202 expands. In this embodiment, unlike the collapsible shelter 100 shown in FIG. 1, the collapsible structure shown in FIG. 2 has no front or back walls. Nevertheless, the tubular arched structures 204 enclose the top and the sides of the interior volume when the collapsible shelter 200 is erected.

Once the collapsible shelter 200 is erected, the collapsible shelter 200 is statically stable and thus no additional actions may be required to maintain the integrity of the collapsible shelter 200. The rigid panels 202 are thus joined so that the rigid panels 202 fold to and from the compact configuration in the collapsed state to the expanded configuration that defines interior volume of the collapsible shelter 200 in the erected stated. In the erected state, the rigid panels 202 furthermore are secured in position with cross tension lines interconnecting the peaks and valleys of the erected shelter to maintain its deployed shape. In other embodiments internal ribs (folded in a similar manner to the outer panels) are integrally affixed to the interior panels so that when fully deployed these ribs provide additional static stability and a means to lock the structure in place with simple tension elements. In this manner, the collapsible shelter 200 maintains its integrity.

In this embodiment, each of the rigid panels 202 is rectangular. However, in alternative embodiments, one or more of the rigid panels 202 may be any other suitable shape such as, the shape of a different polygon, a circular shape, an elliptical shape, and/or the like. Furthermore, in this example, each of the tubular sections 206 has a diamond cross sectional area. However, the tubular sections 206 may be formed so as to have any other suitable cross sectional area, such as the cross-sectional area of a different polygon, a circular cross section area, an elliptical cross section area, and/or the like. These and other implementations of the collapsible shelter 200 would be apparent to one of ordinary skill in the art in light of this disclosure.

This embodiment of the collapsible shelter 200 forms a storage facility for vehicles in the erected state. It should be noted that different embodiments of the collapsible shelter 200 may be provided in order to form different types of storage facilities or buildings. For example, some configurations of the collapsible shelter 200 may be utilized to form a storage facility for food and medical supplies. Other implementations of the collapsible shelter 200 may be used as part of a military or commercial facility that can be easily transported from location to location. Still other implementations of the collapsible shelter 200 can be utilized as part of a large building in a space colony. These and other implementation would be apparent to one of ordinary skill in the art in light of this disclosure.

Figure 3:
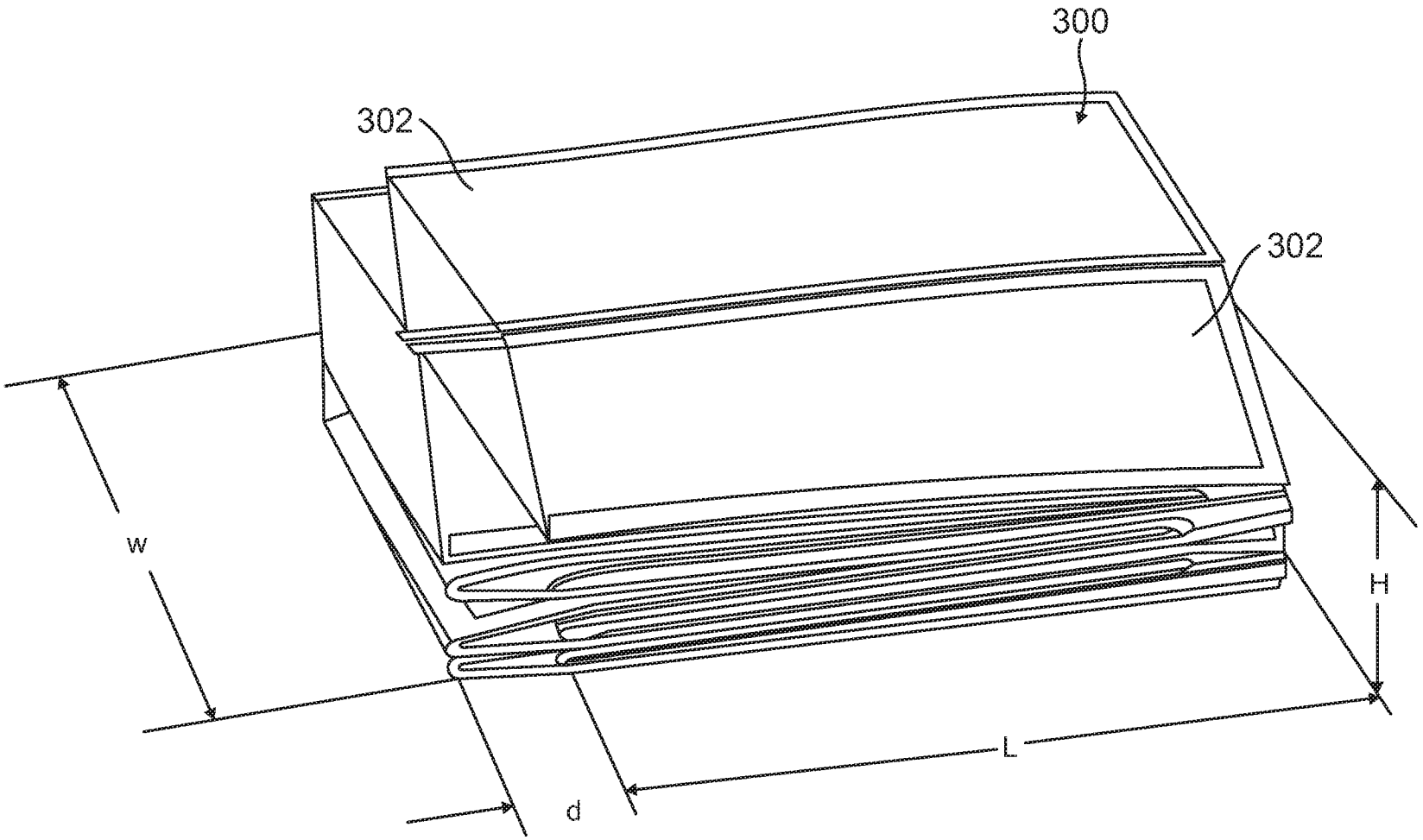
FIG. 3 illustrates a collapsible structure folded into a compact configuration when in the collapsed state.

FIG. 3 illustrates a collapsible structure 300 that include two side-by-side rows of tubular sections, which each tubular section having rigid panels 302, in a collapsed state. In this embodiment, the two rows may be erected so as to form one of the tubular arched structures (having two side-by-side rows), like the tubular arched structures 104 shown in FIG. 1 and the tubular arched structures 204 shown in FIG. 2, as explained in further detail below. As shown in FIG. 3, the collapsible structure 300 thus has rigid panels 302 (like the rigid panels 102 shown in FIG. 1 and the rigid panels 202 shown in FIG. 2). The rigid panels 302 are connected so as to be foldable into a compact configuration, as shown in FIG. 3. In the compact configuration, the collapsible structure 300 has a width of W, and a height of H. In this example, the height H is twice the height h of one of the rows (in a collapsed configuration), since there are two rows. The length of the two rows in the compact configuration is L+d, where L is the length of all of the row and d is the length of the peak and valleys in the row. In this configuration, in an erected, deployed form, the internal width from the inside wall of one tubular section to the inside wall of the opposing tubular section (where they both contact the ground) is approximately 2.1 feet (25 inches), and the height from the ground to the inside surface of the tubular section at its highest point is approximately 2.5 feet (30 inches). Similarly, the length of the tubular section as a whole (consisting of two side-by-side rows in this embodiment) would be approximately 6.2 feet, and if additional length was desired, additional tubular sections could be added together. Separate tubular sections can be connected together using any conventional connector means, which may be incorporated into the tubular arched structures at one or more locations along its perimeter, including clips, buckles, straps, latches, hook and loop material, male/female connectors, and the like.

In this embodiment, some of the rigid panels 102/202/302 have different dimensions. For example, with reference to FIG. 4A-4F, each row 402 of the tubular arched structure 404 may be comprised of approximately ten (10) tubular sections 406, and the tubular sections 406 may contain rigid panels 302 of different sizes and dimensions. For those embodiments with symmetrical shape (i.e., the left side reflects the right side), opposing tubular sections 406 will have corresponding sizes and shapes. In other words, for each row 402, the tubular section 406 on the left side that touches the ground ("$1^{st}$ left side tubular section") will normally have the same dimensions as the tubular section 406 on the right side that touches the ground ("$1^{st}$ right side tubular section"). Similarly, the $2^{nd}$ tubular section 406 on the left side (adjacent to the $2^{nd}$ left side tubular section) will have the same dimensions as the $2^{nd}$ tubular section 406 on the right side, and so forth. If an odd number of tubular sections 406 is used, the tubular section 406 directly overhead at its highest point may have dimensions similar to or different from other tubular sections 406.

In the embodiment shown in FIGS. 4A-4F, the rigid panels 302 generally have the following dimensions:

the rigid panels 302 of the 1st left side tubular section—width—1 foot to 3 feet, length—2 feet to 6 feet, height—1 to 6 inches, depth—0.25 inches to 6 inches.

the rigid panels 302 of the 2nd left side tubular section—width—1 foot to 3 feet, length—2 feet to 6 feet, height—1 to 6 inches, depth—0.25 inches to 6 inches.

the rigid panels 302 of the 3rd left side tubular section—width—1 foot to 3 feet, length—2 feet to 6 feet, height—1 to 6 inches, depth—0.25 inches to 6 inches.

the rigid panels 302 of the 4th left side tubular section—width—1 foot to 3 feet, length—2 feet to 6 feet, height—1 to 6 inches, depth—0.25 inches to 6 inches.

the rigid panels 302 of the 5th left side tubular section—width—1 foot to 3 feet, length—2 feet to 6 feet, height—1 to 6 inches, depth—0.25 inches to 6 inches.

In other embodiments, the left and right sides of the tubular arched structure do not have the same sizes and configurations. The sizes and dimensions of the rigid panels 302 can be modified depending on the size of the desired structure. For example, in some embodiments, the dimensions of the tubular sections 406 have the following ranges:

1st left side tubular section—width—1 foot to 3 feet, length—2 feet to 12 feet, height—1 to 6 feet 2nd left side tubular section—width—1 foot to 3 feet, length—2 feet to 12 feet, height—1 to 6 feet 3rd left side tubular section—width—1 foot to 3 feet, length—2 feet to 12 feet, height—1 to 6 feet 4th left side tubular section—width—1 foot to 3 feet, length—2 feet to 12 feet, height—1 to 6 feet 5th left side tubular section—width—1 foot to 3 feet, length—2 feet to 12 feet, height—1 to 6 feet In one example where the collapsible structure 300 forms two of the rows in the collapsible shelter 200, W=25 inches, h=2.5 inches (and thus H=5 inches), L=32 inches, and d=3.5 inches. Additional rows may be added to the collapsible structure 300 to provide additional tubular arched structures in a collapsible shelter (e.g., the collapsible shelter 200 shown in FIG. 2). As the number of rows are increased, the size of the collapsible shelter 200 in the compact configuration increases as:

Width=W (constant)

Height=h*number of rows

Length=L+(d*number of rows)

In one configuration, the collapsible structure 200 shown in FIG. 2 is provided in the compact configuration such that W=2.1 feet (25 inches), H=2.5 feet (30 inches), and L=6.2 feet (74 inches), where the collapsible shelter 200 has 12 tubular arched structures 204, as shown in FIG. 2. This volume is significantly less than standard volume 208 of an International Standards Organization (ISO) container used for shipping. Thus, the collapsible structure 200 in accordance with these measurements would be easily transportable via standard shipping.

It should be noted that while the rows of the collapsible structure 300 are configured to form a tubular arched structure (like the tubular arched structures 104 shown in FIG. 1 and the tubular arched structures 204 shown in FIG. 2), the rows of the collapsible structure 300 may be used to form other types of tubular structures such as straight walls, sections of roofs, arched walls, and/or the like. In fact, different embodiments of the rows may be utilized to form any suitable structure since the connections between the rigid panels 302 can be provided in the erected state in any suitable manner.

Figure 4A:
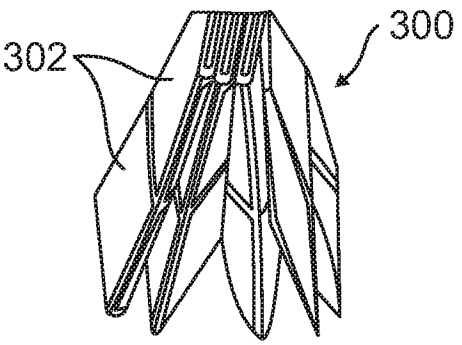
FIGS. 4A-4F illustrate the collapsible structure shown in FIG. 3 as the collapsible structure transitions from the collapsed state to the erected state.
Figure 4B:
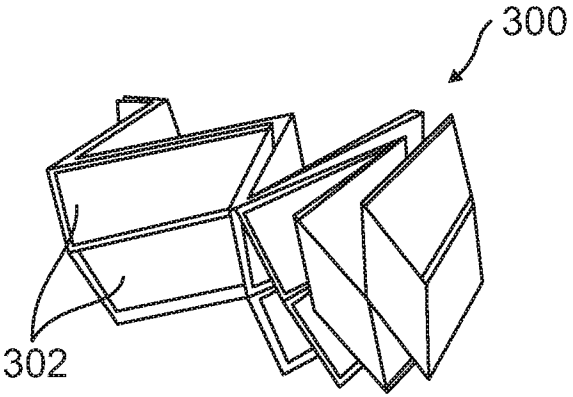
Figure 4C:
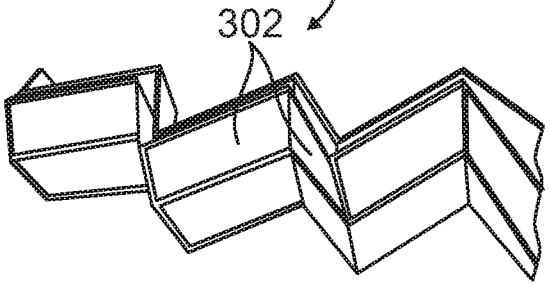
Figure 4D:
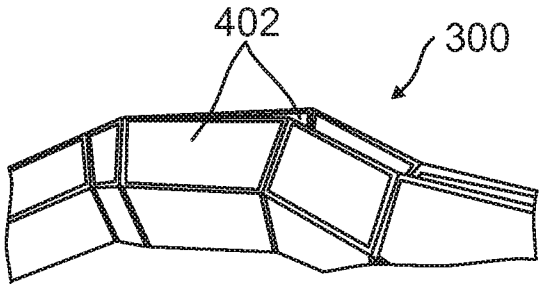
Figure 4E:
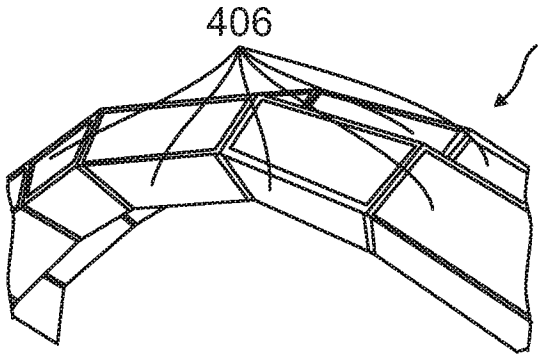
Figure 4F:
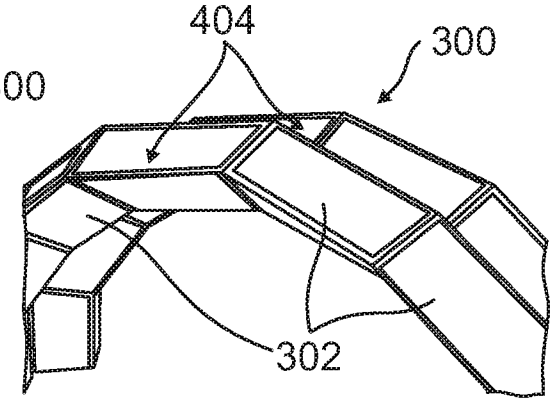
Figure 5:
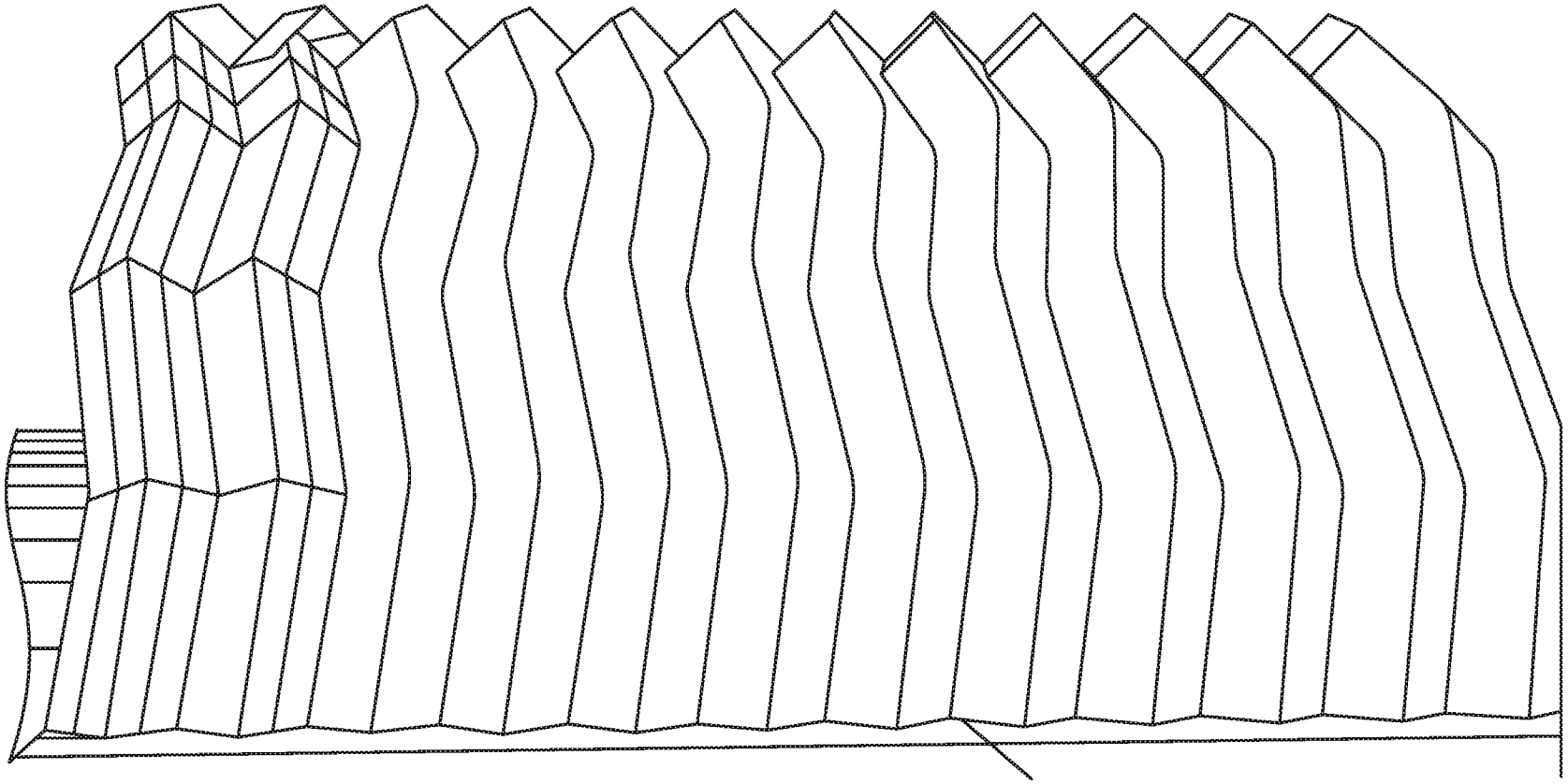
FIG. 5 illustrates a side view of an exemplary embodiment of a collapsible shelter in an erected state, with the highlighted section corresponding to the collapsible structure shown in FIGS. 4A-4F.

Referring now to FIGS. 4A-4F, FIG. 4A-4F shows the progression of the collapsible structure 300 as the collapsible structure 300 transitions from the compact configuration in the collapsed state to the erected state. As shown in FIGS. 4A-4F, the collapsible structure 300 has two rows 402. Each row 402 includes a set of the rigid panels 302 (not all labeled for the sake of brevity and clarity). As shown in FIG. 4F, the rows 402 form a tubular arched structure 404. Furthermore, subsets of the rigid panels 302 within each row 402 of the tubular arched structure 404 form tubular sections 406 (not all labeled for the sake of brevity and clarity). In this particular example, each tubular section 406 is formed by four of the rigid panels 302. For each of the tubular sections 406, the lateral edges of the four rigid panels 302 are connected to form the tubular section 406. In the erected state, in this embodiment, the rigid panels 302 are secured into position so that each of the tubular sections 406 defines a hollow interior with a diamond shaped cross sectional area. The vertical edges of each tubular section 406 are connected to the vertical edges of the rigid panels 302 of the next tubular section 406 in the rows 402. For each of the tubular arched structures 404, the connection between the vertical edges of the rigid panels 302 of the tubular sections 406 are also secured at a particular angle. In this manner, each row 402 forms the tubular arched structure 404 when erected. To join each of the rows 402, the joined lateral edges of the two rigid panels 302 of each tubular section 406 in one of the rows 402 are connected to the joined lateral edges of the two closest joined rigid panels 302 of one of the tubular sections in the other one of the rows 402. These connections are secured into place in the erected state so that the tubular arched structure 404 is secured in a particular orientation.

The connections between the rigid panels 302 of a particular tubular section 406, and the adjacent rigid panels 302 of adjacent tubular sections 406 provide a gap between the rigid panels 302 that is large enough to enable the tubular arched structure 404 to be folded into the configuration shown in FIG. 4A, but are sufficiently secure so as to ensure that the rigid panels 302 do not separate during use.

It should be noted that other configurations of the rows 402 have rigid panels 302 that are secured in other positions as would be apparent to one of ordinary skill in the art in light of this disclosure.

The present disclosure encompasses collapsible shelters (e.g., the collapsible shelters 100, 200, etc.) provided in sizes comparable to the sizes of existing shelters. For example, some existing shelters provide floor space dimensions of (1) 4.1 m×4.1 m, (2) 4.1 m×5.4 m, (3) 4.1 m×6.6 m, (4) 4.1 m×7.8 m, (5) 4.1×9 m, and (6) 4.1×10.2 m, and which have may have corresponding exterior dimensions (L×W×H) of (7) 4.7×4.7×3.2 m, (8) 5.9×4.7×3.2 m, (9) 7.1×4.7×3.2 m, (10) 8.3×4.7×3.2 m; (11) 9.5×4.7×3.2 m; and (12) 10.8 v 4.7×3.2 m. These shelters (respectively) can have packaged dimensions of (1) 132×93×54 64 cm, (2) 132×98×67 cm, (3) 132×104×70 cm, (4) 132×109×74 cm; (5) 132×118×77 cm, and (6) 132×127×80 cm. The present disclosure also encompasses collapsible shelters that are scalable (up or down) and extendable in length depending on how many tubular arched structures (e.g., 104, 204, 404, etc.) are connected. In addition, this disclosure encompasses collapsible shelters having a similar floor space and square footage as existing shelters but having a smaller packaged volume than the existing shelters outlined above and around ½ or ¾ of the weight. The rigid panels (e.g., 102, 202, 302, etc.) can also include insulation, integrated photovoltaic cells, lighting, etc. These collapsible shelters can also be erected by 1-2 individuals in less time than other existing shelters.

Figure 6:
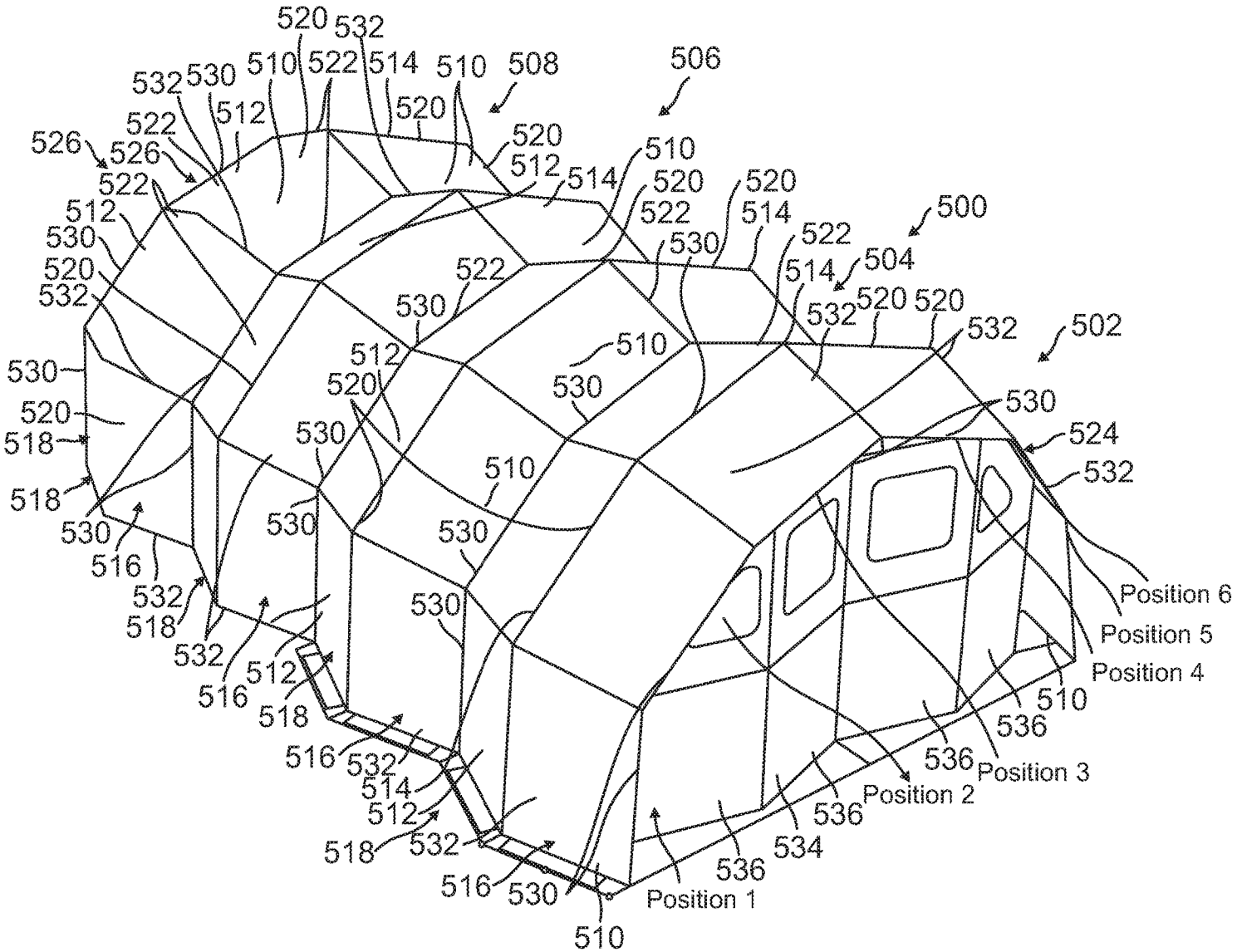
FIG. 6 illustrates another example of collapsible structure in an erected state, where the collapsible shelter includes sheets of panels that form arches.

FIG. 6 illustrates another embodiment of collapsible structure 500 in an erected state. This embodiment of the collapsible structure 500 is also formed from various arches 502, 504, 506, 508, in this case the four arches 502, 504, 506, 508. Other embodiments of the collapsible structure 500 may have any number of arches 502, 504, 506, 508. Like the collapsible shelters 100, 200, 300, the collapsible structure 500 is formed from the rigid panels 510, 512 (not all labeled for the sake of clarity) which may be the same as the rigid panels 102, 202, 302 described above. These rigid panels 510, 512 are foldable into compact configurations when the collapsible structure 500 is in the collapsed state. However, when the collapsible structure 510, 512 is in the erected state (as shown in FIG. 6), the rigid panels 510, 512 are unfolded and expand so that the collapsible structure 500 form a building with a desired shape. More specifically, the rigid panels 510, 512 may be secured into position in the erected state thereby allowing for the collapsible structure 500 to maintain its structural integrity. In this embodiment, the collapsible structure 500 is a collapsible shelter, such as a collapsible tent that may be used by military personnel in the field. However, other embodiments of the collapsible structure 500 may form any type of shelter, such as an aircraft hangar, a barracks, a storage facility, a computer networking facility, and/or the like.

Unlike the collapsible shelters 100, 200, 300 that were described above, the panels 510, 512 do not form the arches 502, 504, 506, 508 by forming tubular sections. Instead, the panels 510, 512 form the arches 502 through their geometric configuration. In particular, each of the arches 502, 504, 506, 508 has a pair of panels 510, 512 at different positions along the arches 502, 504, 506, 508. The number of positions along the arches 502, 504, 506, 508 depends on the overall geometrical polygonal shape selected to form the arches 502, 504, 506, 508. In the example illustrated in FIG. 6, the collapsible structure 500 is formed by six sided arches 502, 504, 506, 508 and thus there are pairs of panels 510, 512 at six positions (position 1, position 2, position 3, position 4, position 5, and position 6) along each of the arches 502, 504, 506, 508. Other embodiments of the arches 502, 504, 506, 508 may have any other suitable geometrical polygonal shape and may thus have a different number of positions in accordance with their corresponding geometrical polygonal shape.

The geometric configuration of the arches 502, 504, 506, 508 are such that each of the arches 502, 504, 506, 508 forms an arch peak 514. An x, y. z coordinate system can be defined where the x-axis runs parallel to the front to the back of the collapsible structure 500, the z-axis runs up and down relative to the grounds, and (facing the front of the collapsible shelter) the y-axis runs parallel from the left to the right of the arches 502, 504, 506, 508. The panels 510 form a row 516 of the panels 510 that are to the front of the arch peak 514 while the panels 512 form a row 518 of the panels 512 toward the back of the arch peak 514. Each of the panels 510, 512 have peak edges 520 (not all labeled for the sake of clarity), where the adjacent peak edges of the panels 510, 512 at the positions (position 1, position 2, position 3, position 4, position 5, and position 6) of the arches 502, 504, 506, 508 form the arch peak 514.

The geometric configuration of the arches 502, 504, 506, 508 are such that each of the arches 502, 504, 506, 508 also forms an arch valley 522. At the front end 524 of the collapsible structure 500 (when in the erected state), the arch valley 522 is formed by just valley edges 530 of the panels 510 of the arch 502. At the back end 526 of the collapsible structure 500 (when in the erected state), the arch valley 522 is formed by just valley edges 530 of the panels 512 of the arch 508. The arch valley 522 between the arch 502 and the arch 504 is formed by valley edges 530 of the panels 512 in the arch 502 and the valley edges 530 of the panels 510 in the arch 504. Similarly, the arch valley 522 between the arch 504 and the arch 506 is formed by valley edges 530 of the panels 512 in the arch 504 and the valley edges 530 (not all labeled for the sake of clarity) of the panels 510 in the arch 506. Finally, the arch valley 522 between the arch 506 and the arch 508 is formed by valley edges 530 of the panels 512 in the arch 506 and the valley edges 530 of the panels 510 in the arch 508.

In this embodiment, each of the panels 510, 512 have four sides. As such, each of the panels 510, 512 have connection edges 532 (not all labeled for the sake of clarity) on their left and right side. Except for the left most connection edge 532 of the panels 510, 512 and the right most connection edge 532 of the panels 510 of the arches 502, 504, 506, 508, each of the connection edges 532 of the panels 510 is connected to the connection edge 532 of an adjacent one of the panels 510 in their the respective one of the arches 502, 504, 506, 508. Additionally, except for the left most connection edge 532 of the panels 512 and the right most connection edge 532 of the panels 512 of the arches 502, 504, 506, 508, each of the connection edges 532 of the panels 512 is connected to the connection edge 532 of an adjacent one of the panels 512 in their respective one of the arches 502, 504, 506, 508.

Note that both the arch peak 514 and the arch valley 522 have the same geometric polygonal shape. However, each of the arch peaks 514 is larger than each of the arch valleys 522. More specifically, the peak edges 520 are longer than the valley edges 530. Thus, the panels 510, 512 could not be laid flat while maintaining the panels 510, 512 abutting one another. Instead, this different in length between the arch peaks 514 and arch valleys 522 is made up through height, which thereby creates the peak-valley shapes of the arches 502, 504, 506, 508.

As shown in FIG. 6, collapsible wall 534 may be provided to cover the front opening and the back opening (not explicitly shown) of the collapsible structure 500 when the collapsible structure 500 is in the erected state. As shown in FIG. 6, the collapsible wall 534 may be placed at the front opening created by the arch 502. The collapsible wall 534 may include doors, windows, and/or the like and may be locked into place. The collapsible wall 534 includes wall panels 536 that are swingably connected to one another so that the collapsible wall 534 also collapses into a stack of the panels 536. In this case, the panels 536 of the collapsible wall 534 can be swung so that the collapsible wall 534 can be folded so as to be collapsed into a collapsed state.

Figure 7:
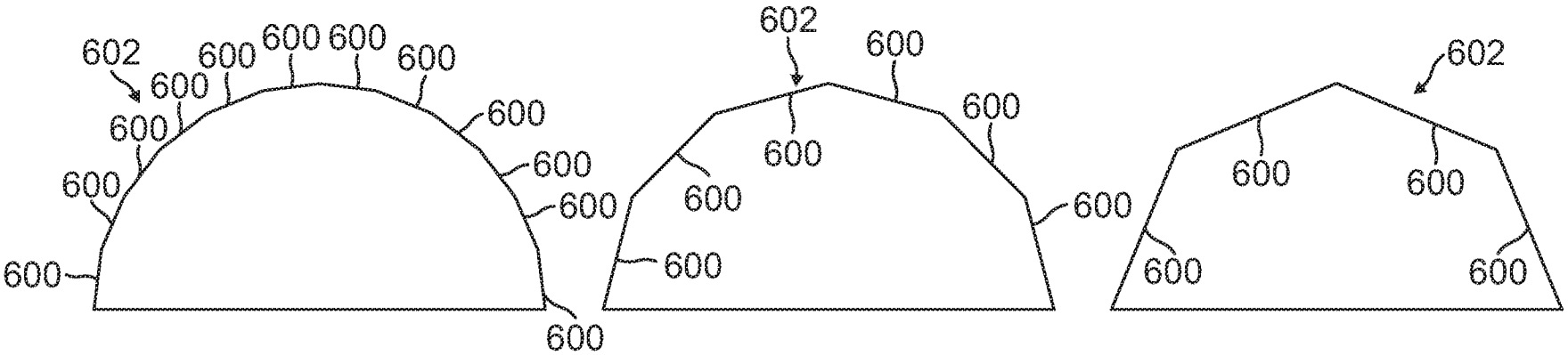
FIG. 7-FIG. 15 illustrate two different design techniques that can be used to design embodiments of the collapsible structure shown in FIG. 6.

FIG. 7 illustrates some procedures that are related to designing a collapsible structure in accordance with this disclosure. FIG. 7 illustrates three different models of the front of the collapsible structure being designed. Edges 600 of what will be the designs for panels are shown. These edges 600 can be thought of as forming the sides of a polygon 602. These edges 600 are combined to form the shape of the arches that will be formed by the panels. To design the collapsible structure, an overall polygon 602 is selected by selecting the number of sides of the polygon 602. This polygon 602 determines the overall polygonal shape of the arches that will become the collapsible structure. For one of the designs discussed below, the four-sided polygon 602 was selected while the six-sided polygon was selected for another design.

Figure 8:
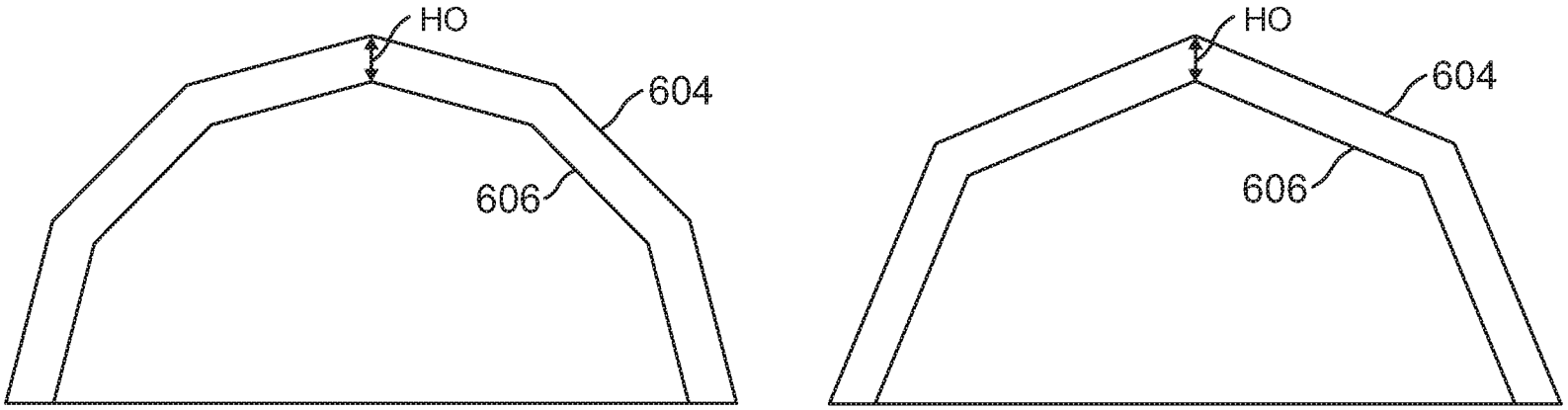

FIG. 8 illustrates the selection in the height offset HO between arch peak 604 and arch valley 606 that are to be formed by the panels in each of the arches. The offset is the height difference due between the arch peak 604 that is formed by the arches and the arch valley 606 that are to be formed by the arches. Both the arch peak 606 and the arch valley 606 are assumed to both be centered with respect to the x-axis.

Figure 9:
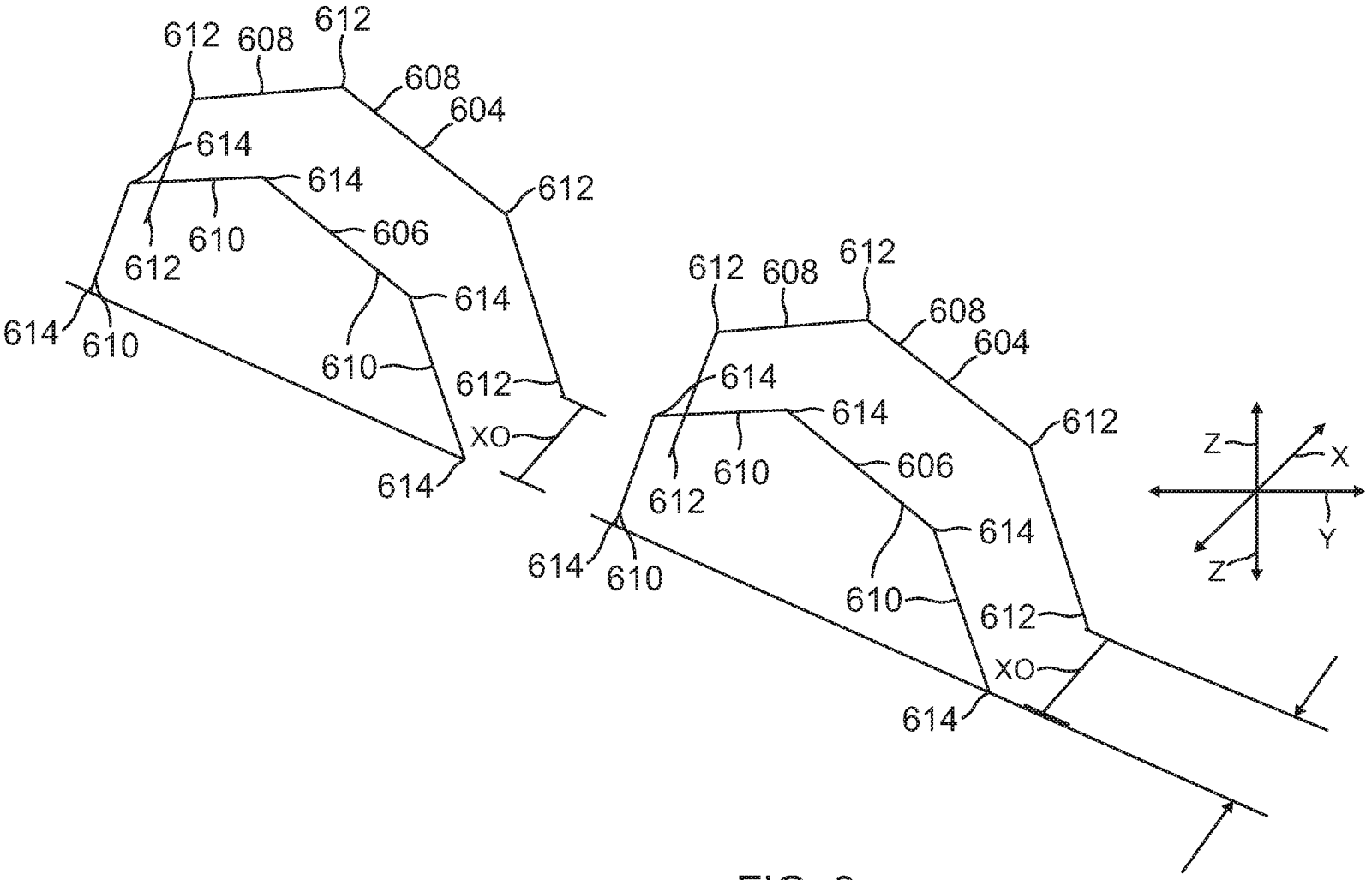

Next, as shown in FIG. 9, a horizontal offset (in this case, relative to the x-axis) XO between the arch peak 604 and the arch valley 606 is selected.

The height offset HO and the horizontal offset XO thus determine a total displacement between peak edges 608 of the panels that are to form the edges of the arch peak 604 and the valley edges 610 of the panels that are to form the edges of the arch valley 606. Note that the peak edges 608 of the arch peak 604 must be longer than the valley edges 610 of the arch valley 606. This is due to the fact that the peak edges 608 that form the arch peak 604 must cover a greater perimeter. At this point, nodes 612 in the arch peak 604 and nodes 614 in the arch valley 606 can be defined. The nodes 612 are formed at the intersection of the peak edges 608 or at the unconnected ends of the peak edges 608. The nodes 614 are formed at the intersection of the valley edges 610 or at the unconnected ends of the valley edges 610. Two different design techniques are used to interconnect the nodes 612 in the arch peak 604 to the nodes 614 in the arch valley 606. These techniques allow for each of the nodes 612 to be connected to one of the nodes 614

Figure 10:
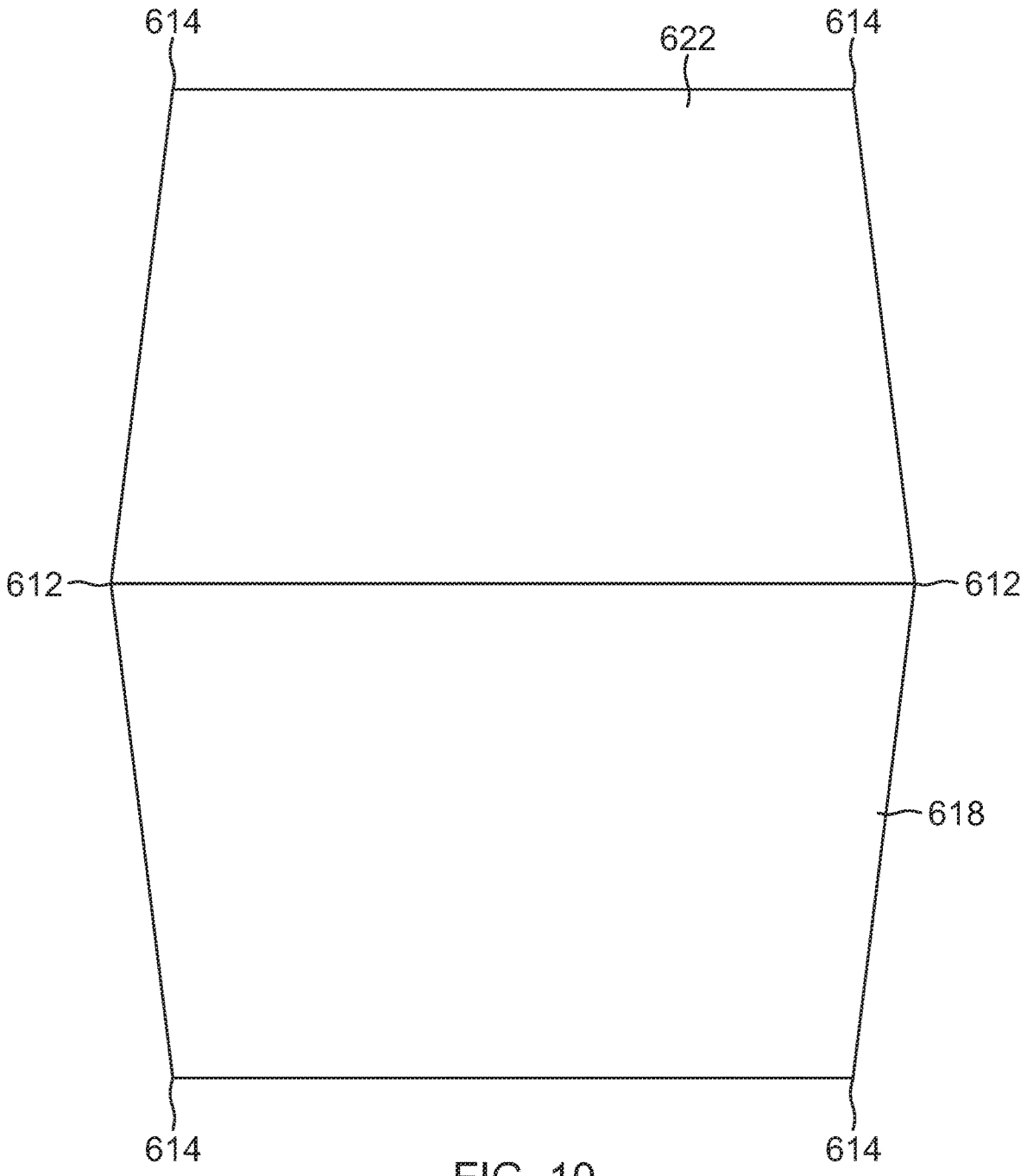
Figure 11:
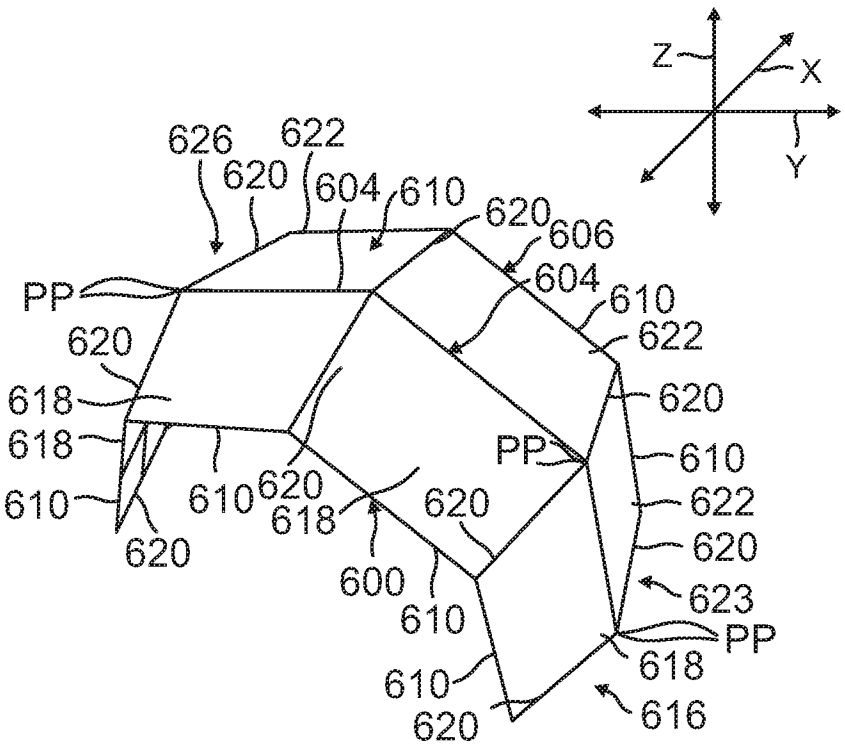

Referring now to FIG. 10 and FIG. 11, FIG. 10 illustrates a design technique for the creation of panels and FIG. 11 illustrates the arch created as a result of the design technique. Initially, the panels 618 in a row 616 (See FIG. 11) are designed by connecting the nodes 612, 614 (See FIG. 9). (For this example, the four-sided polygon has been selected). More specifically, each node 614 is connected to an adjacent node 612. This defines the shape of the row 616 of the panels 618. Note that the model shows that the panels 618 are shaped irregularly. This is because of the difference in size between the arch peak 604 and the arch valley 606. The connecting edges 620 of the panels 618 have to make up the differences in size between the arch peak 604 and arch valley 606. To design the remainder of the arch, the relationship between the row 616 of panels 618 and an adjacent row of panels needs to be defined. The adjacent row of panels will have the same peak to valley relationship as defined through the procedures discussed in FIG. 7-FIG. 9.

In this technique, the panel 618 is mirrored relative to the peak edge 608 to design the adjacent panel 622 in the adjacent and mirrored row 623 (See FIG. 11). FIG. 11 illustrates that this design technique is utilized to design each of the panels 622 in the adjacent row 623 of panels 622. In this manner, an Arch 626 with mirrored rows 616, 623 of panels 618, 624 is designed. As shown in FIG. 10, the peak edges 608 of each of the panels 618, 622 create the arch peak 608 with a projection onto the x-y plane that is straight and does not include bends. Rather, the bends in the arch peak 608 are vertical and along the z-plane. Furthermore, the arch 626 defines two arch valleys 606 one for the panels 618 and another for the panels 622. The valley edges 610 of each of the panels 618 create one of the arch valleys 606, while the valley edges 610 of the panels 622 create another oppositely disposed arch valley 606. The projection onto the x-y plane of the arch valleys 606 is also straight and does not include bends. Rather, the bends in each of the arch valleys 606 are vertical and along the z-plane.

At each of the peak vertices P of the panels 618, 622 formed by the peak edges 608 and the connecting edges 620 of the panels 618, 622 the angles at the peak vertices P are each acute (i.e., less than 90 degrees). At each of the valley vertices V of the panels 618 formed by the valley edges 610 and the connecting edges 620 of the panels 618, 622 the angles at the valley vertices V are each obtuse (i.e., less than 90 degrees). The displacement needed then in order to have the connecting edges 620 of the panels 618 in the row 616 abut one another, to have the connecting edges 620 of the panels 622 in row 623 abut one another, and to have the peak edges 608 of the panels 618, 622 in the adjacent rows 616, 623 abut one another, is provided by the vertical displacement that creates the arch peak 604 and the arch valleys 606.

Figure 12:
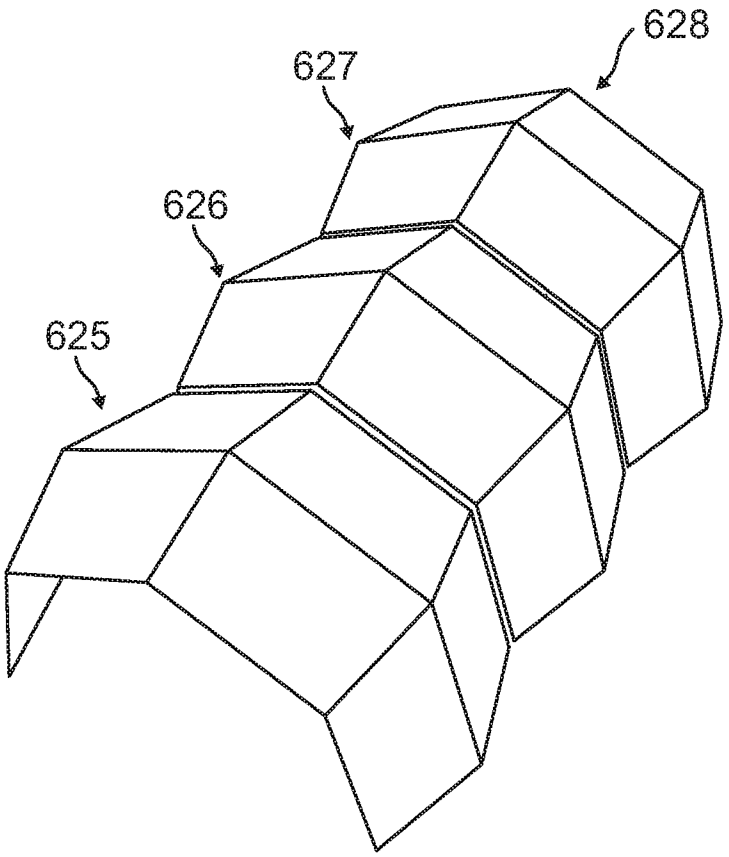
Figure 12A:
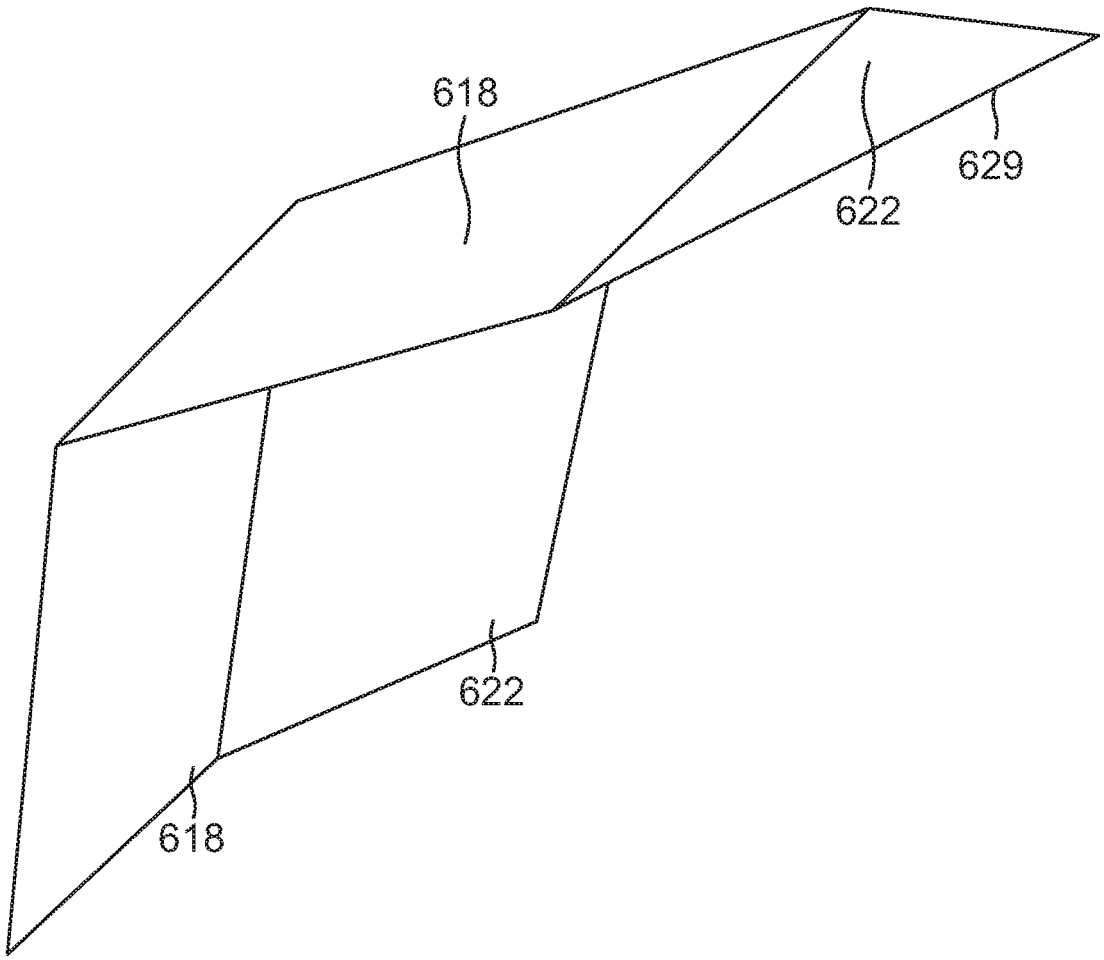

As shown in FIG. 12, this mirroring technique can be repeated to create multiple arches 625, 626, 627 and thereby design the collapsible structure 628. It should be noted that this design technique creates collapsible structures 628 that when erected have a high area moment of inertia. FIG. 12A illustrates that a tension member 629 may be attached between the panels 618, 622 in the rows 616, 623 in order to maintain the structural integrity of the collapsible structure 628 when the collapsible structure 628 is erected.

Figure 13:
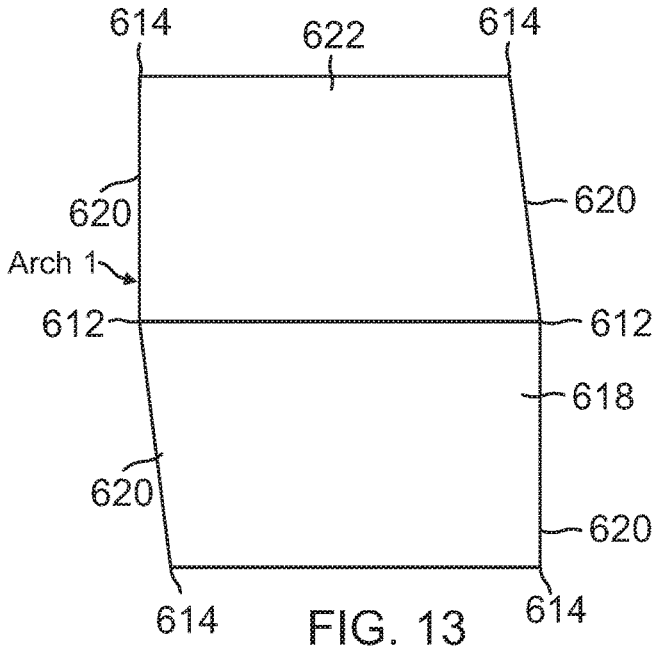

FIG. 13 illustrates another type of design technique that can be used to design the row 616 of panels 618 after the nodes 612, 614 have been defined, as discussed above in FIG. 9. In this technique, one of the panels 618 is connected to provide the peak edge 608, the valley edge 610, and the connection edges of the panel 618. The design of panel 618 in row 616 and the design of the adjacent panel 622 in the row 616. To design the adjacent panel 622, the dimensions of the panel 618 are rotated about the x-axis and then rotated about the peak edge 608 to provide the design of the adjacent panel 622. These panels 618, 622 will be in a first arch (Arch 1).

Figure 14:
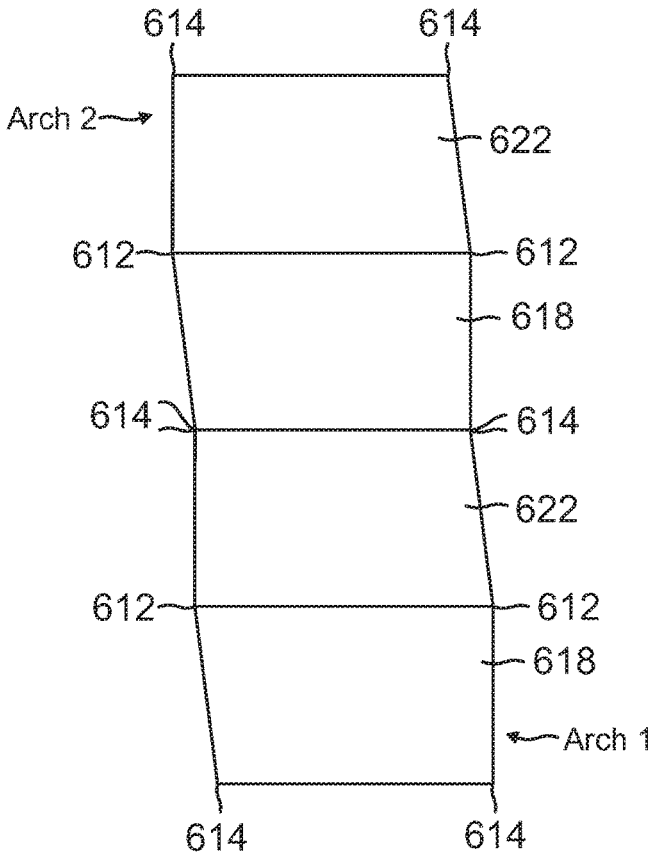
Figure 15:
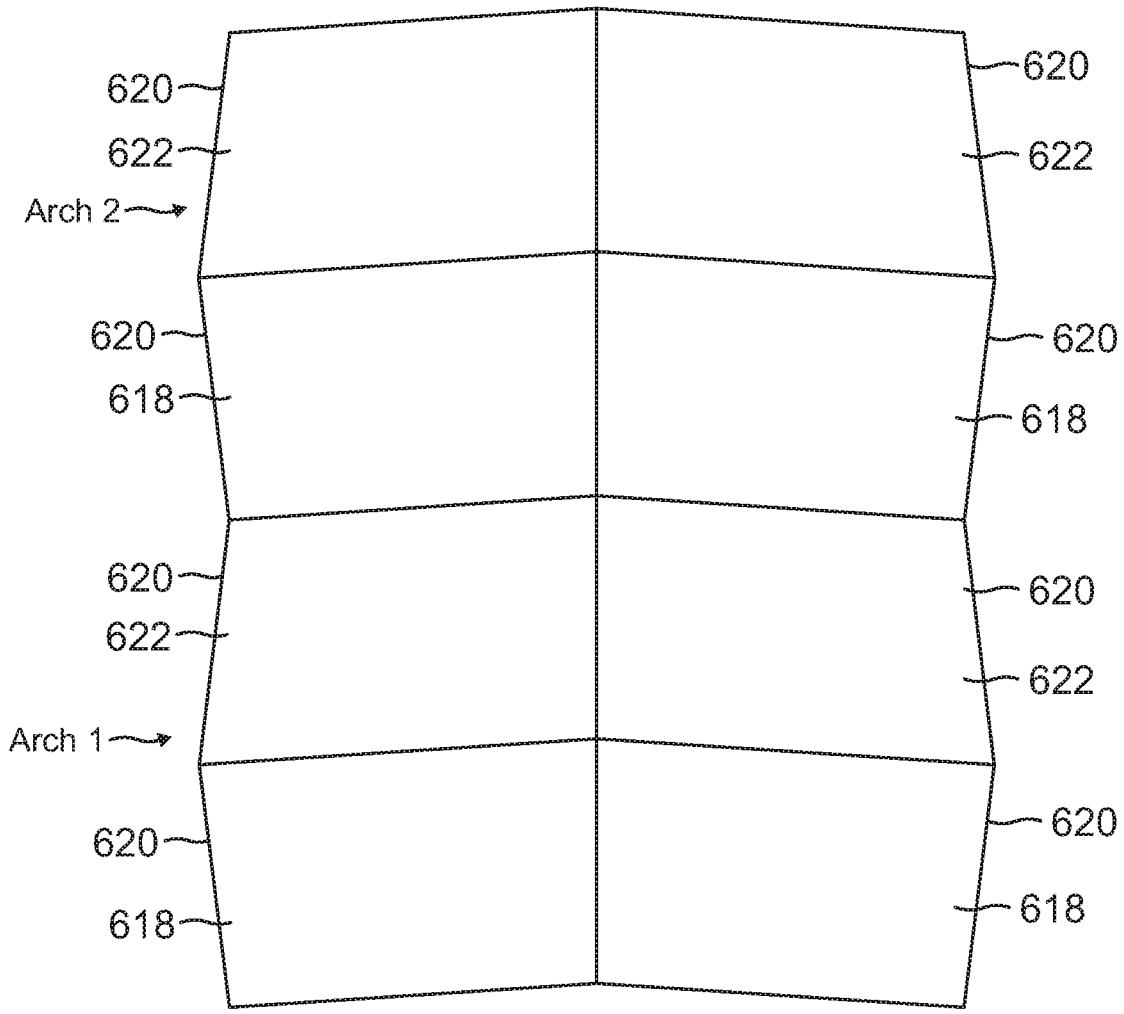

FIG. 14 illustrates the arrangement is then repeated to provide the dimensions of the panels 618, 622 in the same positions of the rows 616, 623 but in a second arch (Arch 2). If there are more arches, the pattern is repeated for the panels 618, 622 in the same positions of rows 616, 623. Next, as shown in FIG. 15, the panels 618, 622 are mirrored by rotating them about the connection edges 620 to create the design of another pair of panels 618, 622 in the rows 616, 623 for each of the arches. This mirroring technique would be repeated along the connection edges 620 in order to design each of the pair of panels 618, 622 in each of the rows 616, 623 in each of the arches.

Figure 16:
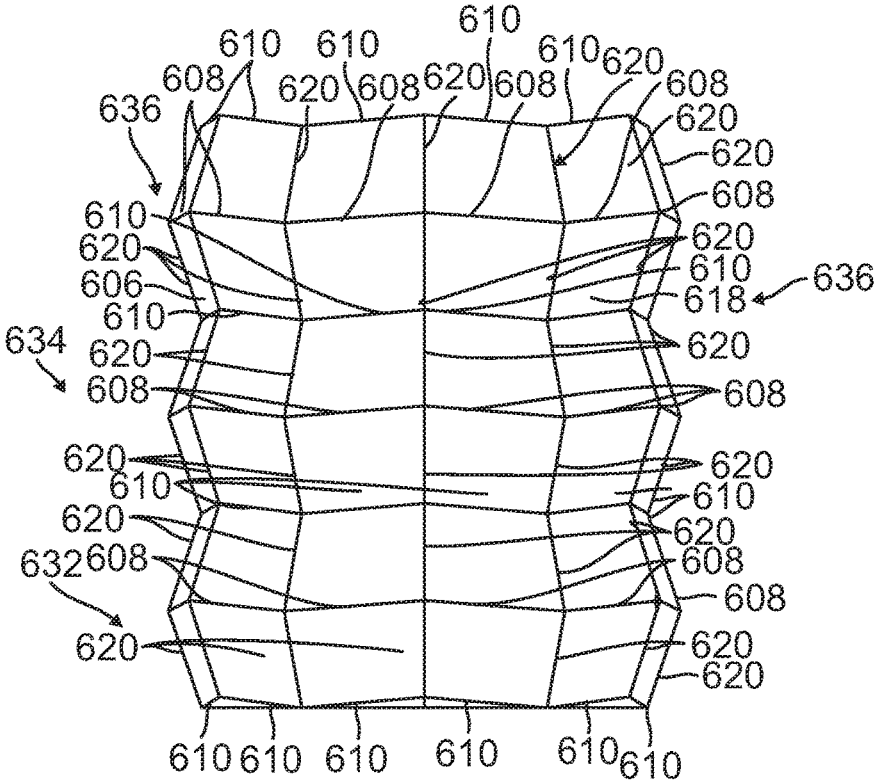
FIG. 16 illustrates a side view of one embodiment of the collapsible structure formed through the design techniques described in FIG. 13-FIG. 15.
Figure 17:
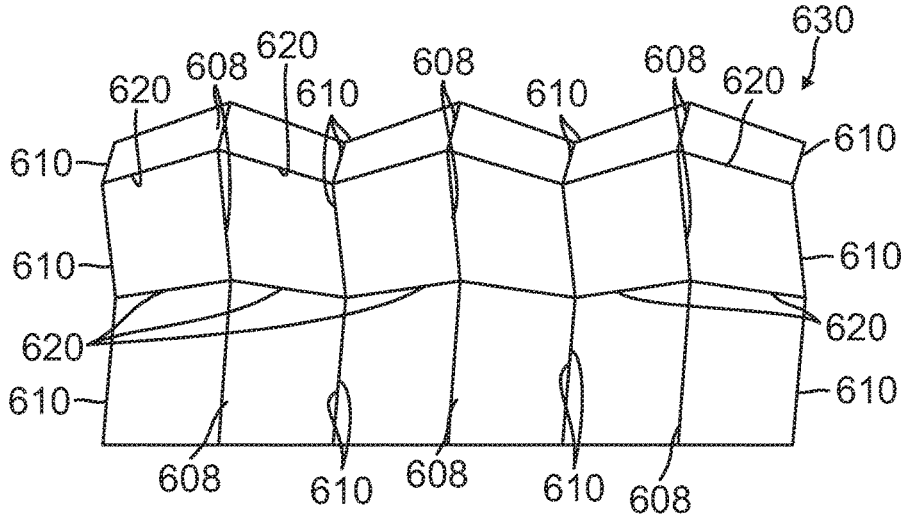
FIG. 17 illustrates a top view of a collapsible structure designed using the design techniques described above in FIG. 13-FIG. 15.

Referring now to FIG. 16 and FIG. 17, FIG. 16 illustrates a side view of a collapsible structure 630 and FIG. 17 illustrate a top view of a collapsible structure 630 created using the technique described above with respect to FIG. 13-FIG. 15. In this example, the collapsible structure 630 has three arches 632, 634, 636. Furthermore, a six-sided polygon was selected for the design. As shown in FIG. 16 and FIG. 17, the peak edges 608 of the panels 618, 622 the arch peaks 604 such that each of the arch peaks 604 has a zig-zag pattern that bends along the x and z axis. Furthermore, the valley edges 610 of the panels 618, 622 form the arch valleys 606 such that each of the arch valleys 606 has a zigzag pattern that bends along the x and z-axis. The zigzag pattern of the arch valleys 606 has the same angular relationship as the zigzag pattern of the arch peaks 604. Finally, note that the connection edges 620 along each of the arches 632, 634, 636 also for a zigzag pattern.

At each of the peak vertices P of the panels 618, 622 formed by the peak edges 608 and the connecting edges 620 of the panels 618, 622, the angles at the peak vertices P alternate between being acute (i.e., less than 90 degrees) and being obtuse (i.e., greater than 90 degrees). At each of the valley vertices V of the panels 618 formed by the valley edges 610 and the connecting edges 620 of the panels 618, 622, the angles at the valley vertices V also alternate between being acute (i.e., less than 90 degrees) and being obtuse (i.e., greater than 90 degrees). Finally, the connection vertices C formed by the connection edges C and the peak edges 608/valley edges 610 also alternate between being acute (i.e., less than 90 degrees) and being obtuse (i.e., greater than 90 degrees). The displacement needed then in order to have the connecting edges 620 of the panels 618 in the row 616 abut one another, to have the connecting edges 620 of the panels 622 in row 623 abut one another, and to have the peak edges 608 of the panels 618, 622 in the adjacent rows 616, 623 abut one another, is provided by the vertical displacement that creates the arch peak 604 and the arch valleys 606.

Referring now to FIG. 18-FIG. 22, FIG. 18-FIG. 22 demonstrate how the collapsible structures 628, 630 can be erected into the erected state and collapsed into the collapsed state. The particular structure shown in FIG. 18-FIG. 22 is the collapsible structure 630. However, the procedures described herein FIG. 18-FIG. 22 are also applicable for the collapsible structure 628. Furthermore, the particular order of FIG. 18-FIG. 22 illustrates the collapsible structure 630 going from the collapsed state to the erected state. However, FIG. 18-FIG. 22 also demonstrate how the collapsible structure 630 goes from the erected state to the collapsed state, as explained in further detail below.

Figure 18:
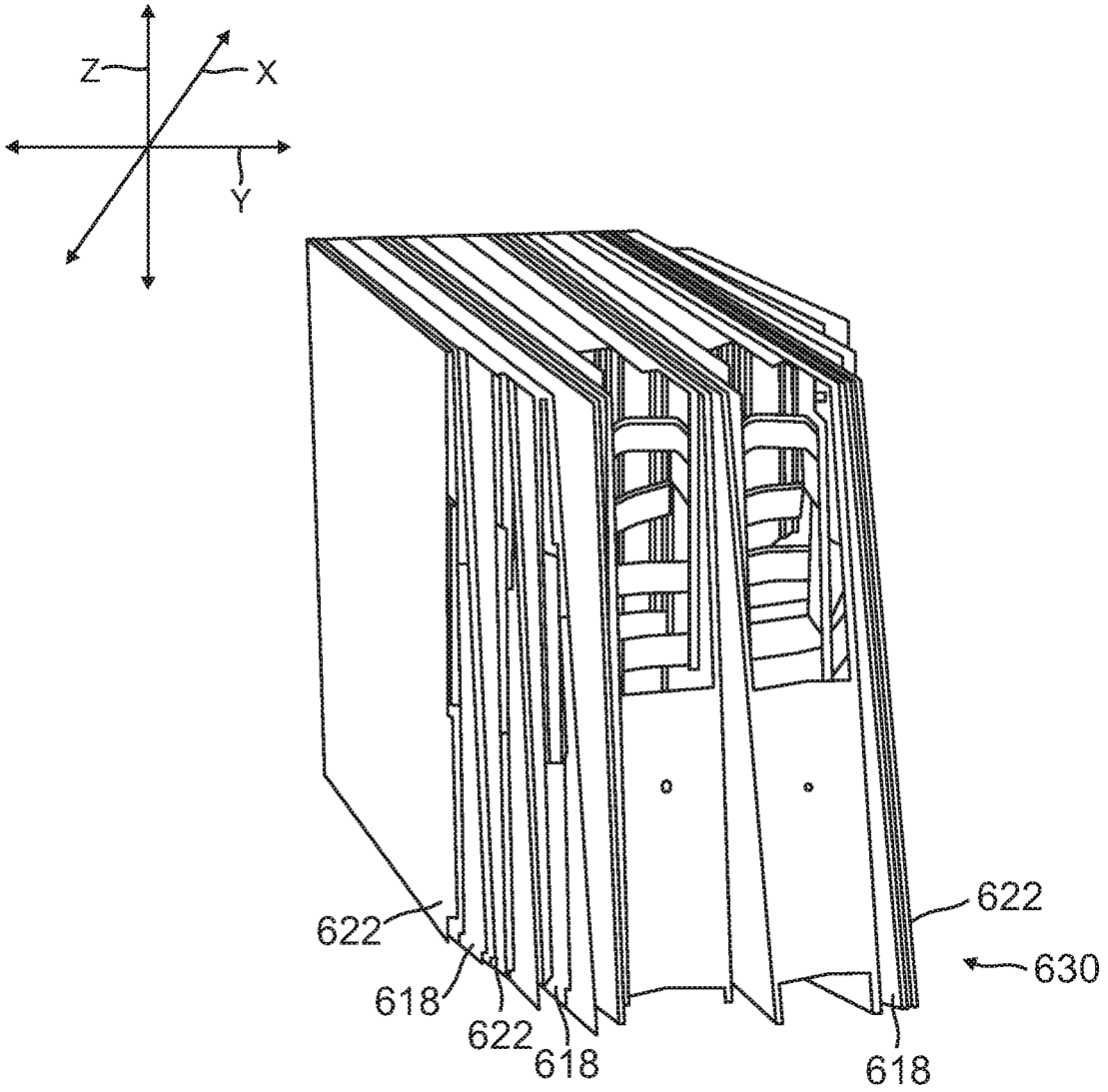
FIG. 18-FIG. 22 illustrates procedures utilized to provide the collapsible structures (designed using the design techniques in FIG. 7-FIG. 15) in the erected state and the collapsed state.

FIG. 18 illustrates the collapsible structure 630 in the collapsed state. As shown in FIG. 18, the collapsible structure 630 is configured as a stack of the panels 618, 622 (not all labeled for the sake of clarity) so that the panels 618, 622 stack directly over each other. In this embodiment, the stack of the panels 618, 622 is tied together by a strap 638, which reinforces the panels 618, 622 so they are maintained in the collapsed state. To begin erecting the collapsible structure 630, the stack of the panels 618, 622 is expanded relative to the y-axis. It should be noted that solid arrows refer to directional motions involved in transitioning from the collapsed state to the erected state while dotted arrows refer to directional motion involved in transitioning from the erected state to the collapsed state.

Figure 19:
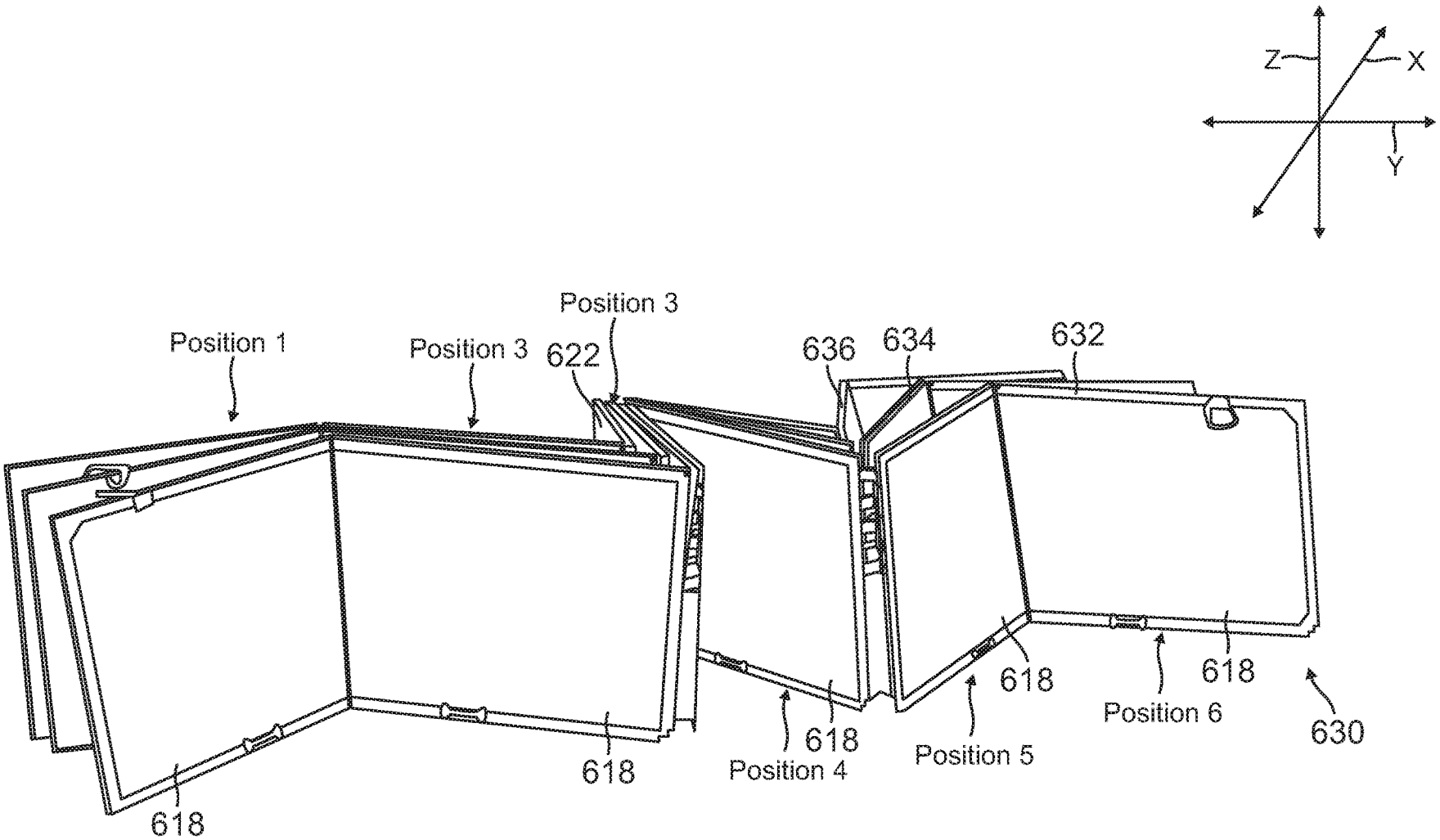

After the stack of the panels 618, 622 is pulled apart in opposite directions parallel to the y-axis, the collapsible structure 630 is provided as shown in FIG. 19. Note that from FIG. 19, the number of arches 632, 634, 636 is apparent. In this case, there are three arches 632, 634, 636 but alternative embodiments of the collapsible structures 628, 630 may have any number of arches. In this case, the arch 634 is the intermediary arch between the arches 632, 636. Each arch includes a row 616 of panels 618 and an adjacent row 623 of panels 622. Note furthermore that the panels 618, 622 at the same position (position 1, position 2, position 3, position 4, position 5, position 6) of the arches 632, 634, 636 were stacked together when stacked in FIG. 18 and now swing apart relative their connection edges 620 in the same manner. More specifically, the panels 618, 622 in each of the arches 632, 634, 636 at position 1 are swingably connected by hinges (not shown explicitly in FIG. 18-FIG. 22) to the adjacent panels 618, 622 at position 2 in their respective row 616, 623 of their respective Arch 632, 634, 636. The panels 618, 622 at position 1 are swingably connected to the adjacent panels 618, 622 at position 2 at the connection edges 620 at the intersection of position 1 and position 2. In this case, the panels 618, 622 in each of the arches 632, 634, 636 at position 1 are swung in the clockwise direction while the panels 618, 622 at position 2 are swung in the opposite counterclockwise direction.

Additionally, the panels 618, 622 in each of the arches 632, 634, 636 at position 2 are swingably connected by hinges (not shown explicitly in FIG. 18-FIG. 22) to the adjacent panels 618, 622 at position 3 in their respective row 616, 623 of their respective Arch 632, 634, 636. The panels 618, 622 at position 2 are swingably connected to the adjacent panels 618, 622 at position 3 at the connection edges 620 at the intersection of position 2 and position 3. In this case, the panels 618, 622 in each of the arches 632, 634, 636 are swung in the counterclockwise direction while the panels 618, 622 at position 3 are swung in the opposite clockwise direction.

Furthermore, the panels 618, 622 in each of the arches 632, 634, 636 at position 3 are swingably connected by hinges (not shown explicitly in FIG. 18-FIG. 22) to the adjacent panels 618, 622 at position 4 in their respective row 616, 623 of their respective Arch 632, 634, 636. The panels 618, 622 at position 3 are swingably connected to the adjacent panels 618, 622 at position 4 at the connection edges 620 at the intersection of position 3 and position 4. In this case, the panels 618, 622 in each of the arches 632, 634, 636 are swung in the clockwise direction while the panels 618, 622 at position 4 are swung in the opposite counterclockwise direction.

In addition, the panels 618, 622 in each of the arches 632, 634, 636 at position 4 are swingably connected by hinges (not shown explicitly in FIG. 18-FIG. 22) to the adjacent panels 618, 622 at position 5 in their respective row 616, 623 of their respective Arch 632, 634, 636. The panels 618, 622 at position 4 are swingably connected to the adjacent panels 618, 622 at position 5 at the connection edges 620 at the intersection of position 4 and position 5. In this case, the panels 618, 622 in each of the arches 632, 634, 636 are swung in the counterclockwise direction while the panels 618, 622 at position 5 are swung in the opposite clockwise direction.

Finally, the panels 618, 622 in each of the arches 632, 634, 636 at position 5 are swingably connected by hinges (not shown explicitly in FIG. 18-FIG. 22) to the adjacent panels 618, 622 at position 6 in their respective row 616, 623 of their respective Arch 632, 634, 636. The panels 618, 622 at position 5 are swingably connected to the adjacent panels 618, 622 at position 6 at the connection edges 620 at the intersection of position 5 and position 6. In this case, the panels 618, 622 in each of the arches 632, 634, 636 are swung in the clockwise direction while the panels 618, 622 at position 6 are swung in the opposite counterclockwise direction.

Figure 20:
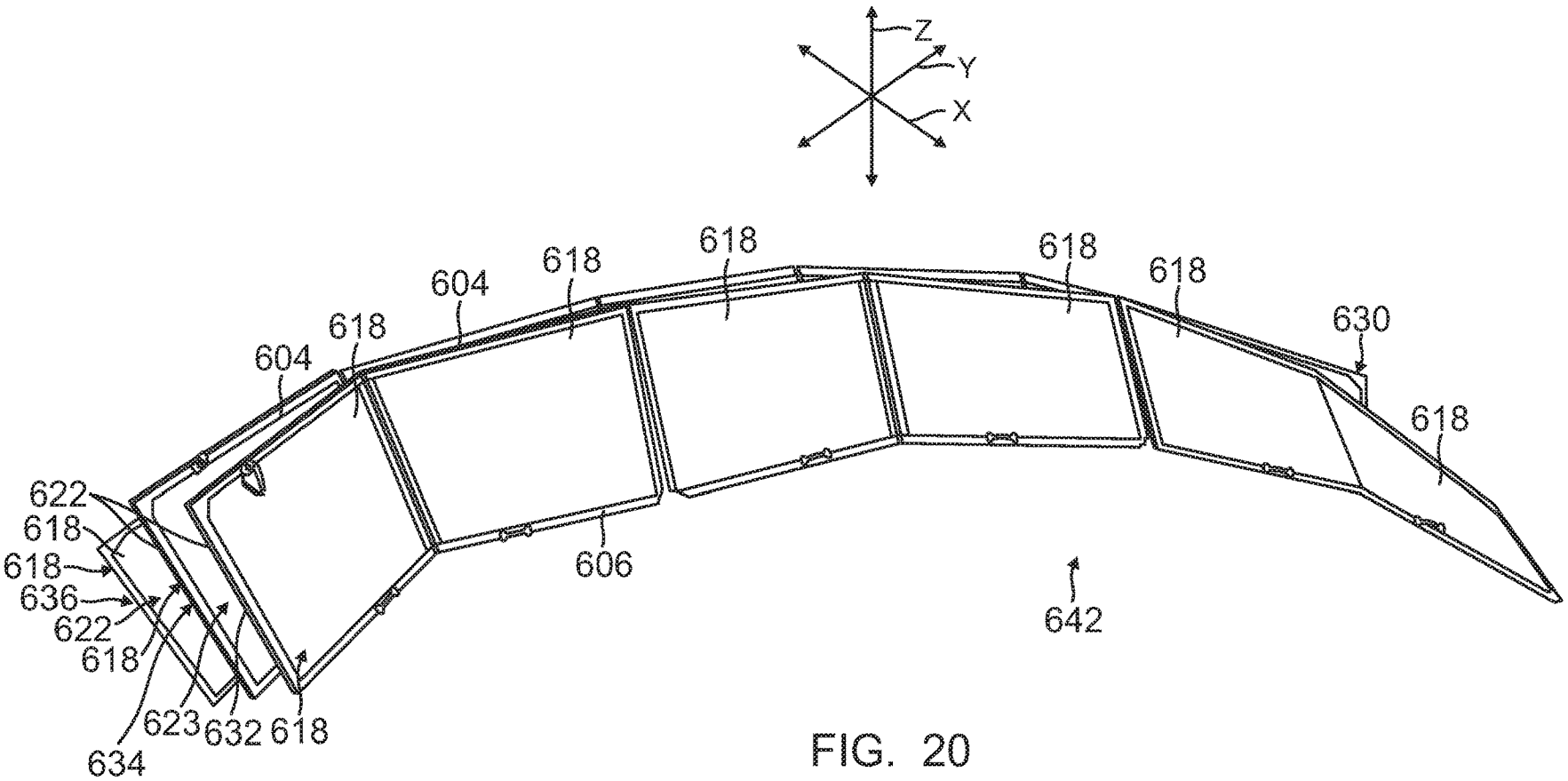
Figure 21:
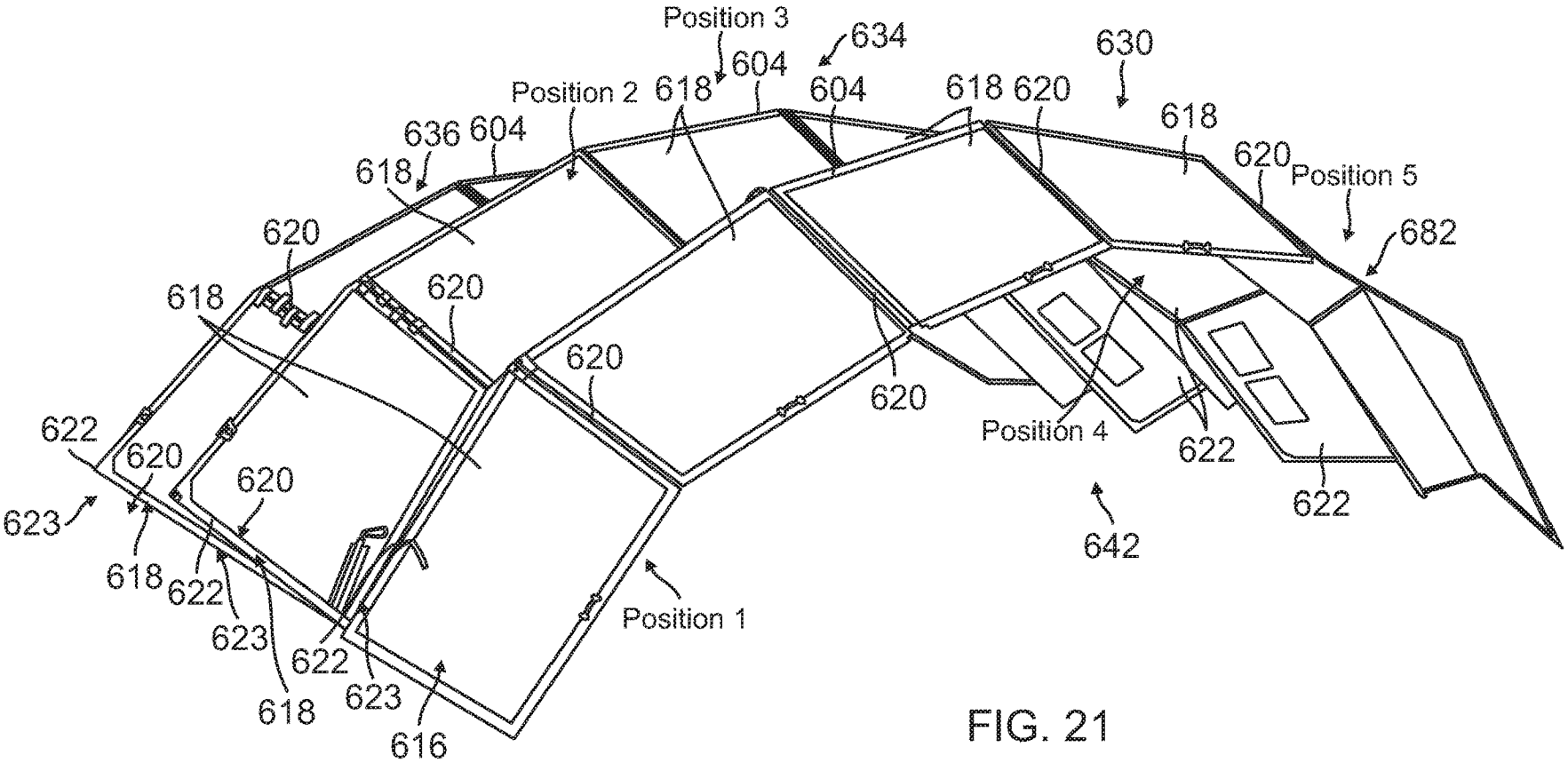
Figure 22:
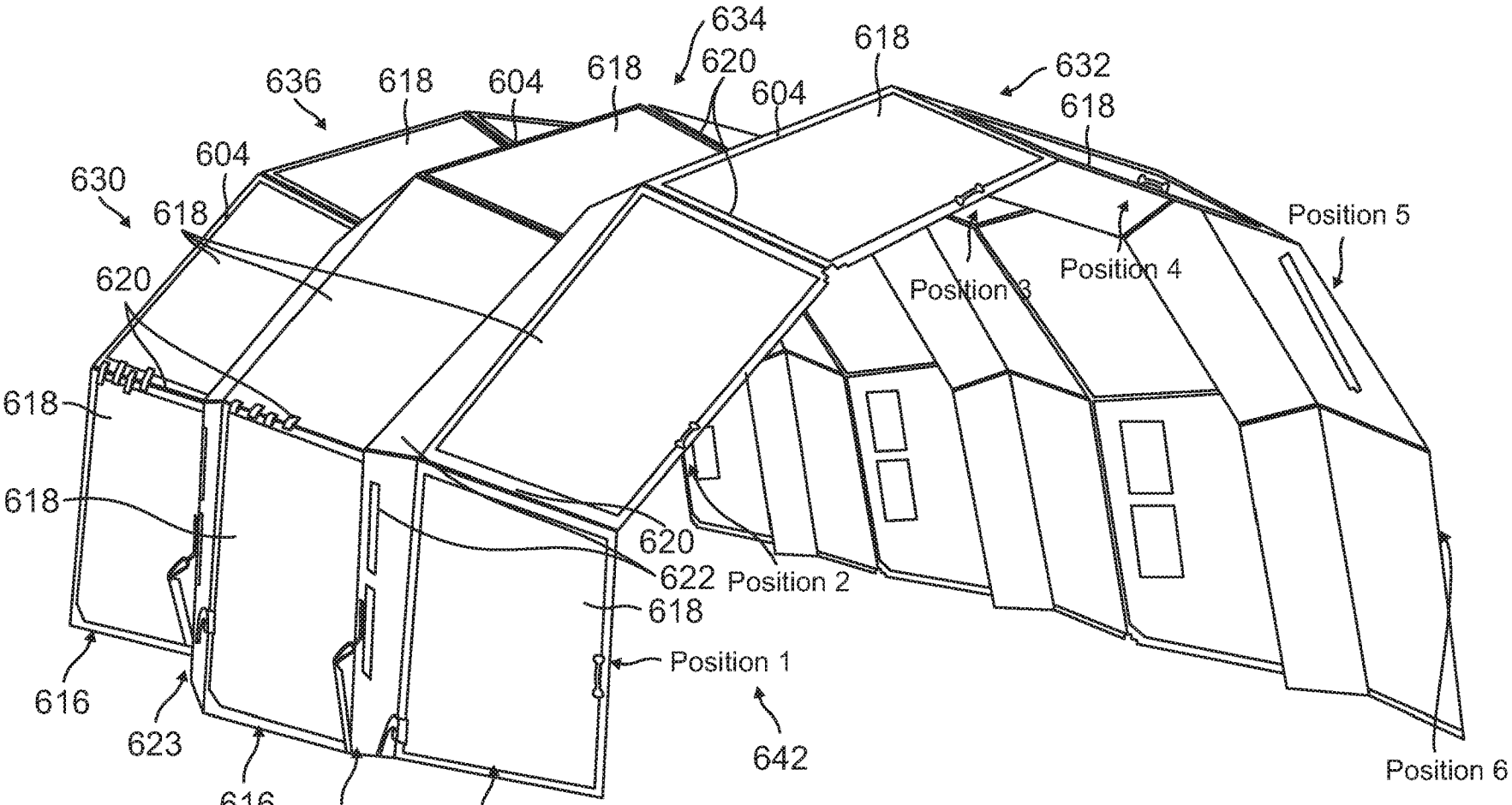

Once the collapsible structure 630 has been pulled in opposite directions parallel to the y-axis, the collapsible structure 630 is pulled apart in opposite directions parallel to the x-axis as shown in FIG. 20 to FIG. 21. Hinges (not shown in FIG. 18-FIG. 22 but explained later) are connected so that the peak edges 608 of adjacent panels 618, 622 (not all labeled for the sake of clarity) that form the arch peak 604 (not all labeled for the sake of clarity) are swingably connected to one another. As the collapsible structure 630 is expanded relative to the x-axis, each row 616 of the panels 618 of each of the arches 632, 634, 636 is turned in the clockwise direction relative the peak edges 608 while each row 623 (not all labeled for the sake of clarity) of the panels 622 of each of the arches 632, 634, 636 is turned in the counterclockwise direction relative the peak edges 608 as the arches 632, 634, 636 are expanded. Due to the geometric configuration of the panels 618, 620 and due to the hinges (not explicitly shown in FIG. 18-FIG. 22) that prevent the edges 608, 610, 620 (not all labeled for the sake of clarity) from separating, the panels 618, 622 will reach a natural maximum rotation angle and form the arch peaks 604 of each of the arches 632, 634, 636.

Furthermore, as the collapsible structure 630 is expanded relative to the x-axis, each row 616 of the panels 618 of each of the arches 632, 634, 636 is turned in the counterclockwise direction relative the valley edges 610 while each row 623 of the panels 622 of each of the arches 632, 634, 636 is turned in the clockwise direction relative the valley edges 610 as the arches 632, 634, 636 are expanded relative to the x-axis. Due to the geometric configuration of the panels 618, 620 and due to the hinges (not explicitly shown in FIG. 18-FIG. 22) that prevent the edges 608, 610, 620 from separating, the panels 618, 620 will reach a natural maximum rotation angle and form the arch valleys 606 between each of the arches 632, 634 and between the arches 634, 636.

Once the arch peaks 604 and the arch valleys 606 have been fully expanded, the collapsible structure 630 is expanded in the z-direction. In this embodiment, there are also hinges (not explicitly shown in FIG. 18-FIG. 22 but discussed later) that are connected so that connection edges 620 are swingably connected to one another. As the collapsible structure 630 is expanded in the z-direction, the panels 618, 622 will move inward with respect to the y-axis so that the collapsible structure 630 is provided in the erected state. As such, each of the panels 618, 622 in position 1, position 2, and position 3 move in the counterclockwise direction with respect to the connection edges 620 while each of the panels 618, 622 in position 4, position 5, and position 6 move in the clockwise direction with respect to the connection edges 620. Due to the geometric configuration of the panels 618, 620 and due to the hinges (not explicitly shown in FIG. 18-FIG. 22) the panels 618, 620 will reach a natural maximum rotation angle so that the collapsible structure 630 is provided in the erected state.

The collapsible structure 630 can also go from the erected state (shown in FIG. 22) to the collapsed state (shown in FIG. 18). To do this, the actions described above with respect to FIG. 18 to FIG. 22 would be reversed (the reversed actions are indicated with dotted arrows in the FIG. 18-FIG. 22). In this manner, the collapsible structure 630 would start in the erected state and then collapse into the collapsed state.

Note that in this embodiment, the collapsible structure 630 may include a chord pulley system 640 that is attached to the panels 618, 622 at the bottom of the arches 632, 634, 636. In this example, chords 642 are attached to the panels 618, 622 at position 1 and at position 6. The chords 642 allows a person to use the chords 642 to create a tension relative to the y-axis. By pulling the chords 642 towards the center of the arches 632, 634, 636, the arches 632, 634, 636 can be raised when the collapsible structure 630 is being set up in the erected state. The chords 642 can also be used to control the collapse of the arches 632, 634, 636, when the collapsible structure 630 is being set up in the collapsed state.

Figure 23:
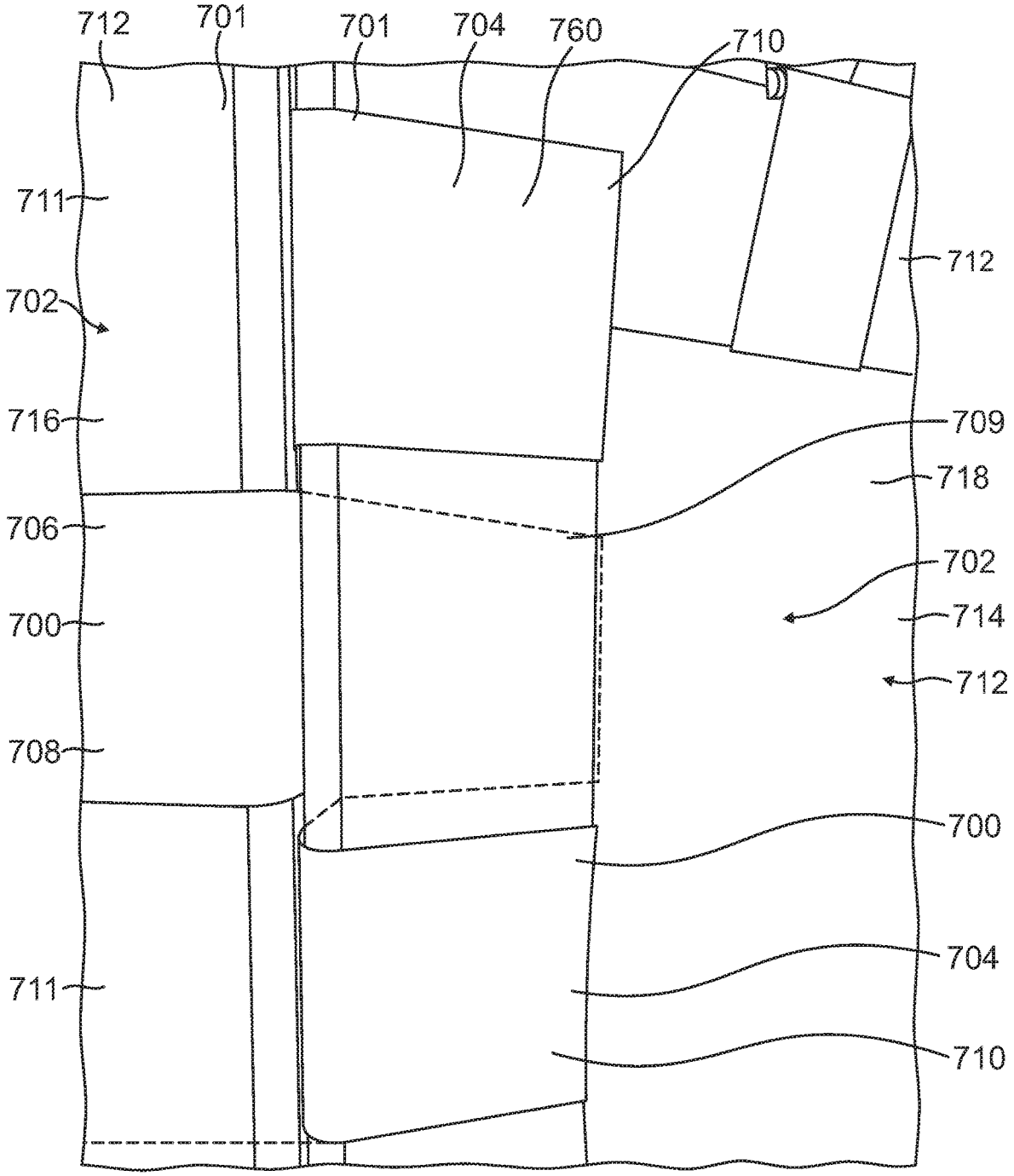
FIG. 23 illustrates one embodiment of an uncammed infinity hinge utilized to swingably connect a pair of adjacent panels.

FIG. 23 illustrates an example of an uncammed infinity hinge 700 that are used to connect a pair of joined edges 701 of a pair of panels 702. The infinity hinges 700 may be used to swingably connect the panels 702 so that a collapsible structure, such as the collapsible structures 628, 630 described above can be provided in the collapsed state and in the erected state. Each of the infinity hinges 700 includes has two or more strips 704, 706 of a flexible material. Each strip 704, 706 of the flexible material has one section 708, 710 that connects to one side 712 of one of the panels 702 while another section 709, 711 of the strips 704, 706 connects to an oppositely disposed side (not shown explicitly) of the other panel 702. Thus, each strip 704, 706 forms an S-shape.

In this embodiment, each of the panels 702 has a rigid frame 712 along the edges 701 of the panel. The rigid frame 712 is configured to securely hold a panel body 714 that fills the frame 712. In this embodiment, one of the strips 706 has a section 708 connected to the side 712 (for example the bottom of the rigid frame 712) of a first panel 716 and a section 709 connected to the other side (not explicitly shown) of the second panel 718. As shown in FIG. 23, the other strips 704 each have a section 710 connected to the side 712 of the second panel 718 and a section 711 connected to the other side (not explicitly shown) of the first panel 716. Thus, the S-shaped strip 706 is oppositely disposed to S-shaped strips 704 in the infinity hinge 700 thereby giving the "infinity" hinges their name, as they resemble the symbol for infinity. Note that any number of infinity hinges 700 may be distributed along the joined edges 701 of adjacent panels 702 so that the adjacent panels 702 are swingably connected to one another.

Figure 24:
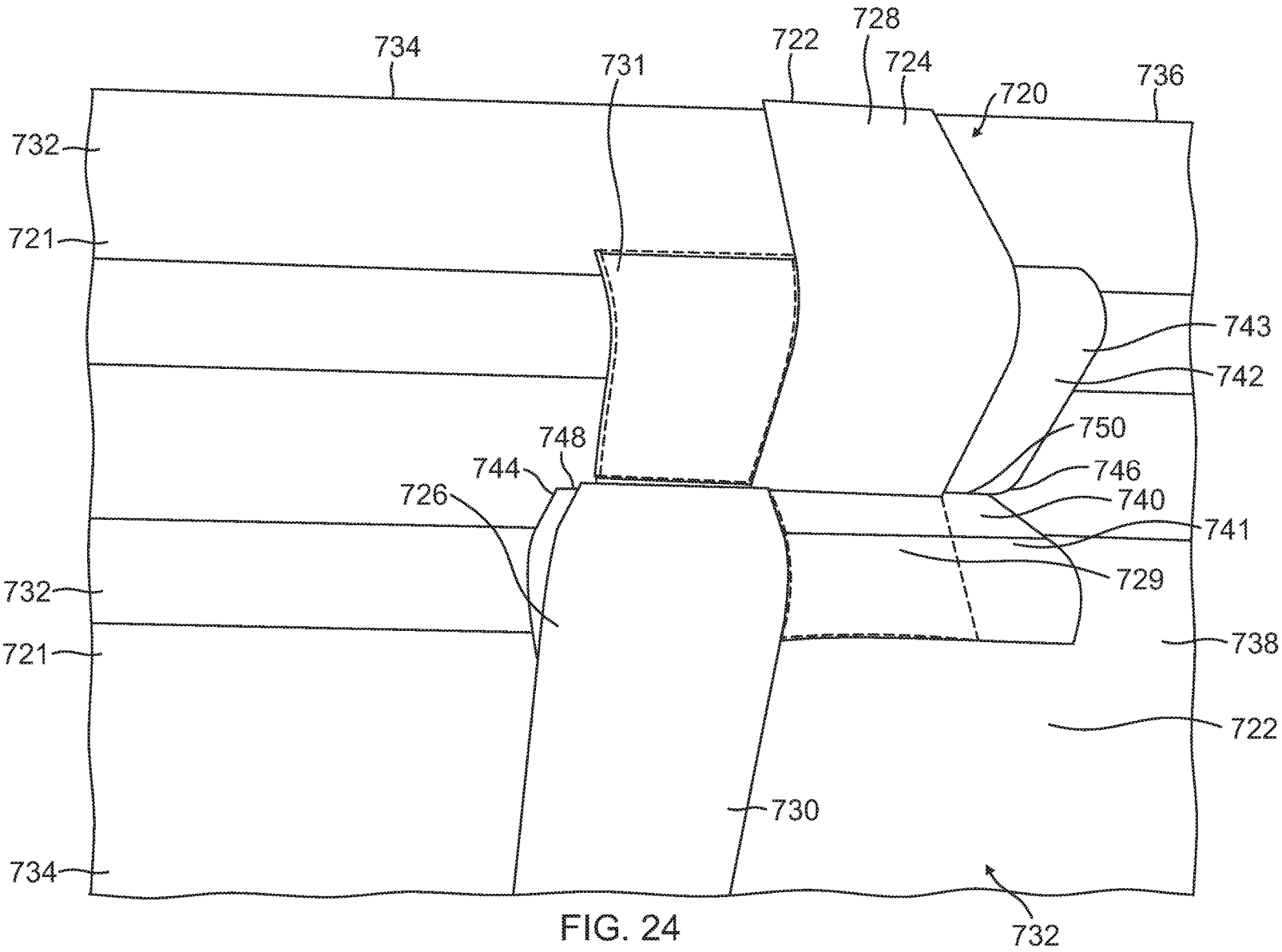
FIG. 24 illustrates one embodiment of a cammed infinity hinge utilized to swingably connect a pair of adjacent panels.

FIG. 24 illustrates an example of a cammed infinity hinge 720 that are used to connect a pair of joined edges 721 of a pair of panels 722. The infinity hinges 720 may be used to swingably connect the panels 722 so that a collapsible structure, such as the collapsible structures 628, 630 described above, can be provided in the collapsed state and in the erected state. Each of the infinity hinges 720 includes has at least two strips 724, 726 of a flexible material. Each strip 724, 726 of the flexible material has one section 728, 730 that connects to one side 732 of one of the panels 722 while another section 729, 731 of the strip 724, 726 connects to an oppositely disposed side (not shown explicitly) of the other panel 722. Thus, each strip 724, 726 forms an S-shape.

In this embodiment, each of the panels 722 has a rigid frame 732 along the edges 721 of the panel. The rigid frame 732 is configured to securely hold a panel body 734 that fills the frame 732. In this embodiment, the strip 724 has a section 728 connected to the side 732 of a first panel 736 and a section 729 connected to the other side (not explicitly shown) of the second panel 738. As shown in FIG. 23, the other strip 726 has a section 730 connected to the side 732 of the second panel 738 and a section 731 connected to the other side (not explicitly shown) of the first panel 736. The two oppositely disposed S-shaped strips 726, 728 are mirrored and swingably connected the adjacent panels 722.

In this embodiment, however, the cammed infinity hinges 720 further include cams 740, 742. The cams 740, 742 extend outwardly from the frame 742 of its respective panel 722. In this example, the cams 740, 742 engage one another and have a width that is greater than their lengths. As each of the strips 724, 726 transitions from one of the panels 722 to the other panel 722, each of the strips 724, 726 go around the cams 740, 742. When the panels 722 are in the unfolded state, opposing faces 741, 743 of the cams 740, 742 abut each other and there is a minimal amount of spacing between the edges 721 of the panels 722. However, as the panels 722 are swung into the folded state, the edges 744, 746 at the ends 748, 750 of the cams 740, 742 abut one another and the edges 721 of the panels 722 have a maximum distance. The cammed infinity hinge 720 thus give the separation that may be needed in order to fold nested rows of panels (See FIG. 15 and FIG. 19 for an example of nested rows of panels). The angular relationship between these cams 740, 742 also helps determine the configuration of the arches when the panels 722 are unfolded.

Figure 25:
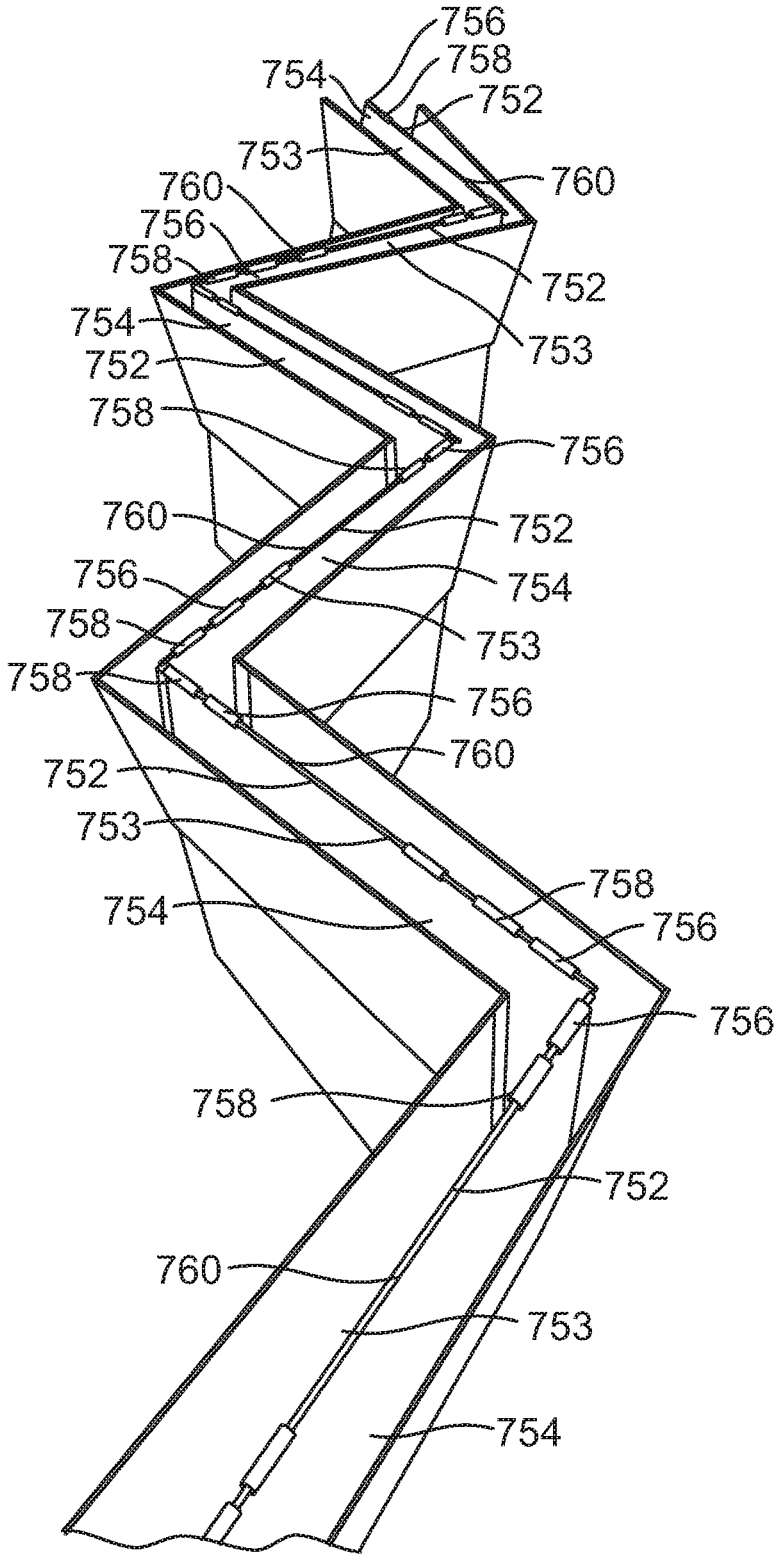
FIG. 25 illustrates one embodiment of poled hinges utilized to swingably connect pairs of adjacent panels.

FIG. 25 illustrates an example of pinned hinges 752 that are used to connect a pair of joined edges 753 of a pair of panels 754. The poled hinges 752 may be used to swingably connect the panels 754 (not all labeled for the sake of clarity) so that a collapsible structure, such as the collapsible structures 628, 630 described above, can be provided in the collapsed state and in the erected state. Each of the poled hinges 752 includes 752 has least two strips 756 (not all labeled for the sake of clarity), 758 (not all labeled for the sake of clarity) of a flexible material. Furthermore, poles 760 are provided between the edges 753 so that a length of the poles 760 is parallel to the pair of joined edges 753. Strips 756 are attached to their respective pin 760 and then to one of the panels 754 while the strips are attached to their respective pin 760 and the oppositely disposed panel 754. Unlike the previous embodiments, the panels 754 in this embodiment do not include frame but rather just panel bodies. In some configurations, a cord 756 is provided through the edges 753 of the panels 754, which can be pulled to hold connected edges 753 in a particular configuration or to provide tension when the panels 754 are in the unfolded state.

Figure 26:
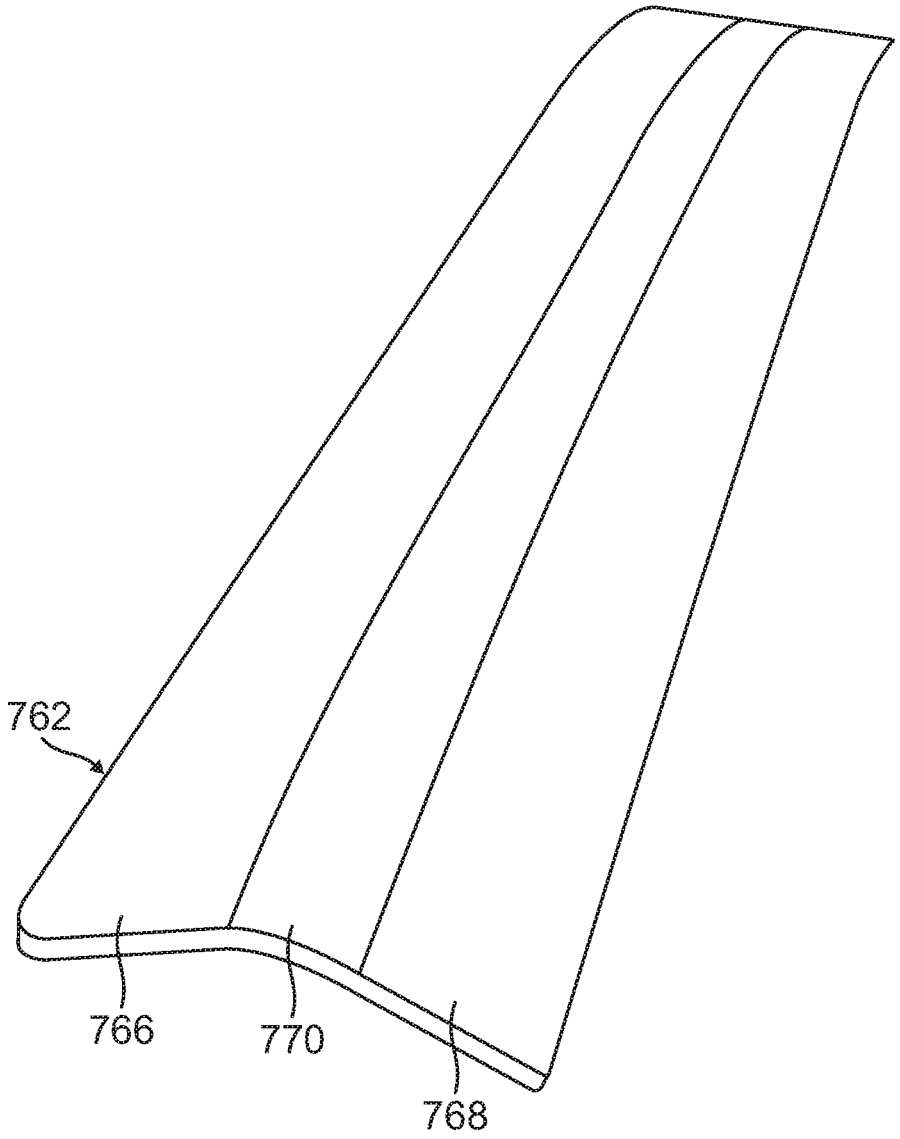
FIG. 26 illustrates an embodiment of another hinge utilized to swingably connect a pair of adjacent panels.

FIG. 26 illustrates an example of another hinges 762 that are used to connect a pair of joined edges (not explicitly shown in FIG. 26) of a pair of panels (not explicitly shown in FIG. 26). In this embodiment, the hinge 762 is formed as a pair of oppositely disposed flexible plastic walls 766, 768. The flexible plastic walls 766, 768 are each connected to an elongated member 770. Each of the flexible plastic walls 766, 768 pivot about the elongated member 770. Each of the flexible plastic walls 766, 768 may be connected to the edges (not explicitly shown) of adjacent panels (not explicitly shown). In this manner, the panels may be provided in the folded state and in the unfolded state.

Figure 27:
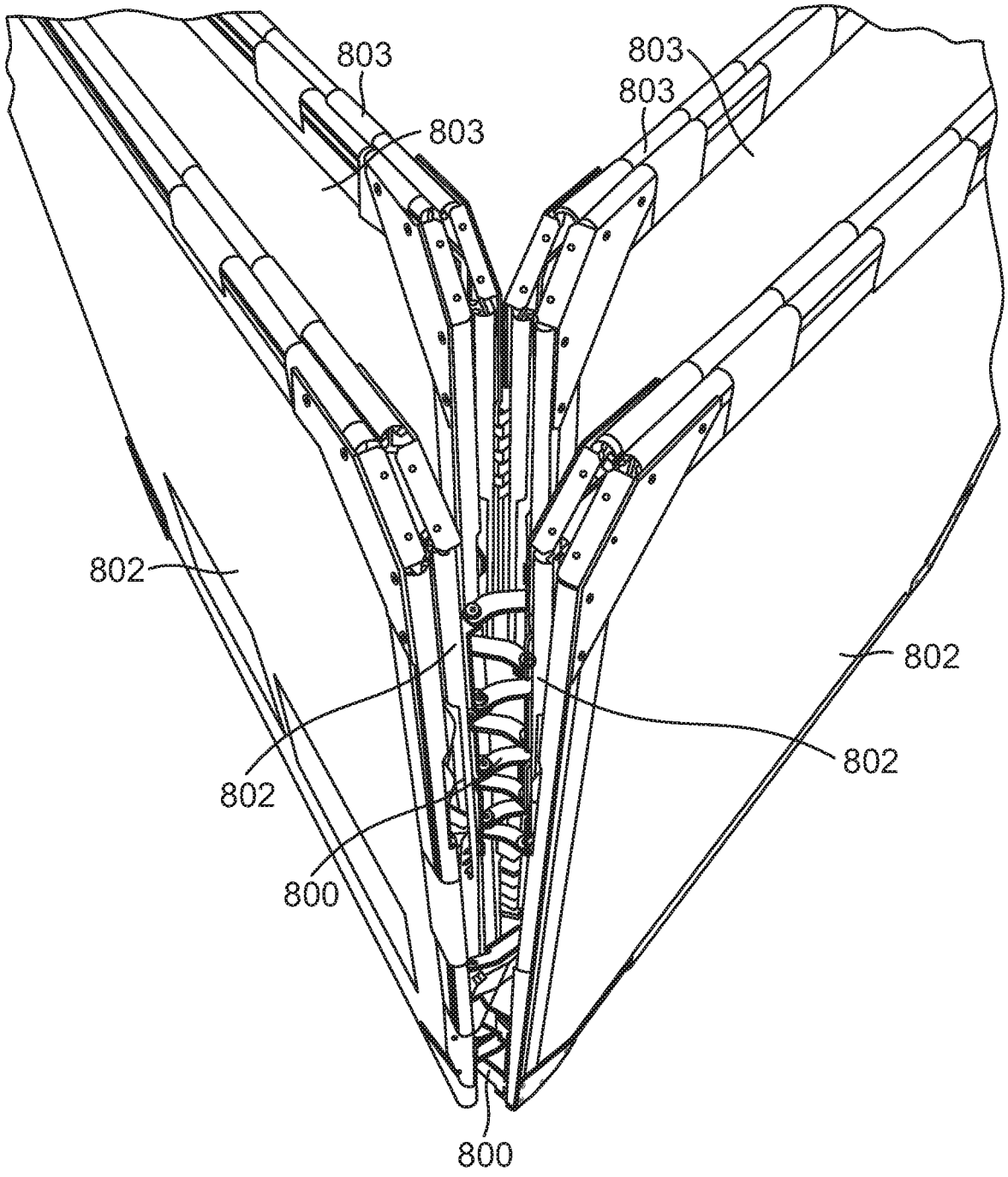
FIG. 27 illustrates an embodiment of yet another hinge utilized to swingably connect a pair of adjacent panels.

FIG. 27 illustrates a group 801 of panels 802 being folded using one embodiment of a hinge 800. The group 801 is in a row of the panels 802 (analogous to panels 518, 522 above). Panels 803 are part of rows that are nested when folded between the panels 802. The hinge 800 may be utilized to fold and unfold the group 801 of panels 802 in one of the collapsible shelters 628, 630.

Figure 28:
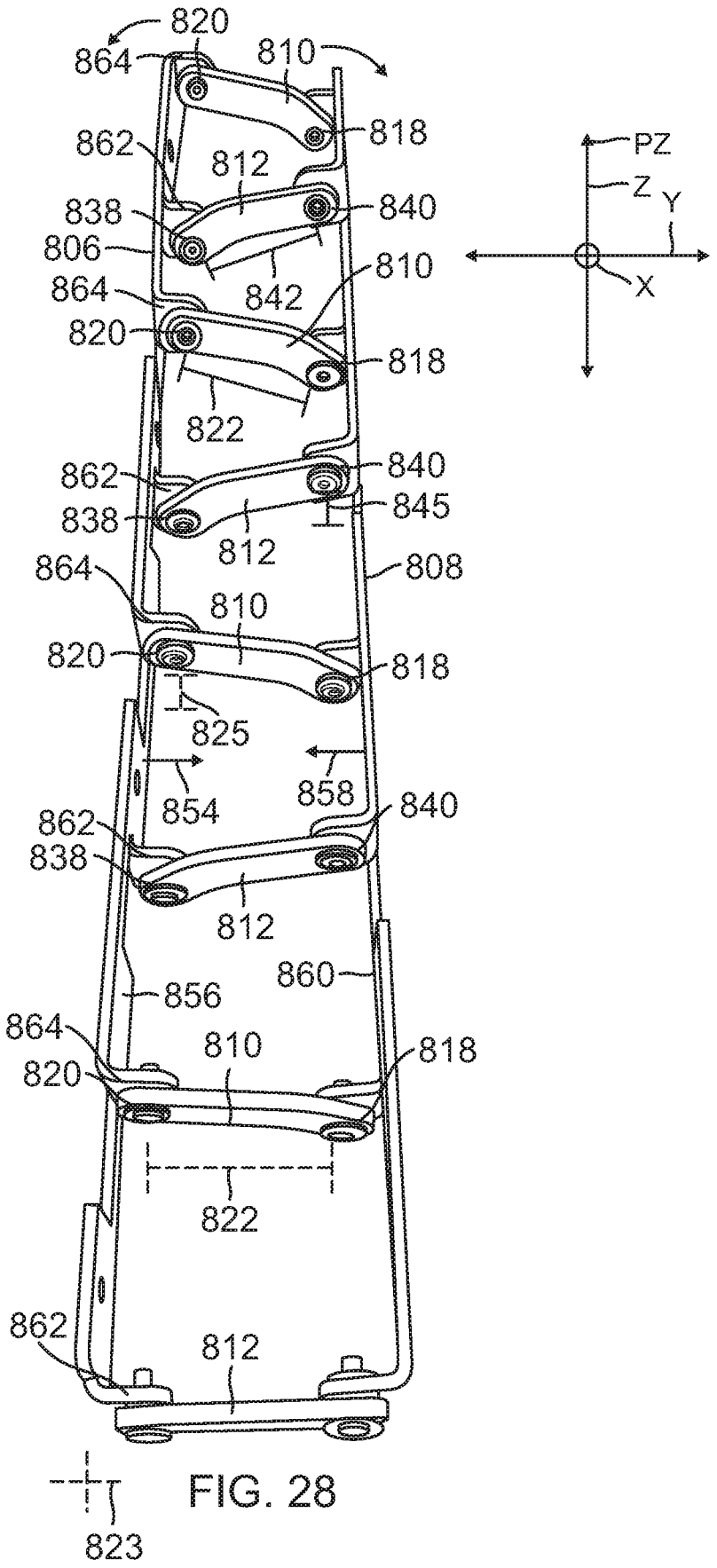
FIG. 28 illustrates the hinge shown in FIG. 27 in the folded state.
Figure 29:
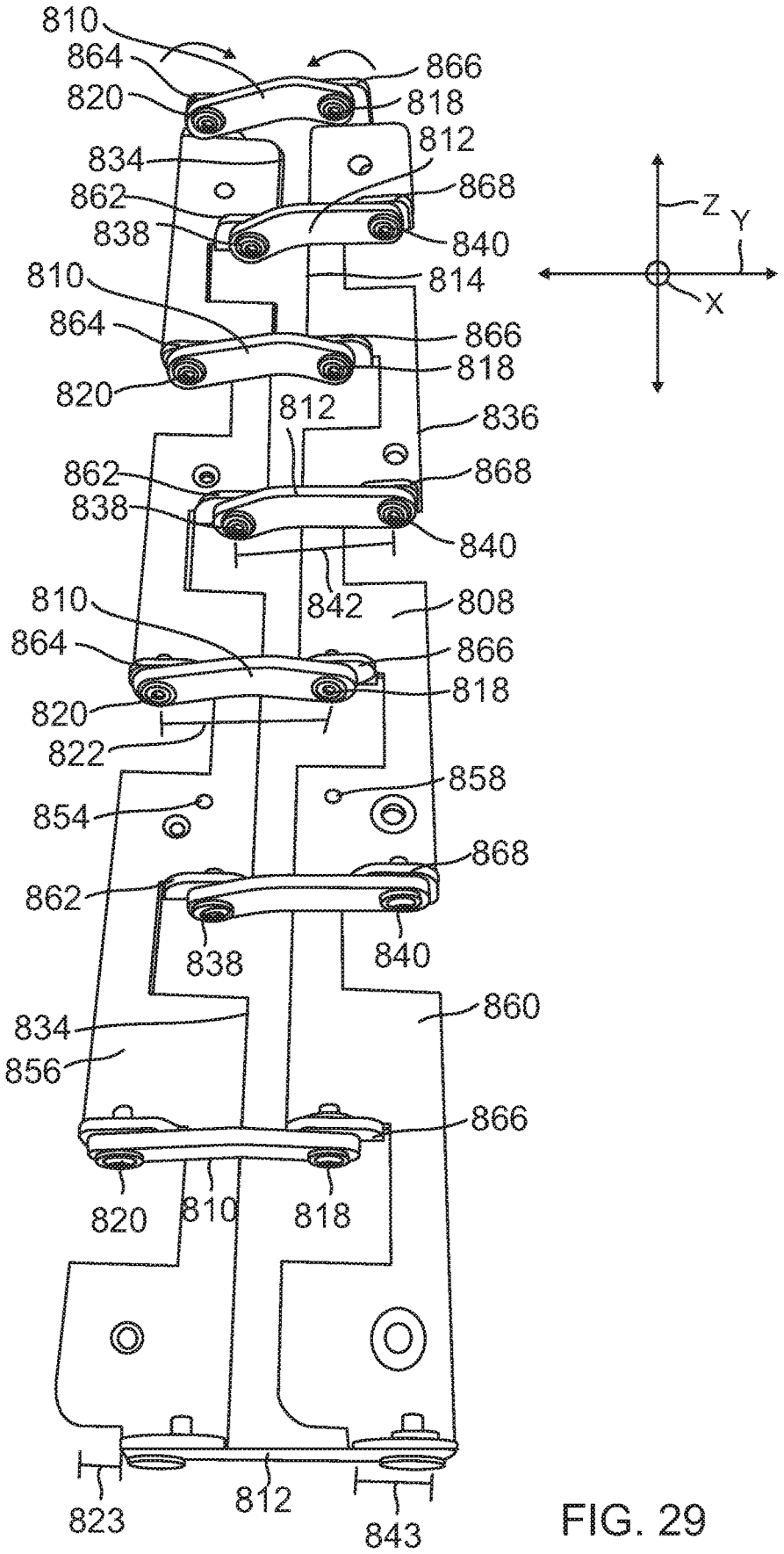
FIG. 29 illustrates the hinge shown in FIG. 27 in the unfolded state.

Referring now to FIG. 28 and FIG. 29, FIG. 28 illustrates the hinge 800 shown in FIG. 27 in the folded state while FIG. 29 illustrates the hinge 800 shown in FIG. 27 in the unfolded state. The embodiment of the hinge 800 shown in FIG. 28 and FIG. 29 is being utilized to fold the panels 802 that are analogous to the panels 522 discussed above. The x-y-z coordinates may be defined by first defining the z-axis with respect to an axis of rotation provided by the plates 806, 808. The x-direction and the y-direction are each orthogonal to each other and to the z-axis of rotation (in this case, the x-axis was selected to come out of the page). The hinge 800 includes a first plate 806 and an oppositely disposed second plate 808. Arms 810, 812 are coupled between the plates 806, 808 so that each of the plates 806, 808 can be provided in a folded state and in an unfolded state, as explained in further detail below. Each of the plates 806, 808 in the hinge 800 is designed to attach to one of a pair of adjacent panels 802 that are provided in a row of panels 802. The hinge 800 is designed to provide a cam action to make up for a greater distance in separation between the edges of the panels in the folded state than when the hinge 800 is in the unfolded state. The hinge 800 is configured to translate the difference in separation between two orthogonal directions and thereby allow the hinge 800 to fold nested rows of the panels 802, 804.

The first plate 806 and the second plate 808 may be attached to their respective panels 802 using any suitable technique. In one embodiment, the hinge 800 and thereby the plates 806, 808 are formed from a metallic material and the plates 806, 808 include apertures (not explicitly shown in FIG. 27) for screws that are used to attach the plates 806, 808, to their respective panel 802. In other embodiments, welding, adhesives, brackets, and/or the like may be used to attach the plates 806, 808 to their respective panels.

Each of the plates 806, 808 is configured to be turned about an axis of rotation that is approximately parallel to the z-axis. However, each of the plates 806, 808 is turned in opposite rotational directions in order to place them respectively in the folded state and in the unfolded state respectively. More specifically, looking in the direction of the positive direction along the z-axis, the plate 806 is turned in the counter-clockwise direction when turning the plate 806 from the folded state to the unfolded state. The plate 806 is turned in the clockwise direction to turn the plate 806 from the unfolded state to the folded state.

The plate 808 is oppositely disposed with respect to the plate 806 and more specifically has mirror symmetry with respect to the plate 806. As such, the plate 808 is turned in the clockwise direction when turning the plate 808 from the folded state to the unfolded state. The plate 808 is turned in the counter-clockwise direction to turn the plate 808 from the unfolded state to the folded state.

The arms 810 are coupled between the first plate 806 and the second plate 808 so as to turn the first plate 806. In this embodiment, each of the arms 810 is coupled from a proximal inner side edge 814 of the second plate 808 and to a distal outer side edge 816 of the first plate 806. Regarding the arms 810, the connection locations of the arms 810 are also evenly spaced relative to the z-axis For each of the arms 810, an end 818 of each of the arms 810 is movably connected to the proximal inner side edge 814 of the second plate 808 such that the ends 818 can be turned in the clockwise and counter clockwise direction. Each of the ends 818 is connected at different location along the z-axis to the second plate 80*s*.

Furthermore, an end 820 of each of the arms 810 is movably connected to the distal outer side edge 816 of the first plate 806 such that the end 820 can be turned in the clockwise and counter clockwise direction. However, note that as the first plate 806 is turned, the position of the ends 818 do not change while the position of the ends 820 relative to both the x-axis and the z-axis do change. More specifically, the arms 810 are bent so as to translate a distance 822 between the ends 818, 820 more in a direction along the y-axis when the first plate 806 is in the unfolded state and more in a direction along the x-axis when the first plate 806 is in the folded state. The additional distance along the y-axis in the unfolded state is labeled as 823 and the additional distance along the x-axis in the folded state is labeled as 825. Again, the x-axis and the y-axis are orthogonal to each other. Thus, the arms 810 are bent to translate the distance 822 more in the y-axis (negative direction along the y-axis) when the first plate 806 is in the unfolded state and more in the x-axis (positive direction along the x-axis) when the first plate 806 is in the folded state. This provides a dual cam action along the y-axis and the x-axis that allows for the first plate 806 to operate with its attached panel 802 (See FIG. 27).

With regard to the arms 812, looking in the direction of the positive direction pz along the z-axis, the plate 808 is turned in the clockwise direction when turning the plate 808 from the folded state to the unfolded state. The plate 808 is turned in the counter-clockwise direction to turn the plate 808 from the unfolded state to the folded state.

The arms 812 are coupled between the first plate 806 and the second plate 808 so as to turn the second plate 808. In this embodiment, each of the arms 812 is coupled from a proximal inner side edge 834 of the first plate 806 and to a distal outer side edge 836 of the second plate 808. Regarding the arms 812, the connection locations of the arms 812 are also evenly spaced relative to the z-axis For each of the arms 812, an end 838 of each of the arms 812 is movably connected to the proximal inner side edge 834 of the first plate 806 such that the ends 838 can be turned in the clockwise and counter clockwise direction. Each of the ends 838 is connected at different location along the z-axis to the second plate 80*s*.

Furthermore, an end 840 of each of the arms 812 is movably connected to the distal outer side edge 836 of the second plate 808 such that the end 840 can be turned in the clockwise and counter clockwise direction. However, note that as the second plate 808 is turned, the position of the ends 838 do not change while the position of the ends 840 relative to both the x-axis and the z-axis do change. More specifically, the arms 812 are bent so as to translate a distance 842 between the ends 838, 840 more in a direction along the y-axis when the second plate 808 is in the unfolded state and more in a direction along the x-axis when the second plate 808 is in the folded state. The additional distance along the y-axis in the unfolded state is labeled as 843 and the additional distance along the x-axis in the folded state is labeled as 845. Again, the x-axis and the y-axis are orthogonal to each other. Thus, the arms 812 are bent to translate the distance 842 more in the y-axis (positive direction along the y-axis) when the second plate 808 is in the unfolded state and more in the x-axis (positive direction along the x-axis) when the second plate 808 is in the folded state. This provides a dual cam action along the y-axis and the x-axis that allows for the second plate 808 to operate with its attached panel 802 (See FIG. 27).

In this embodiment, the arms 810 and the arms 812 are configured so that the first plate 806 and the second plate 808 face one another in a folded state (See FIG. 28) and are on substantially a same plane (in this case, the z-y plane) in an unfolded state (See FIG. 29). As such, in the folded state, a normal 854 of an interior surface 856 of the first plate 806 and a normal 858 of an interior surface 860 of the second plate 806 are parallel but point in opposing directions (in this case, opposing directions along the y-axis). In the unfolded state, the normal 854 and the normal 858 are parallel and point in the same direction (out of the page along the x-axis). In other embodiments, this may not be the case. For instance, the angular displacement of the normals 854, 858 from the unfolded state and the folded state may not be 90 degrees in other embodiments. In such a case, the normals 854, 858 may not end up parallel to one another in either the folded state or the unfolded state but rather may have some other form of angular relationship. The angular displacement between the unfolded and folded states may depend on the requirements for the geometric relationship between the panels 802 in the folded state and in the unfolded state.

Note that the shape of the first plate 806 is provided so that the first plate 806 has tabs 862 that extend parallel to the normal 854 and near the proximal inner side edge 834 of the first plate 806 such that the ends 838 of arms 812 can be attached and turned. Furthermore, the shape of the first plate 806 is provided so that the first plate 806 has tabs 864 that extend parallel to the normal 854 and near the distal outer side edge 816 of the first plate 806 such that the ends 820 of arms 810 can be attached and turned. The shape of the second plate 808 is provided so that the second plate 808 has tabs 866 that extend parallel to the normal 858 and near the proximal inner side edge 814 of the second plate 808 such that the ends 818 of arms 810 can be attached and turned. Furthermore, the shape of the second plate 808 is provided so that the second plate 808 has tabs 868 that extend parallel to the normal 858 and near the distal outer side edge 836 of the second plate 808 such that the ends 830 of arms 812 can be attached and turned.

Figure 30:
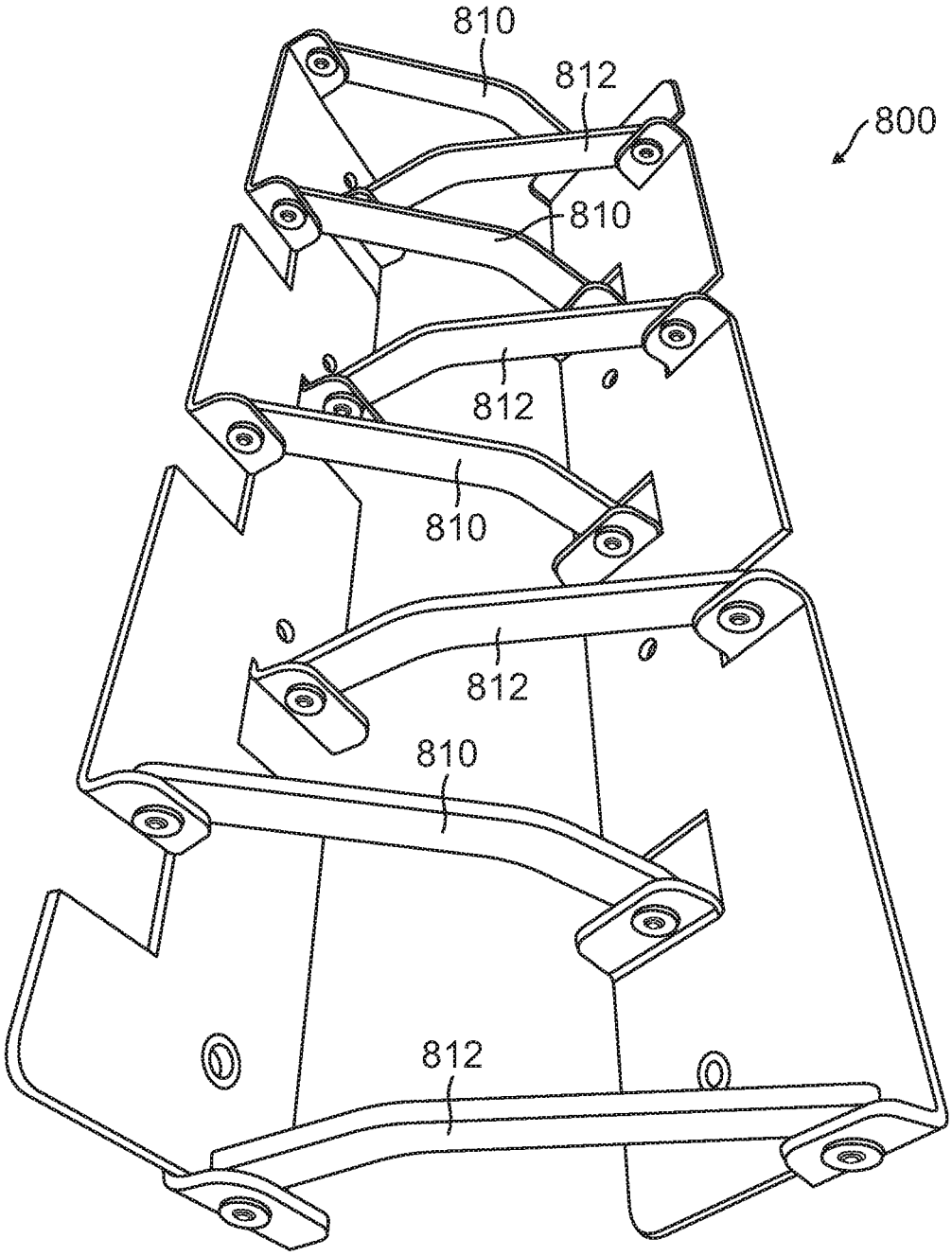
FIG. 30 illustrates another embodiment of the hinge shown in FIG. 27 but with longer arms.

FIG. 30 illustrates another embodiment of the hinge 800. The embodiment of the hinge 800 in FIG. 30 is the same as the embodiment of the hinge 800 in FIG. 27-FIG. 29, except that in FIG. 30, the arms 810 and the arms 812 are longer. It should be noted that the length of the arms 810, 812 may depend on whether the panels 802 to be folded have more folded panels 802, 804 to be placed between its folded panels 802 and how many layers of the folded panels 802, 804 are to be placed in between the panels 802 that are to be folded by the hinge 800. For example, the hinge 800 used in FIG. 30 may be used to fold the panels 802 that are analogous to the panels 518 and thus have an additional row of nested panels 802, 804 and thus require additional separation in the folded state.

Figure 31A:
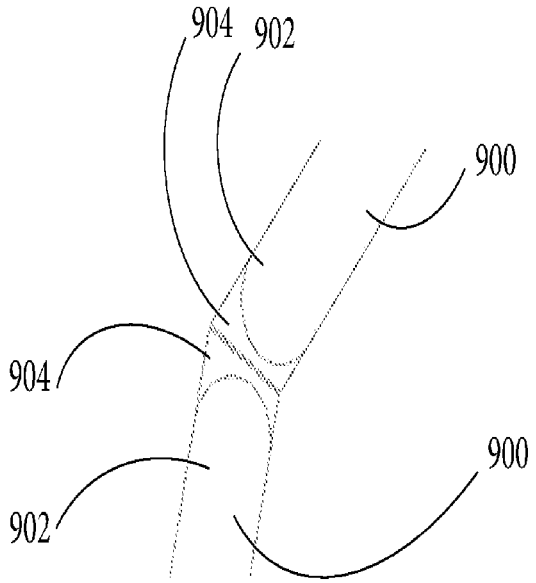
FIG. 31A-FIG. 40 illustrates different techniques for sealing a collapsible structure.

FIG. 31A-FIG. 36B illustrate gasket approach to sealing edges between a pair of panels. FIG. 31A-FIG. 33B illustrates using a gasket approach to seal adjacent edges 902 of adjacent panels 900. In this case, each of the edges 902 is rounded. FIG. 31A illustrates the use of mating gaskets 904 in order to seal the edges 902. FIG. 31B illustrates the mating gaskets 904 when the mating gaskets 904 are separated. As shown by FIG. 31A and FIG. 31B, the mating gaskets 904 are solid and not flexible. Thus, the mating gaskets 904 are not reshaped by pressure.

Figure 32A:
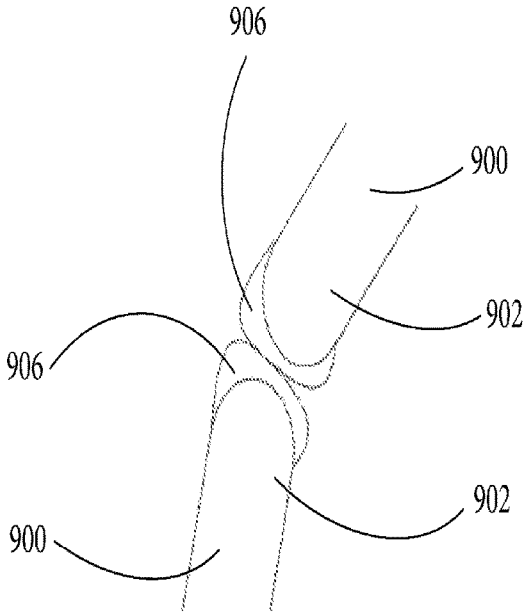
Figure 32B:
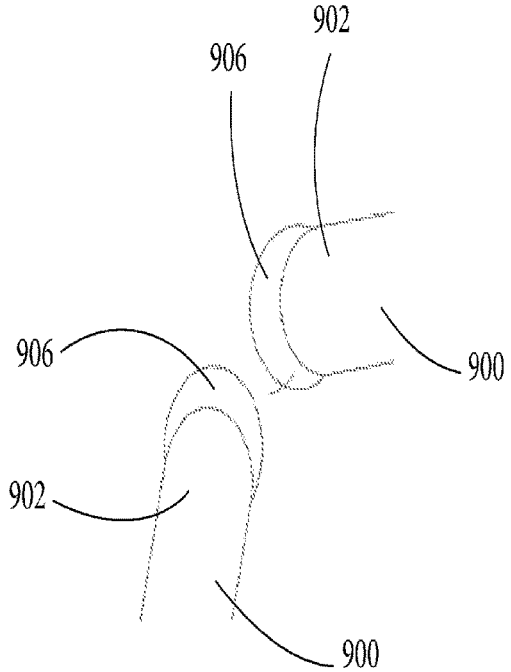

FIG. 32A illustrates the use of gasket bulbs 906 in order to seal the edges 902. FIG. 32B illustrates the gasket bulbs 906 when the gasket bulbs 906 are separated. As shown by FIG. 32A and FIG. 32B, the gasket bulbs 906 are flexible and compress under pressure. Thus, the gasket bulbs 906 are reshaped by pressure.

Figure 33A:
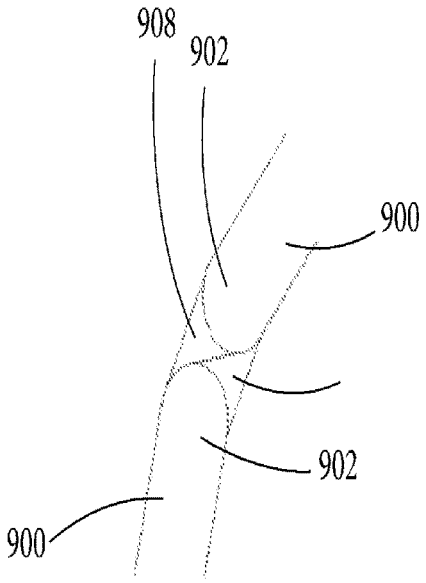
Figure 33B:
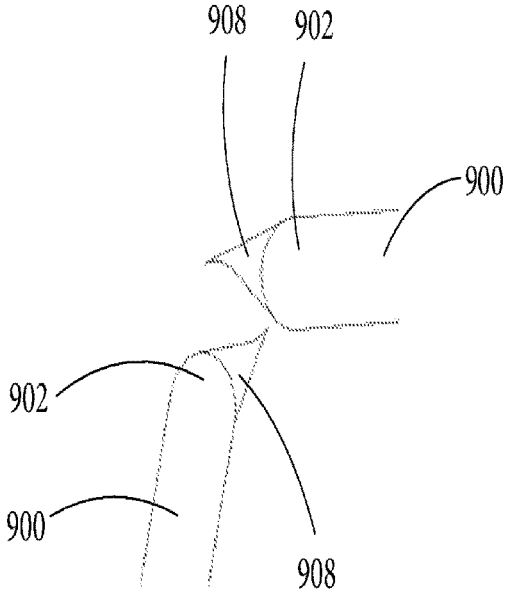

FIG. 33A illustrates the use of overlapping gaskets 908 in order to seal the edges 902. FIG. 33B illustrates the overlapping gaskets 908 when the overlapping gaskets 908 are separated. As shown by FIG. 33A and FIG. 33B, the overlapping gaskets 908 are not flexible and do not compress under pressure. Thus, the overlapping gaskets 908 are not reshaped but rather connect once joined.

Figure 31B:
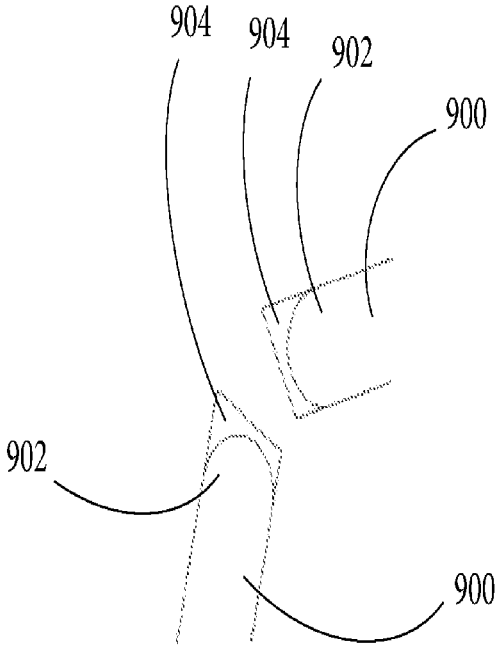
Figure 34A:
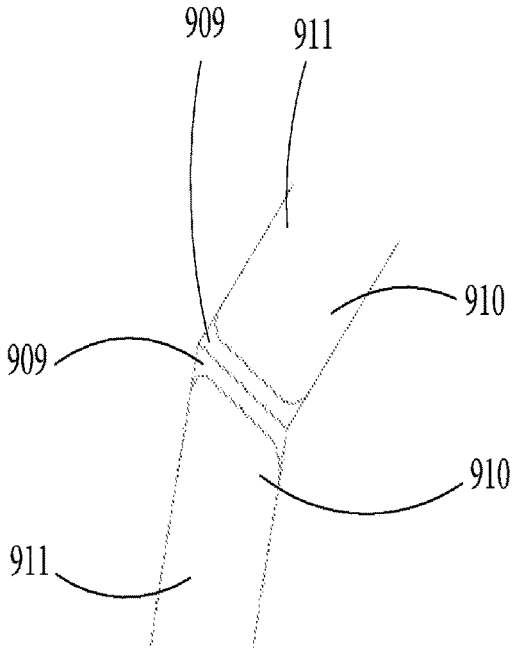
Figure 34B:
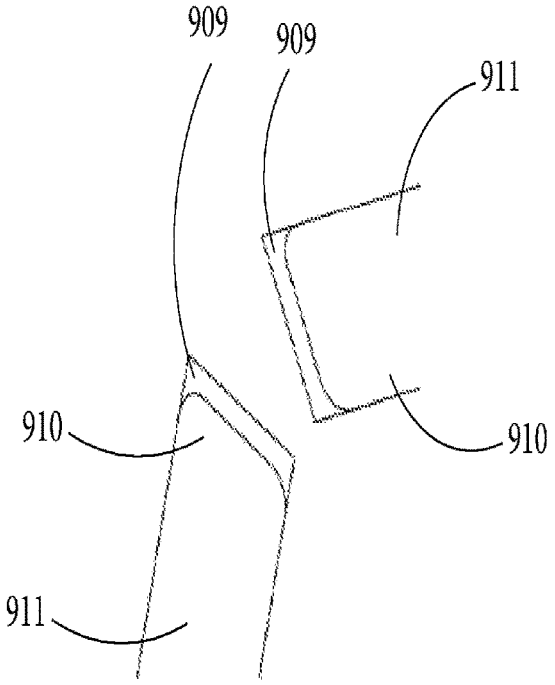

FIG. 34A illustrates the use of mating gaskets 909 in order to seal the edges 910. The edges 910 of the panels 911 in this case are mitered edges. FIG. 31B illustrates the mating gaskets 909 when the mating gaskets 909 are separated. As shown by FIG. 34A and FIG. 34B, the mating gaskets 909 are solid and not flexible. Thus, the mating gaskets 909 are not reshaped by pressure.

Figure 35A:
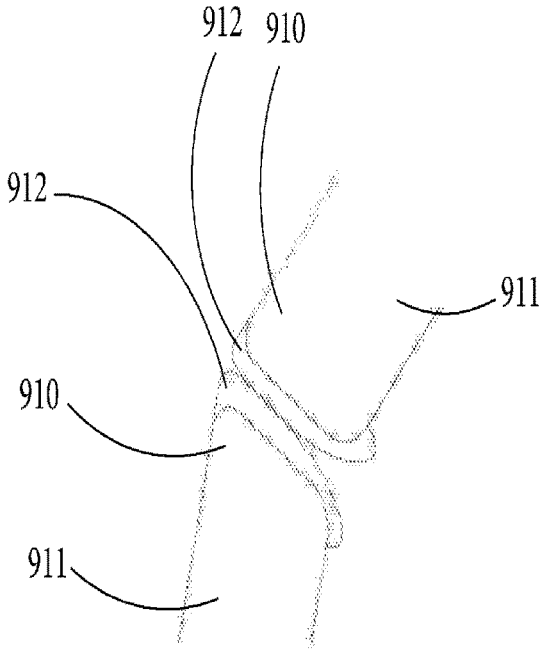
Figure 35B:
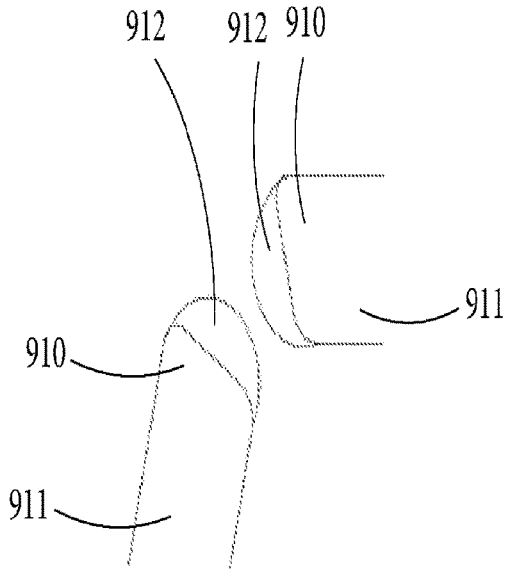

FIG. 35A illustrates the use of gasket bulbs 912 in order to seal the edges 910. FIG. 35B illustrates the gasket bulbs 912 when the gasket bulbs 912 are separated. As shown by FIG. 35A and FIG. 35B, the gasket bulbs 912 are flexible and compress under pressure. Thus, the gasket bulbs 912 are reshaped by pressure.

Figure 36A:
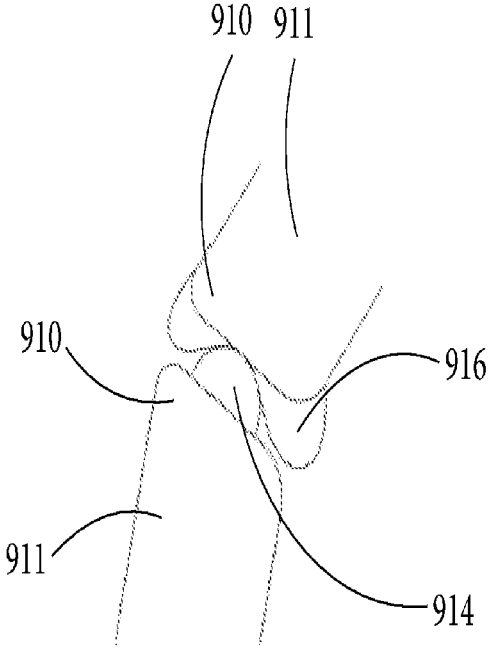
Figure 36B:
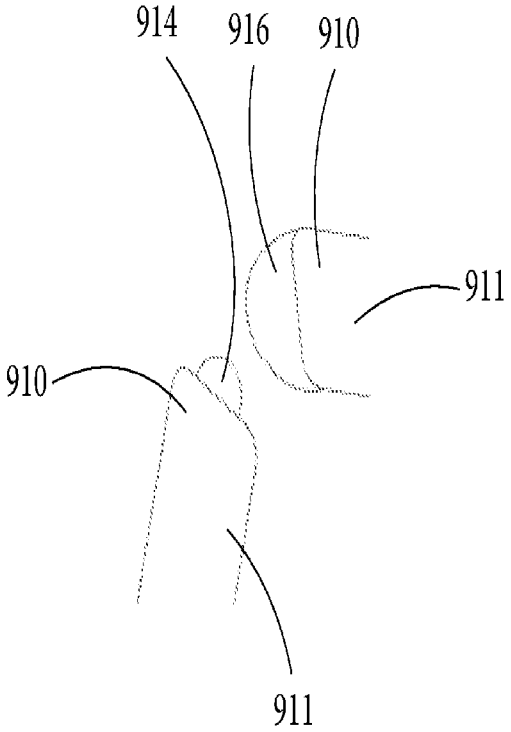

FIG. 36A illustrates the use of bead and bulb gaskets 914,116 in order to seal the edges 910. The gasket 914 is a bead gasket while the gasket 916 is a gasket bulb. FIG. 36B illustrates the bead and bulb gaskets 914,116 when the bead and bulb gaskets 914, 916 are separated. As shown by FIG. 36A and FIG. 36B, the bead gasket 914 is not flexible and do not compress under pressure. Thus, the bead gasket 914 is not reshaped by pressure. However, the gasket bulb 916 is flexible and does compress under pressure when the bead gasket 914 presses into it.

Figure 37A:
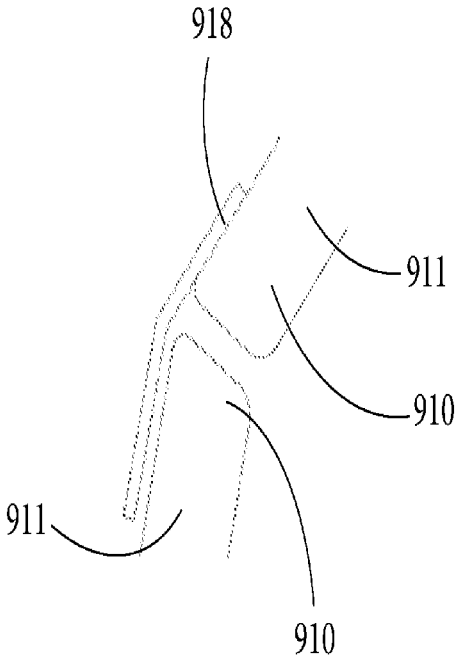
Figure 37B:
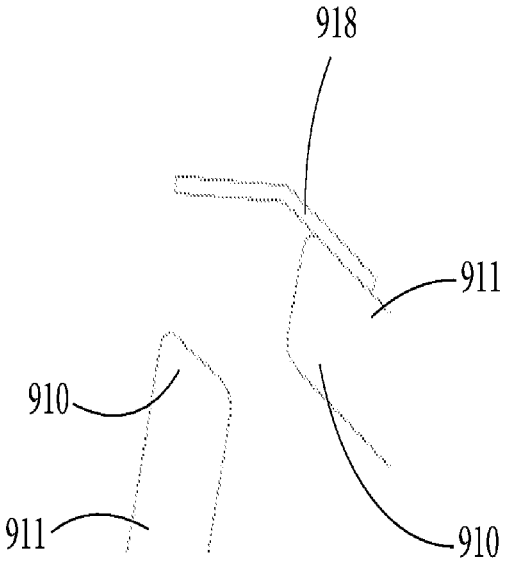

A second approach to sealing the edges is to have a waterproof fabric or plastic cover that covers the edges but is not attached to allow for the panels to be provided in the folded and unfolded states. FIG. 37A-FIG. 38B illustrates this approach. FIG. 37A illustrates a flap cover 918 that is attached to one of the panels 911 so as to cover the edges 910. The flap cover 918 may be made from a waterproof material. FIG. 37B illustrates the flap cover 918 and the panels 911 once the edges 910 have been separated. As shown in FIG. 37B, the flap cover 918 is only attached to one of the panels 911 so that the flap cover 918 does not constrict the movement of the panels 911 with respect to the edges 910.

Figure 38A:
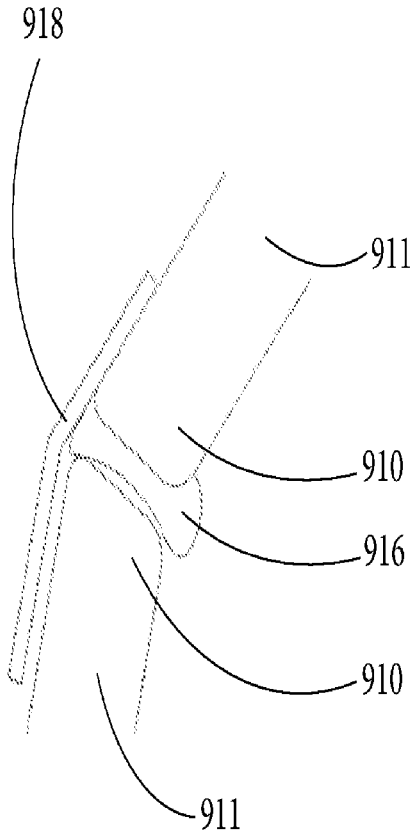
Figure 38B:
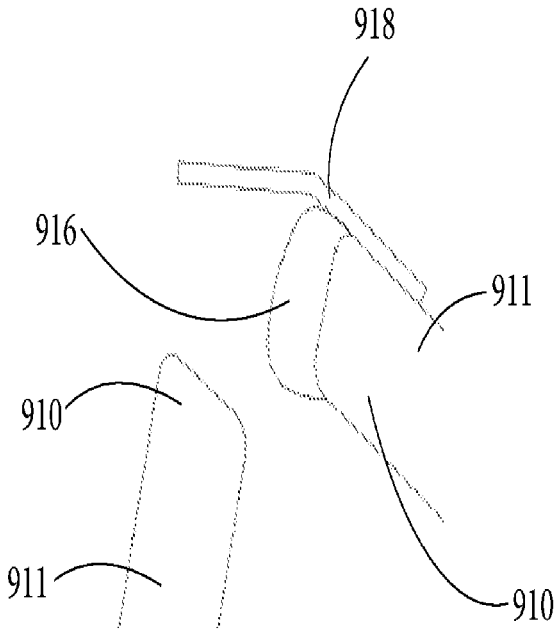

FIG. 38A illustrates that a flap cover 918 may be used in conjunction with the gasket bulb 916. The flap cover 918 is the same one described above with respect to FIG. 37A and FIG. 37B. However, in this embodiment, the gasket bulb 916 is attached to the edge 910 of the same panel 911 that the flap cover 918 is attached to in order to help seal the edges 910. In other embodiments, the flap cover 918 and the gasket bulb 916 may be attached to different panels 911. FIG. 38B illustrates the panels 911, the gasket bulb 916, and the flap cover 918 when the panels 911 are being placed in the folded state.

Figure 39A:
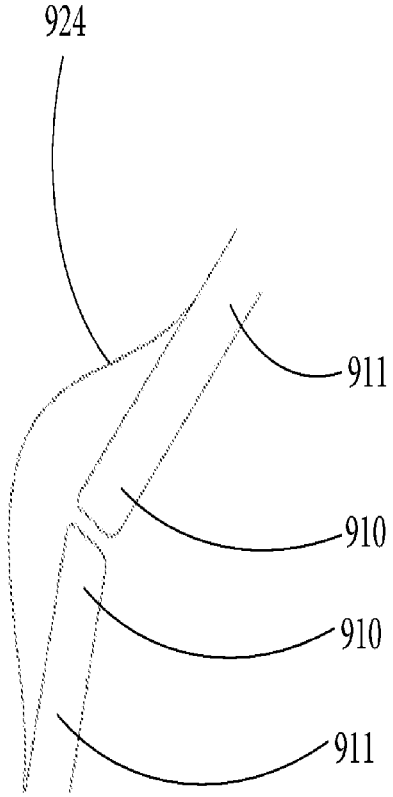
Figure 39B:
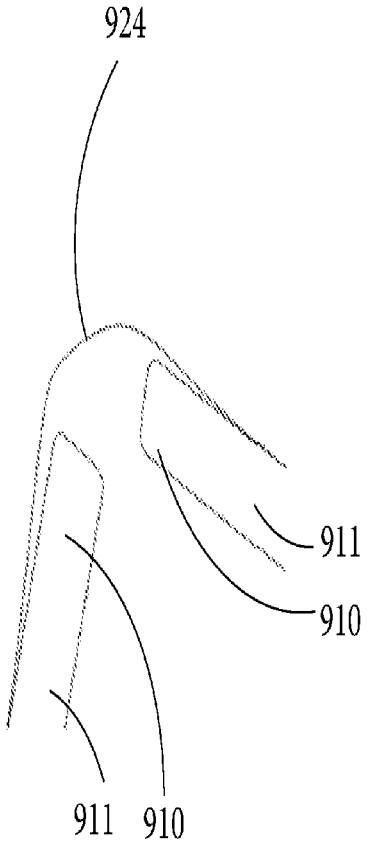

A third approach to sealing the edges is to have a water proof fabric or plastic cover boded over the edges with enough slack to allows the panels to be provided in the folded and unfolded states. FIG. 39A illustrates a flap cover 922 that is attached to both panels 911 and cover the edges 910. The panels 911 are in the unfolded state. FIG. 39B illustrates the panels 911 as the panels 911 are being provided in the folded state. As shown by FIG. 39A and FIG. 39B, the flap cover 922 is provided with sufficient slack so as to allow for the panels 911 to be provided in the folded and unfolded states.

The fourth approach is to have a waterproof fabric or plastic covering encompassing the whole collapsible structure. FIG. 39A-FIG. 39B illustrates a fitted sheet 924 that has been attached over the entire exterior of a collapsible structure, such as the collapsible structures 628, 630. FIG. 310A illustrates the panels 911 in the unfolded state and FIG. 39B illustrates the panels 911 being provided in the folded state. The fitted sheet 924 is sized larger than the collapsible structure so that there is sufficient allowance to allow for the collapsible structure to be provided in the erected state and the collapsed state.

Figure 40:
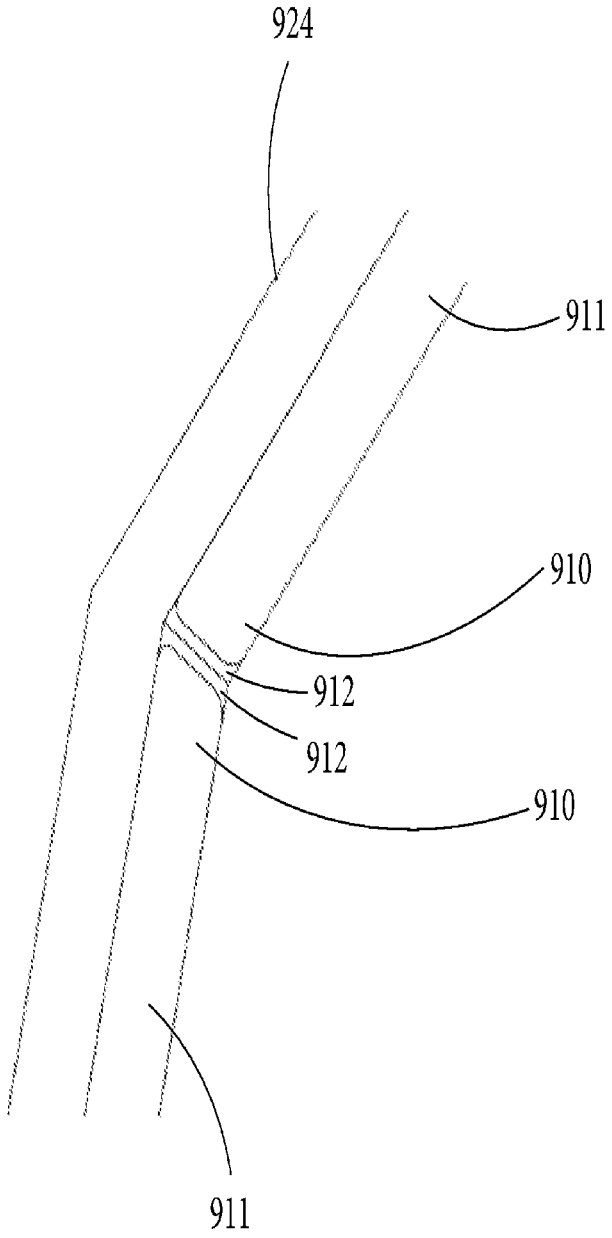

The fifth approach is to have a combination of the above referenced sealing techniques. FIG. 40 illustrates an example where the fitted sheet 924 is being used in combination with the gasket bulbs 912. However, it should be noted that any of the techniques described in FIG. 31A-FIG. 39B may be combined to seal a collapsible structure, such as the collapsible structures 628, 630.

Figure 41:
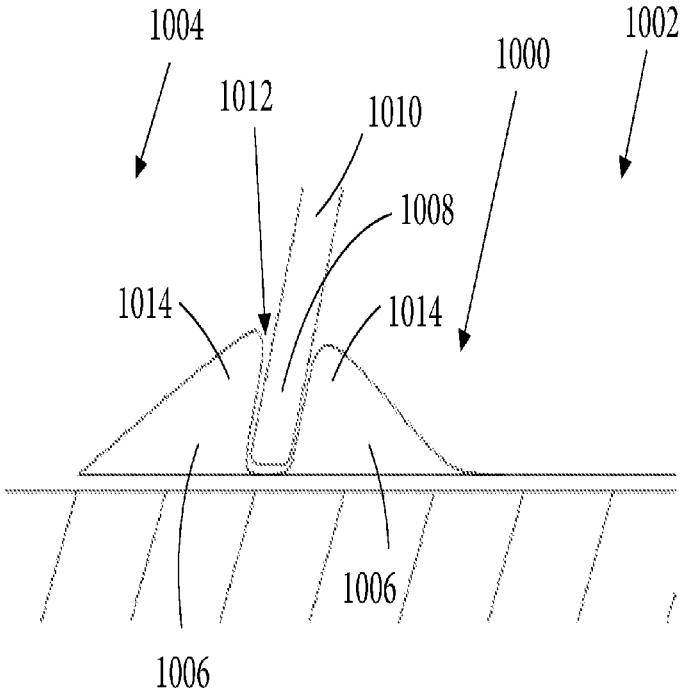
FIG. 41 illustrates an edge gasket that may be placed on the ground to help support a collapsible structure in the erected state.

FIG. 41 illustrates one embodiment of a ground attachment and sealing system 1000 that may be utilized to help support a collapsible structure, such as the collapsible structures 628, 630, when they are in the erected state. The ground attachment and sealing system 1000 also is configured to help protect an interior 1002 of the collapsible structure from environmental conditions (e.g., rain, snow, dust, dirt) at the exterior 1004 of the collapsible structure. To do this, edge gaskets 1006 are provided on the ground so that bottom edges 1008 of the bottom most panels 1010 can be placed within a slot 1012 formed by the edge gaskets 1006. Bottom edges 1008 would the bottom most edges of the panels 1010 of the collapsible structure that would rest on the ground. A plurality of the ground attachment and sealing systems 1000 may be placed on the ground so as to help support the collapsible structure in the erected state. When the collapsible structure is in the erected state, the bottom edges 1008 of the bottom most panels 1010 are inserted into slots 1012 formed by the edge gaskets 1006. The slots 1012 are defined by two opposing bulges 1014. The bulges 1014 are configured so that the angular orientation of the slot 1012 matches the angular orientation of the bottom most panel 1010 with respect to the ground.

Figure 42:
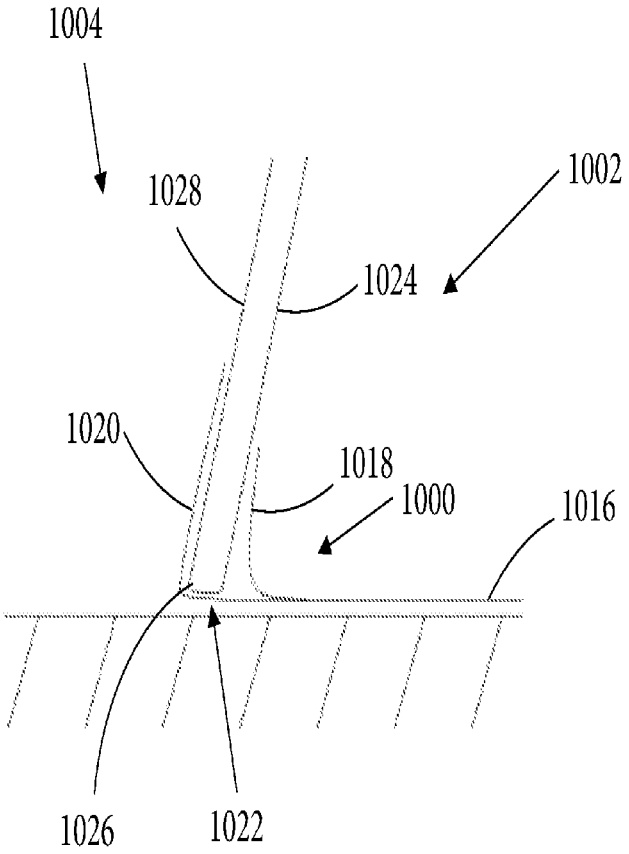
FIG. 42 illustrates one embodiment of a ground sheet that may be utilized to seal the collapsible structure.

FIG. 42 illustrates a ground sheet 1016 that may be provided and form part of the ground attachment and sealing system 1000. Thus, instead of sitting directly on the ground, the ground sheet 1016 may be laid on top of the ground and the collapsible structure may lay on the ground sheet 1016. The edge gaskets 1006 discussed with respect to FIG. 41 may be formed or may be mounted on the ground sheet 1016. The ground sheet 1016 may be provided out of two ground sheet layers 1018, 1020 that are integrated into one another except for at the outer edges 1022. The ground sheet layer 1018 may be provided to cover the interior surface 1024 of the bottom edge 1008 of the bottom most panel 1010 while the bottom surface 1026 and exterior surface 1028 of the bottom most panel 1010 is covered by the other ground sheet layer 1020 at the exterior 1004. Ground sheet 1016 thus provides an integrated water seal while the edge gaskets 1006 provide a supporting edge at the bottom of arches.

Figure 43:
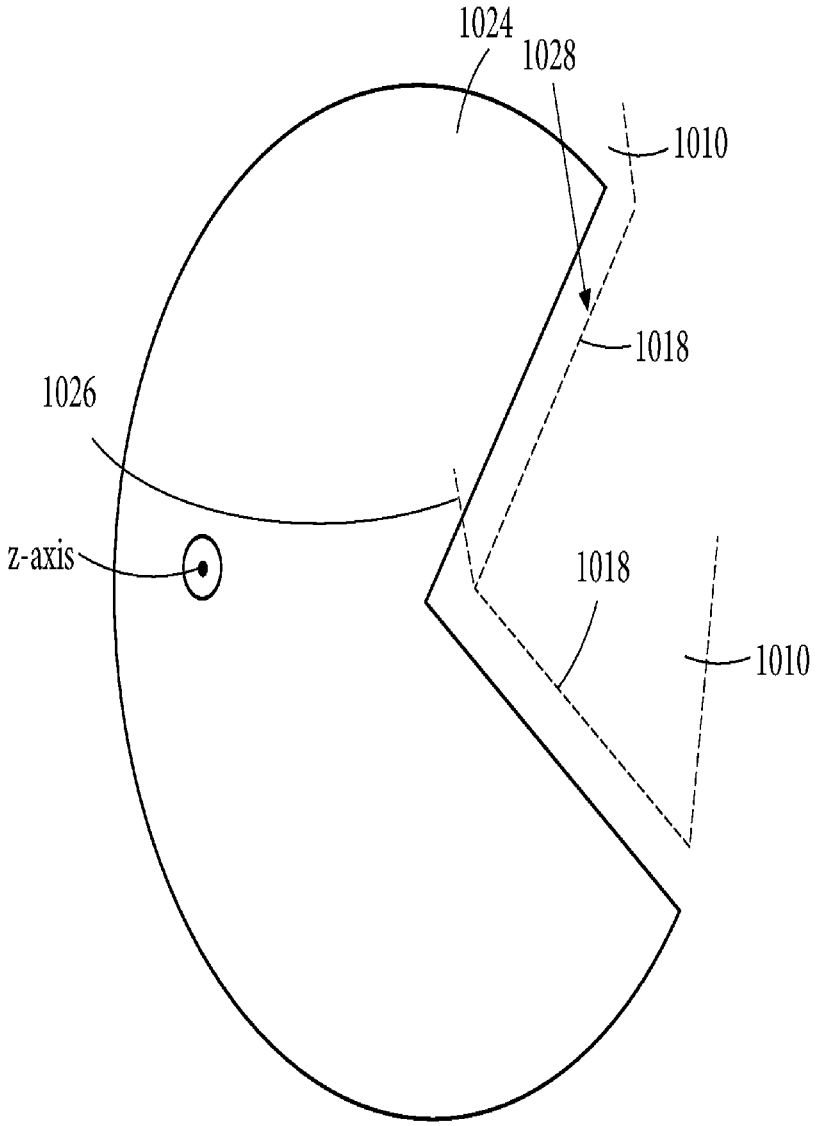
FIG. 43 illustrates an embodiment of a footpad that may be utilized to help support the collapsible structure when the collapsible structure is in the erected state.

FIG. 43 illustrates a footpad 1024 that may be provided at the bottom edges 1018 of the bottom most panels 1010. In particular, the footpad 1024 may be utilized where adjacent one of the bottom most panels 1010 form an arch peak 1026. An insertion slot 1028 may be defined by the footpad 1024 so that the arch peak 1026 rests in the footpad 1024. Thus, the insertion slot 1028 may be shaped in accordance with the arch peak 1026. Footpads 1024 may be provided at both sides of each arch in the collapsible structure so that each side of the arch peak 1026 of every arch is supported by footpads 1024. Note that the footpads 1024 may be configured to rotate about an axis parallel to the z-axis (coming out of page). This allows for the footpads 1024 to be rotated as the collapsible structure is being assembled so that it becomes easier to insert the arch peaks 1026 within the insertions slots 1028.

Figure 44:
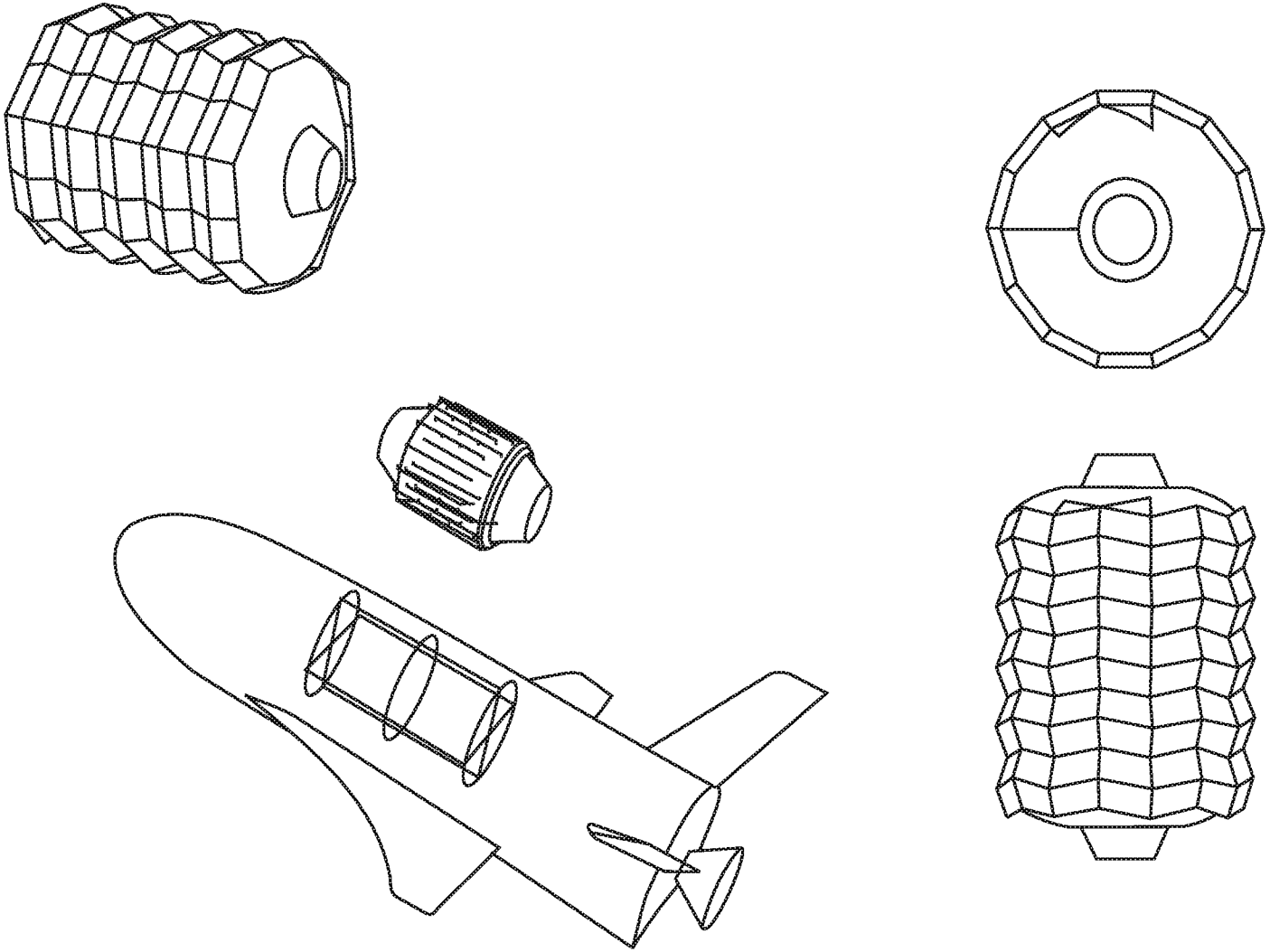
FIG. 44 illustrates another embodiment of a collapsible shelter, which may be used for the space industry.

FIG. 44 illustrates another embodiment of a collapsible shelter, which may be used for the space industry. The collapsible shelter is configured with panels so as to provide shelter to humans in space in the erected state. In one embodiment, the collapsible shelter has a rigid exterior shell and provides over 450 cubic feet of volume. The collapsible shelter may also include docking adaptor to connect to collapsible shelters such as itself. In the collapsed state, the collapsible shelter folds and stows easily within an X37 payload volume. In this manner, the collapsible shelter can be transported to outer space in a space vehicle.

Those skilled in the art will recognize improvements and modification to the preferred embodiments of the present disclosure. All such improvements and modifications are considered within the scope of the concepts disclosed herein and the claims that follow.

What is claimed is:

1. A collapsible structure, comprising:

a plurality of hinges;

a plurality of panels, wherein the plurality of panels are swingably connected by the plurality of hinges so as to form at least one arch when the collapsible structure is in an erected state and so as to become at least one stack of the plurality of panels in a collapsed state, wherein the at least one arch comprises a tubular arched structure in the erected state, wherein the plurality of panels comprise a first row of panels and a second row of panels that are adjacent to the first row of panels, the first row of panels being directly connected to the second row of panels by at least one of the plurality of hinges; and wherein, the at least one of the plurality of hinges are configured to connect the first row of panels and the second row of panels such that a first stack of the at least one stack of panels include both the first row of panels and the second row of panels in the collapsed state and such that the first row of panels and the second row of panels are interleaved in the first stack in the collapsed state.

2. The collapsible structure of claim 1, wherein the tubular arched structure comprises tubular sections that are connected by the plurality of hinges so as to form the tubular arched structure in the erected state.

3. The collapsible structure of claim 2, wherein each of the tubular sections comprises a different set of panels of the plurality of panels such that each of the set of panels of the plurality of panels provides walls of a respective one of the tubular sections.

4. The collapsible structure of claim 3, wherein the tubular sections form a row of the tubular sections and wherein a set of hinges of the plurality of hinges are configured to swingably connect the tubular sections such that the row of tubular sections forms a first arch of the at least one arch.

5. The collapsible structure of claim 4 further comprising means for inflating the row of tubular sections from the collapsed state to the erected state.

6. The collapsible structure of claim 1, wherein:

the plurality of panels comprise a first panel and a second panel;

the plurality of hinges comprise a first hinge, wherein the first hinge comprises:

a first strip having a first section that connects to the first panel on a first side and a second section that connects to the second panel on a second side;

a second strip having a third section that connects to the second panel on the first side and a fourth section that connects to the first panel on the second side.

7. The collapsible structure of claim 6, wherein the first hinge further comprises a first member attached to the first panel and a second member attached to the second panel wherein the first member and second member abut each other and the first strip goes around the second member to connect to the second side of the second panel and the second strip goes around the first member to connect to the first side of the first panel.

* * * * *